US007088935B2

(12) United States Patent
Kagawa et al.

(10) Patent No.: US 7,088,935 B2
(45) Date of Patent: Aug. 8, 2006

(54) HEATER, AND IMAGE FORMING APPARATUS, HEATING METHOD INCORPORATING SAME

(75) Inventors: Toshiaki Kagawa, Kitakatsuragi-gun (JP); Tetsunori Mitsuoka, Habikino (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 11/229,412

(22) Filed: Sep. 16, 2005

(65) Prior Publication Data

US 2006/0013606 A1 Jan. 19, 2006

Related U.S. Application Data

(62) Division of application No. 10/769,679, filed on Jan. 30, 2004.

(30) Foreign Application Priority Data

Jan. 30, 2003 (JP) ..... 2003-022364
Jan. 30, 2003 (JP) ..... 2003-022412
Jan. 30, 2003 (JP) ..... 2003-022461

(51) Int. Cl.
*G03G 15/20* (2006.01)

(52) U.S. Cl. ..... 399/68; 399/69; 399/67

(58) Field of Classification Search ..... 399/68
See application file for complete search history.

(56) References Cited

U.S. PATENT DOCUMENTS 6,389,261 B1 5/2002 Fratangelo et al.
2002/0141795 A1* 10/2002 Hirst et al. ..... 399/328

FOREIGN PATENT DOCUMENTS

| | | |
|---|---|---|
| JP | 08-179644 | 7/1996 |
| JP | 09-244448 | 9/1997 |
| JP | 2000-338818 | 12/2000 |
| JP | 2002-049265 | 2/2002 |

* cited by examiner

*Primary Examiner*—Arthur T. Grimley
*Assistant Examiner*—Ryan D. Walsh
(74) *Attorney, Agent, or Firm*—George W. Neuner; David G. Conlin; Edwards Angell Palmer & Dodge LLP

(57) ABSTRACT

A fixer (heater) includes a heat roller and a pressure roller pressing each other. The fixer heats a heated material by passing the heated material through a press region where the heat roller and the pressure roller meet. The fixer further includes an external heat roller heating the pressure roller from outside the pressure roller. A transit time taken for any given point on the heated material to pass through the press region is less than or equal to $2.3\times10^{-2}$ sec. The surface temperature, T1 (° C.), of the heat roller and the surface temperature, T2 (° C.), of the pressure roller satisfy T1−T2≦100 (° C.), and preferably satisfy T1−T2≦70 (° C.). The load on the heat roller is reduced, and so is the power consumption.

6 Claims, 35 Drawing Sheets

HEATER, AND IMAGE FORMING APPARATUS, HEATING METHOD INCORPORATING SAME

CROSS REFERENCE TO RELATED APPLICATIONS

This application is a divisional of U.S. Ser. No. 10/769,679 filed Jan. 30, 2004, which is incorporated in its entirety herein by reference.

This Nonprovisional application claims priority under 35 U.S.C. § 119(a) on Patent Applications Nos. 2003-22461, 2003-22412, 2003-22364, all filed in Japan on Jan. 30, 2003, the entire contents of which are hereby incorporated by reference.

FIELD OF THE INVENTION

The present invention relates to heaters heating a medium under heat and pressure, as well as image forming apparatuses and heating methods incorporating such a heater.

BACKGROUND OF THE INVENTION

When used as a fixer fixing an developing agent on a recording medium in copying machines, printers, and other electrophotographic image forming apparatuses, heaters heating a medium (heated material) under heat and pressure are typically arranged to operate according to heat roller fixing.

A fixer arranged to operate according to heat roller fixing has a pair of rollers (heat and pressure rollers) disposed to press each other. Inside the roller (heat roller) in contact with the toner image side of a recording medium (recording paper) is provided heating means, such as a halogen heater.

The heat roller is heated to a predetermined temperature (fixing temperature) by the heating means. Then, a recording medium carrying an unfixed toner image is passed through a pressure application section (fix nip section) of the heat and pressure rollers where the toner image is fixed under heat and pressure.

A disadvantage of heat roller fixing is that it takes a long time (warm-up time) for the heat roller to reach the fixing temperature after the onset of its heating. For convenience, the heat roller needs to be pre-heated when in standby. Power consumption in warm-up and standby is considerable.

To address the problems, fixers have been proposed recently which implement thin heat roller fixing. Japanese unexamined patent application 9-244448 (Tokukaihei 9-244448/1997; published on Sep. 19, 1997), for example, discloses such a fixer.

The thin-heat-roller-fixing fixer includes a heat roller with core metal having a reduced thickness for a reduced thermal capacity. The warm-up time is thus reduced, which reduces the warm-up and standby power consumption.

However, in thin heat roller fixing, the heat roller can be reduced in thickness relatively easily in low-to-medium speed apparatuses (e.g., capable of making less than 50 A4 copies per minute when the recording paper is fed in landscape orientation), but only with difficulty in high speed apparatuses (e.g., capable of making 50 or more A4 copies per minute when the recording paper is fed in landscape orientation).

These are reasons why high speed apparatuses have longer warm-up time (typically 3 minutes or longer) and greater power consumption. Referring to FIG. 16, the following will describe difficulties in incorporating a thin heat roller in high speed apparatuses.

FIG. 16 is a graph showing relationships between a nip transit time, a heat roller temperature (roller temperatures), and a pressure applied to recording paper in the fix nip section (surface pressures) in conventional low-to-medium and high speed apparatuses.

The nip transit time is also called the duel time. It is the width of the fix nip section divided by the fixing rate (transport speed of recording paper) and represents the time taken for any given point on recording paper to pass through the fix nip section. A greater copy rate normally means a shorter nip transit time.

It would be understood from FIG. 16 that the low-to-medium speed apparatus uses higher fix roller temperatures to achieve a greater copy rate, i.e., to compensate for a shorter nip transit time and by doing so, applies an adequate quantity of heat to the recording paper to ensure sufficient fixing performance. The surface pressure is therefore substantially constant regardless of nip transit time.

The high speed apparatus must work at a greater fixing rate than the low-to-medium speed apparatus, resulting in a nip transit time of 23 ms ($2.3\times10^{-2}$ sec.) or less. Meanwhile, the always-on temperature for the heat roller is limited (for example, to 200° C.) in an ordinary situation. In view of heat resistance issues of the heat roller, the heat roller temperature cannot be raised exceeding the limit temperature. The high speed apparatus therefore ensures sufficient fixing performance by means of a high surface pressure while maintaining a constant heat roller temperature (at the limit temperature).

This places a heavy load on the heat roller, which unlike in the low-to-medium speed apparatus inhibits the provision of a thin heat roller in the high speed apparatus. Thus, the warm-up time is difficult to reduce. A result is great power consumption.

In addition, the heavy load on the heat roller causes the heat roller to creep and suffers from a shortened lifetime, as well as causes the recording paper to crease and curl up.

Further, the difficulties in reducing the heat roller thickness invite increases in size of the apparatus. In addition, the heat roller will have an increased drive torque which in turn entails increased power consumption and shortened driver components lifetime.

To address the aforementioned large warm-up and standby power consumption problems, fixers implementing external roller heating (hereinafter, "external roller heating fixers") have also been proposed recently. Japanese unexamined patent application 2000-338818 (Tokukai 2000-338818; published on Dec. 8, 2000), for example, discloses such a fixer.

An external roller heating fixer incorporates an external heat roller into the fixer implementing heat roller fixing. The external heat roller is an auxiliary heating means for the pressure roller. It contacts the pressure roller to externally heat the surface of the pressure roller.

This raises the surface temperature of the pressure roller and unlike in the fixer for heat roller fixing, enables the pressure roller to actively supply thermal energy to the recording paper. The warm-up time is thus reduce, and so is the pre-heating of the heat roller in standby, enabling reductions in power consumption.

In addition, the pressure roller actively supplying additional thermal energy to the recording paper allows reductions in the fixing load to the recording paper. This prevents the recording paper passing through the fix nip section from curling up.

Further, the reduced fixing load opens up possibilities that the fixer may be used in high speed apparatus generally regarded as requiring a heavy fixing load (e.g., 55 or more A4 copies [sheets] per minute when the recording paper is fed in landscape orientation, or a 23 millisecond or less transit time taken for any given point on recording paper to pass through the fix nip section). Thanks to the reduced fixing load, the external roller heating fixer allows the use of a heat roller which is reduced in thickness and/or diameter, hence in thermal capacity. The fixer thereby shortens the warm-up time and accordingly reduces power consumption. For these reasons, the fixer is suitably applied in the high speed apparatus field.

The pressure roller in the external roller heating fixer has however a higher surface temperature and thus dissipates more heat from the surface than the counterpart in the fixer for heat roller fixing. The external heat roller also dissipates heat from the surface.

Therefore, under some structural and physical conditions of the external heat roller, such as its diameter, thickness, the load it exerts to the pressure roller, and its surface temperature, the fixer dissipates too much heat, which possibly causes poor heat efficiency, higher internal temperature, and like problems. An outcome may be the opposite of what is intended in the first place: greater power consumption than the fixer for heat roller fixing.

SUMMARY OF THE INVENTION

The present invention has a first objective to provide a power saving heater with a heat roller receiving less load, and an image forming apparatus and heating method incorporating the same.

To achieve the first objective, a heater in accordance with the present invention includes a first heating member and a second heating member pressing each other, heats a heated material by passing the heated material through a press region where the first heating member and the second heating member meet, and is characterized in that the heater includes an external heating member heating the second heating member from outside the second heating member, wherein: a transit time taken for any given point on the heated material to pass through the press region is less than or equal to $2.3\times10^{-2}$ sec.; and a surface temperature, T1 (° C.), of the first heating member and a surface temperature, T2 (° C.), of the second heating member satisfy $T1-T2\leqq100$ (° C.) and preferably satisfy $T1-T2\leqq70$ (° C.).

According to the arrangement, the surface temperature, T1 (° C.), of the first heating member and the surface temperature, T2 (° C.), of the second heating member satisfy either $T1-T2\leqq100$ (° C.) or $T1-T2\leqq70$ (° C.). This eliminates the need for an increase in surface pressure in the press region even in a high speed apparatus for which the transit time taken for any given point on the heated material to pass through the press region is less than or equal to $2.3\times10^{-2}$ sec. In other words, the arrangement allows for a smaller load being applied to the heating members.

This allows for construction of thinner and smaller thermal capacity heating members, and hence reduces the warm-up time of the heater. Therefore, pre-heating of the heating members becomes unnecessary. Power consumption in warm-up and standby is lowered.

The less load on the heating members, for example, prevents the heating members from creeping and extends the heating members' lifetime.

Further, the reduced thickness of the heating members allows for construction of a more compact heater. The reduced drive torque of the heating members allows for lower power consumption and extends lifetime of driver components.

To achieve the first objective, a heater in accordance with the present invention includes a first heating member and a second heating member pressing each other, heats a heated material by passing the heated material through a press region where the first heating member and the second heating member meet, and is characterized in that: a transit time taken for any given point on the heated material to pass through the press region is less than or equal to $2.3\times10^{-2}$ sec.; and a quantity, Q1, of heat transferred from the first heating member to the heated material while the heated material is passing through the press region and a quantity, Q2, of heat transferred from the second heating member to the heated material while the heated material is passing through the press region satisfy $Q2/(Q1+Q2)\geqq0.25$, and preferably satisfy $Q2/(Q1+Q2)\geqq0.3$.

For example, when the material composing the second heating member has extremely poor heat conductivity, the second heating member in some cases transfers only an insufficient quantity of heat to the heated material, failing to provide sufficient heating, even if the surface of the second heating member is maintained at a high temperature.

However, the arrangement specifies the quantity of heat transferred to the heated material, not the temperature of the heating members. Regardless of from what material the heating members are made, similar effects are achieved to a case where the aforementioned surface temperature, T1, of the first heating member and surface temperature, T2, of the second heating member are determined to satisfy $T1-T2\leqq70$ (° C.).

In other words, the arrangement allows the load on the heating members to be reduced and enables lower power consumption.

To achieve the first objective, an image forming apparatus in accordance with the present invention is characterized in that it includes: an image transfer device forming an image of an unfixed toner on the heated material; and the heater described above fixing the unfixed toner on the heated material.

The arrangement provides a low power consumption image forming apparatus. In addition, for example, the heater can be used as a fixer. This enables reductions in power consumption through the smaller load, while securing toner's fixing performance, and prevents recording paper which is a heated material from creasing and curling up.

The arrangement also provides image forming apparatus containing a heater made up of long-life heating members and driver components.

To achieve the first objective, a heating method in accordance with the present invention is a method of heating a heated material by passing the heated material through a press region where a first heating member and a second heating member meet so that any given point on the heated material passes through the press region in $2.3\times10^{-2}$ sec., and is characterized in that the method involves the step of heating the second heating member by an external heating member from outside the second heating member so that a surface temperature, T1 (° C.), of the first heating member and a surface temperature, T2 (° C.), of the second heating member satisfy $T1-T2\leqq100$ (° C.), and preferably satisfy $T1-T2\leqq70$ (° C.).

According to the method, the surface temperature, T1 (° C.), of the first heating member and the surface temperature, T2 (° C.), of the second heating member satisfy either $T1-T2\leqq100$ (° C.) or $T1-T2\leqq70$ (° C.). This eliminates the need for an increase in surface pressure in the press region even in a high speed apparatus for which the transit time taken for any given point on the heated material to pass through the press region is less than or equal to $2.3\times10^{-2}$ sec. In other words, the method allows for a smaller load being applied to the heating members.

This allows for construction of thinner and smaller thermal capacity heating members, and hence reduces the warm-up time of the heater implementing the heating method. Therefore, pre-heating of the heating members becomes unnecessary. Power consumption in warm-up and standby is lowered.

To achieve the first objective, a heating method in accordance with the present invention is a method of heating a heated material by passing the heated material through a press region where a first heating member and a second heating member meet so that any given point on the heated material passes through the press region in $2.3\times10^{-2}$ sec., and is characterized in that the method involves the step of controlling so that a quantity, Q1, of heat transferred from the first heating member to the heated material while the heated material is passing through the press region and a quantity, Q2, of heat transferred from the second heating member to the heated material while the heated material is passing through the press region satisfy $Q2/(Q1+Q2)\geqq0.25$, and preferably satisfy $Q2/(Q1+Q2)\geqq0.3$.

The method specifies the quantity of heat transferred to the heated material, not the temperature of the heating members. Regardless of from what material the heating members are made, similar effects are achieved to a case where the aforementioned surface temperature, T1, of the first heating member and surface temperature, T2, of the second heating member are determined to satisfy $T1-T2\leqq70$ (° C.). In other words, the method allows the load on the heating members to be reduced and enables lower power consumption.

The present invention has a second objective to provide a power saving and/or heat efficiency improving heater, an image forming apparatus incorporating the heater, and a heating method, even if there is provided an external heating member heating the heating members so that the heating members heating heated material have predetermined temperatures.

To achieve the second objective, a heater in accordance with the present invention includes a first heating member and a second heating member pressing each other, heats a heated material by passing the heated material through a press region where the first heating member and the second heating member meet, and is characterized in that the heater includes an external heating member rotating with the second heating member in contact with the second heating member and heating the second heating member so that the second heating member has a predetermined surface temperature, wherein a heating nip transit time taken for any given point on the second heating member in rotation to pass through a heating nip region where the second heating member contacts the external heating member is determined based on a material and thermal capacity of the external heating member, a power consumption in the heater while the heated material is passing through the press region, and a surface temperature of the external heating member while the heated material is passing through the press region.

According to the arrangement, the heating nip transit time can be determined in accordance with the material and thermal capacity of the external heating member so that, for example, the power consumption in the heater (first, second, and external heating members) while the heated material is passing through the press region is smaller than that in a heater without an external heating member and the surface temperature of the external heating member while the heated material is passing through the press region does not exceed a predetermined temperature (for example, heat resistance temperature).

Therefore, power consumption can be lowered by arranging the heater so as to achieve the determined heating nip transit time in this manner, although the external heating member is included.

To achieve the second objective, a heater in accordance with the present invention includes a first heating member and a second heating member pressing each other, heats a heated material by passing the heated material through a press region where the first heating member and the second heating member meet, and is characterized in that the heater includes an external heating member heating the second heating member so that the second heating member has a predetermined surface temperature, wherein the heated material passes through the press region between the first heating member and the second heating member either upward or downward.

According to the arrangement, the direction in which the heated material passes through the press region (transport direction for the heated material) is substantially vertical. A region is therefore downward with respect to the first and second heating members. This lowers heat dissipation by convection from the first and second heating members.

The air heated in the heater remain in the lower space than the first and second heating members, heating the second heating member. The heat efficiency of the heater is improved.

To achieve the second objective, an image forming apparatus in accordance with the present invention is characterized in that it includes: an image transfer device forming an image of an unfixed toner on the heated material; and the heater described above fixing the unfixed toner on the heated material.

According to the arrangement, the heater can be used as a fixer. The arrangement provides a low power consumption image forming apparatus. In addition, for example, when the heater is applied to a high speed image forming apparatus, the heater enables reductions in power consumption through the smaller load even in a high speed apparatus, while securing toner's fixing performance, and prevents recording paper (recording medium) which is a heated material from creasing and curling up.

In addition, the arrangement provides a heat efficient image forming apparatus.

To achieve the second objective, a heating method in accordance with the present invention is a method of heating a heated material by passing the heated material through a press region where a first heating member and a second heating member meet, and is characterized in that the method involves the step of determining a heating nip transit time for any given point on the second heating member in rotation to pass through a heating nip region where the second heating member and the external heating member contact each other, based on a material and thermal capacity of an external heating member rotating with the second heating member in contact with the second heating member and heating the second heating member so that the second heating member has a predetermined surface temperature, power consumptions by the first heating member, the second heating member, and the external heating member, and a surface temperature of the external heating member.

According to the method, the heating nip transit time can be determined in accordance with the material and thermal capacity of the external heating member so that, for example, the power consumption in the heater (first, second, and external heating members) while the heated material is passing through the press region is smaller than that in a heater without an external heating member and the surface temperature of the external heating member while the heated material is passing through the press region does not exceed a predetermined temperature (for example, heat resistance temperature).

The method therefore heats the heated material on low power consumption by arranging the heater so as to achieve the determined heating nip transit time in this manner, although the external heating member is included.

Additional objects, advantages and novel features of the invention will be set forth in part in the description which follows, and in part will become apparent to those skilled in the art upon examination of the following or may be learned by practice of the invention.

DESCRIPTION OF THE EMBODIMENTS

[Embodiment 1]

Referring to FIGS. 1 to 6 and 8 to 15, the following will describe an embodiment of the present invention.

Figure 1:
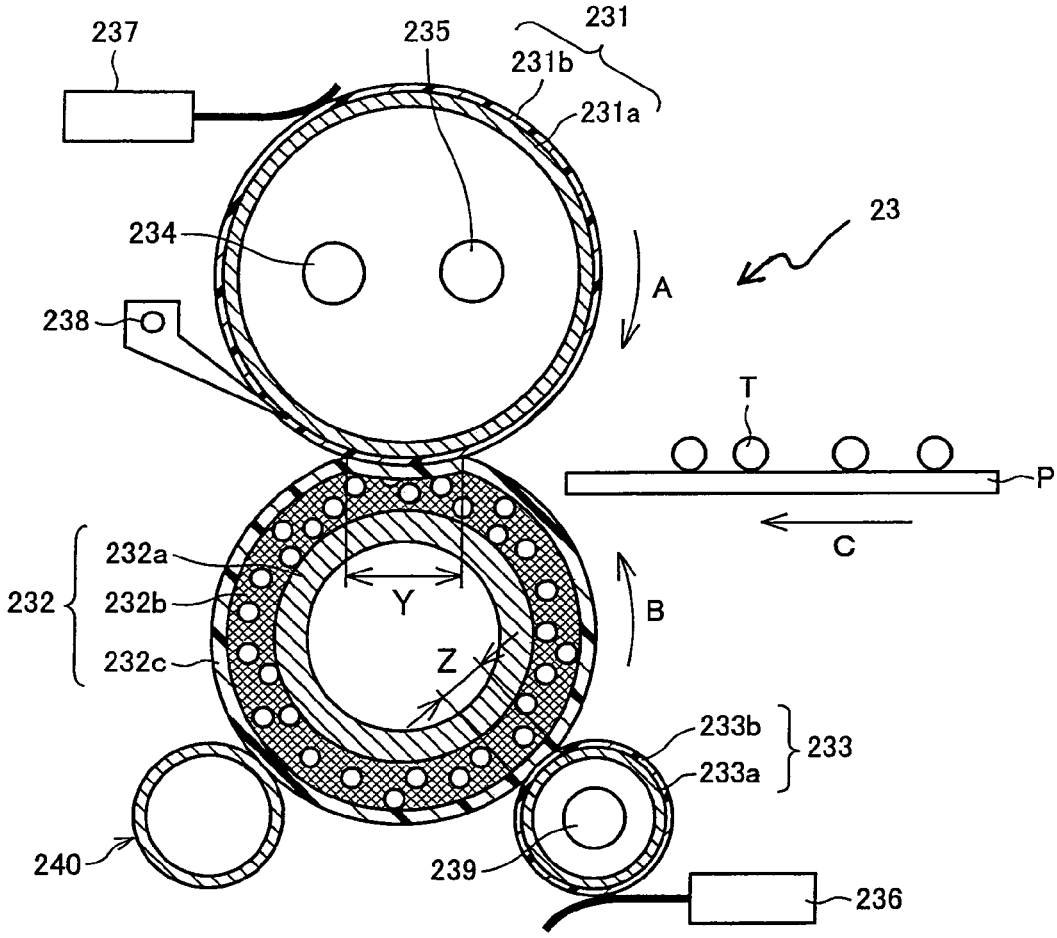
FIG. 1 is a drawing showing the structure of a major part of a fixer in accordance with an embodiment of the present invention.

FIG. 1 shows the structure of a major part of a fixer (heater) 23 in accordance with an embodiment of the present invention. Referring to the figure, the fixer 23 includes a heat roller (first heating member) 231, a pressure roller (second heating member) 232, an external heat roller (external heating member) 233, and a cleaning roller 240.

The structure described here is an example based an assumption that the fixer 23 is mounted to an electrophotographic copying machine. The fixer 23 applies heat and pressure to recording paper P carrying on it an image made of unfixed toner T in order to fix the toner T onto the recording paper P.

As shown in FIG. 1, the heat roller 231 is rotatable in the direction indicated by arrow A. The roller 231 is provided to heat the recording paper P while transiting a fix nip section Y where the heat roller 231 and the pressure roller 232 (detailed later) touch the recording paper P to fix the toner T onto the recording paper P. See a later description for details about the section. The heat roller 231 is made up of a cylindrical core metal 231*a* and a releasing layer 231*b*.

The core metal 231*a* forms the main body of the heat roller 231 and has a hollow cylindrical structure. The core metal 231*a* is preferably iron, aluminum, copper, or an alloy of these metals. Specifically, the metal 231*a* is, for example, stainless steel or carbon steel. Here, the core metal 231*a* is iron (STKM (carbon steel) and has a diameter of 40 mm and a thickness of 0.4 mm to give it low thermal capacity.

The releasing layer 231*b* is provided on the outer surface of the core metal 231*a* to prevent the toner T on the recording paper P from offsetting. The releasing layer 231*b* is suitably made of a fluororesin, such as PFA (perfluoroalcoxyalkane; a copolymer of tetrafluoroethylene and perfluoroalkylvinylether) or PTFE (polytetrafluoroethylene); a silicone rubber; a fluororubber; or a similar material. Here, the releasing layer 231*b* is made by applying and baking a mixture of PFA and PTFE to a thickness of 25 μm on the core metal 231*a*.

Inside the core metal 231*a* of the heat roller 231 are there provided heater lamps 234, 235 (heat sources) made from halogen heaters. When fed with electric current by a control circuit (not shown), the heater lamps 234, 235 emit light at the infrared wavelengths with a predetermined heat distribution. The inner surface of the heat roller 231 is thus heated.

The heater lamps 234, 235 up to a predetermined temperature (here, 200° C.) heat the heat roller 231 which in turn heats the recording paper P with an unfixed toner image passing through the fix nip section (press region) Y. The heat melts and fixes the toner T on the recording paper P. Here, the heater lamps 234, 235 have a combined power rating of 700 W.

Slightly above the outer surface of the heat roller 231 in the downstream vicinity of the fix nip section Y is there provided a guide section 238 guiding the recording paper P with the fixed toner T off the heat roller 231.

The pressure roller 232 is rotatable in the direction indicated by arrow B in the figure. The roller 232 is pressed to the heat roller 231 by a spring or other pressure member (not shown) with a force of, for example, 274 N. Thus, the fix nip section Y, about 7 mm wide, is formed between the pressure roller 232 and the heat roller 231. The pressure roller 232 is made up of a core metal 232*a*, a heat resistant elastic layer 232*b*, and a releasing layer 232*c*.

The core metal 232*a* is the main body of the pressure roller 232 and has a hollow cylindrical structure. The core metal 232*a* is preferably iron, aluminum, or an alloy of these metals. Specifically, the metal 232*a* is, for example, stainless steel or carbon steel. Here, the core metal 232*a* is stainless (stainless steel (SUS) and has a diameter of 28 mm.

The heat resistant elastic layer 232*b* is formed of 6 mm thick silicone rubber foam (rubber hardness: JIS-A at 50° C.) on the outer surface of the core metal 232*a*. The heat resistant elastic layer 232*b* is given such elasticity as to deform itself under pressure from the pressure member and resistance to heat from the external heat roller 233 (detailed later).

The releasing layer 232*c* is formed of, for example, a 50 μm thick PFA (fluororesin) tube on the surface of the heat resistant elastic layer 232*b*. The releasing layer 232*c* has a releasing property.

The external heat roller 233 has in it a heater lamp (heat source body) 239 to heat the pressure roller 232. The heater lamp 239 is structured similarly to the heater lamps 234, 235, and here has a power rating of 300 W. The external heat roller 233 is disposed upstream to the fix nip section Y and presses the pressure roller 232 with a predetermined push force.

The external heat roller 233 pressing the pressure roller 232 with a predetermined push force forms a heating nip section (heating nip region) Z between the external heat roller 233 and the pressure roller 232. Here, the heating nip section Z is 3 mm wide (as measured in the direction indicated by arrow B in the figure).

The external heat roller 233 is made up of a core metal (external heating member) 233*a* and a heat resistant releasing layer (heat resistant resin) 233*b*. The core metal 233*a* is the main body of the external heat roller 233, and preferably iron, aluminum, copper, or an alloy of these metals. Specifically, the metal 233*a* is, for example, stainless steel or carbon steel. The core metal 233*a* is an aluminum cylinder shaft measuring 15 mm in diameter and 0.5 mm in thickness.

The heat resistant releasing layer 233*b* is made of a synthetic resin material with excellent heat resistance and releasing properties. Examples of such materials include elastomers, such as silicone rubber or fluororubber, or fluotoresins, such as PFA or PEFE. Here, the heat resistant releasing layer 233*b* is made by applying and baking a mixture of PFA and PEFE to a thickness of 25 μm on the core metal 233*a*.

Slightly above the outer surface of the heat roller 231 is there provided a temperature sensor (temperature sensing means or temperature sensing section) 237 sensing the surface temperature of the heat roller 231. Based on the result of the sensing by the temperature sensor 237, a control circuit (control means or control section; not shown in the figure) controls electric current feed to the heater lamps 234, 235 so that the heat roller 231 has a predetermined surface temperature.

Slightly above the outer surface of the pressure roller 232 is there provided a temperature sensor (temperature sensing means) 242 sensing the surface temperature of the pressure roller 232. Slightly above the outer surface of the external heat roller 233 is there provided a temperature sensor (temperature sensing means) 236 sensing the surface temperature of the external heat roller 233.

Based on the surface temperature of the pressure roller 232 as sensed by the temperature sensor 242 and the surface temperature of the external heat roller 233 as sensed by the temperature sensor 236, the control circuit (control means; not shown in the figure) controls current feed to the heater lamp 239 so that the external heat roller 233 has a predetermined surface temperature. The control of the electric current feed to the heater lamp 239 controls the surface temperature of the pressure roller 232 and the surface temperature of the external heat roller 233.

The temperature sensor 242 may be omitted if, for example, the temperature of the external heat roller 233 is controlled based on such predetermined conditions as to the temperature of the external heat roller 233 that the surface temperature of the heat roller 231 differs from the surface temperature of the pressure roller 232 by a desired value.

A cleaning roller 240 is provided upstream to the external heat roller 233 near the outer surface of the pressure roller 232.

The heat roller 231, the pressure roller 232, and the external heat roller 233 are not limited in any special manner to the aforementioned structural and physical features (e.g., composition, dimensions, and shape).

The cleaning roller 240 is provided to remove toner, paper particles, etc. from the pressure roller 232, preventing smearing of the external heat roller 233. The cleaning roller 240 is disposed upstream to the heating nip section Z and presses the pressure roller 232 with a predetermined push force.

Supported at the axis, the cleaning roller 240 is rotated by the rotation of the pressure roller 232. The cleaning roller 240 is a cylindrical core material made of aluminum, stainless steel, or a like metal. Here, the cleaning roller 240 is made of stainless steel.

The heat roller 231, the pressure roller 232, the external heat roller 233, and the cleaning roller 240 are not limited in any special manner to the aforementioned structural and physical features (e.g., composition, dimensions, and shape).

Now, the fixer 23 will be further described in terms of its operation. Still referring to FIG. 1, the recording paper P carrying an image formed by unfixed toner T is transported in the direction indicated by arrow C in the figure. The recording paper P is heated to a predetermined temperature by the external heat roller 233 and the heat roller 231 heated to 200° C. by the heater lamps 234, 235. The paper P is then passed between the heat roller 231 and the pressure roller 232 which is being pressed by the roller 231, that is, through the fix nip section Y.

While passing through the section Y, the unfixed toner T melts and firmly adheres onto the recording paper P under heat and pressure from the rollers 231, 232. Hence, the fixer 23 arranged as above is capable of fixing the toner T onto the recording paper P passing between the rollers 231, 232.

The nip transit time in the present embodiment is preferably 23 milliseconds or less. The nip transit time is defined as a time taken for any given point on the recording paper P to pass through the fix nip section Y. That is, the width (mm) of the fix nip section Y divided by the transport speed (fixing rate) (mm/sec.) of the recording paper P. In other words, the fixer 23 is applicable to high speed apparatuses.

A typical copying machine operates in copy mode, warm-up mode, standby mode, etc.

Warm-up mode is the mode in which the copying machine operates immediately after its power supply is turned on. In that mode, the copying machine first feeds current to the heater lamps 234, 235 to heat up the heat roller 231 to a predetermined temperature (here, 200° C.). As the heat roller 231 reaches the predetermined temperature, the machine turns on the drive motor, driving the rollers 231, 232, 233 to rotate at a peripheral speed (fixing rate) of 365 mm/sec. and simultaneously with the driving, feeds electric current to the heater lamp 239. The external heat roller 233 is continuously heated until it reaches a predetermined temperature (here, 170° C.).

In copy mode, the copying machine forms an image on the recording paper P moving at a predetermined speed. It is in this mode that the fixer 23 fixes toner onto the recording paper P. In copy mode, the electric current feeds to the heater lamps 234, 235, 239 are controlled so as to maintain the heat roller 231 and the pressure roller 232 at predetermined temperatures (here, 200° C. and 135° C. respectively).

Specifically, the heater lamp 239 in the external heat roller 233 is so controlled as to maintain the external heat roller 233 at a temperature (here, 170° C.) required to maintain the surface of the pressure roller 232 at a predetermined temperature (here, 135° C.).

In standby mode, electric consumption is maintained at such a level that the copying machine can enter copy mode immediately in response to a print request. After copying is finished, the copying machines is in standby mode for some time before entering low power mode.

Fixing toner T onto the recording paper P requires some amount of surface pressure between the heat roller 231 and the pressure roller 232 in the fix nip section Y. In other words, some load needs to be applied to the recording paper P while transiting the fix nip section Y, to fix toner T.

Next, referring to Table 1, relationship will be described between the load necessary to fix toner T (hereinafter, "required fixing load"), the surface temperature, T1, of the heat roller 231, and the surface temperature, T2, of the pressure roller 232. The surface temperature, T1, of the heat roller 231 was 200° C. Required surface pressure (kPa) is defined as the required fixing load (N) divided by the area of the fix nip section Y where toner T is fixed.

In arrangements (I), (II), and (III) of the fixer 23, the surface temperature, T2, of the pressure roller 232 was respectively set to 105° C., 130° C., and 135° C.

In comparative examples (I), (II), there was provided no external heat roller 233 heating the pressure roller 232. In comparative example (III), a heater lamp heating the heat roller 231 was provided inside the pressure roller 232, replacing the external heat roller 233.

TABLE 1

| | Comp. Ex. (I) | Comp. Ex. (II) | Comp. Ex. (III) | Arrgmt. (I) | Arrgmt. (II) | Arrgmt. (III) |
|---|---|---|---|---|---|---|
| Pressure roller heating means | Not included | Not included | Included (Internal) | Included (External roller) | Included (External roller) | Included (External roller) |
| Fixing rate (mm/s) | 365 | 365 | 365 | 365 | 365 | 365 |
| Fix nip width (mm) | 6.5 | 7 | 7 | 7 | 7 | 7 |
| Nip transit time (ms) | 17.8 | 19.2 | 19.2 | 19.2 | 19.2 | 19.2 |
| Temp. T1 of heat roller (° C.) | 200 | 200 | 200 | 200 | 200 | 200 |
| Temp. T2 of pressure roller (° C.) | 90 | 93 | 130 | 105 | 130 | 135 |
| T1 – T2 (deg.) | 110 | 107 | 70 | 95 | 70 | 65 |
| Required fixing load (N) | 980 | 784 | 274 | 539 | 274 | 196 |
| Required surface Pressure (kPa) | 486 | 361 | 126 | 248 | 126 | 90 |

Note:
Comp. Ex. < Comparative Example
Arrgmt < Arrangement

In comparative examples (II), (III), and arrangement (I) to (III), the nip transit time was 19.2 milliseconds (ms) (the copy rate was 65 copies per minute if A4 recording paper P was fed in landscape orientation), and the fix nip section Y was 7 mm wide ("fix nip width" as measured in the direction indicated by arrow A in the figure). In comparative example (I), the nip transit time was 17.8 milliseconds, and the fix nip width was 6.5 mm.

Table 1 shows that a very high surface pressure (360 kPa or greater) is necessary in comparative examples (I), (II) where the pressure roller 232 is not heated.

This is because the nip transit time is too short to transfer sufficient thermal energy from the heat roller 231 to the recording paper P for the toner to melt, despite the fact that the surface temperature, T1, of the heat roller 231 is controlled at the limit temperature, 200° C. Another reason is the missing heat source (for example, the external heat roller 233, the heater lamp, or similar heating means) in the pressure roller 232: without the heat source, the surface temperature, T2, of the pressure roller 232 falls to or below 100° C. (hence, T1–T2>100° C. (deg.)), where sufficient thermal energy is not transferred from the pressure roller 232 to the recording paper P; very high fixing load becomes necessary to compensate for the insufficient thermal energy transfer.

On the other hand, by maintaining the surface temperature, T2, of the pressure roller 232 at a high value (hence, T1–T2≦100° C. (deg.)) by means of the provision of the heating means (the external heat roller 233 or the heater lamp) heating the pressure roller 233 as in comparative example (III) and arrangements (I) to (III), an increased amount of thermal energy is transferred from the pressure roller 232 to the recording paper P. The required fixing load is therefore reduced to or below 300 kPa.

Figure 2:
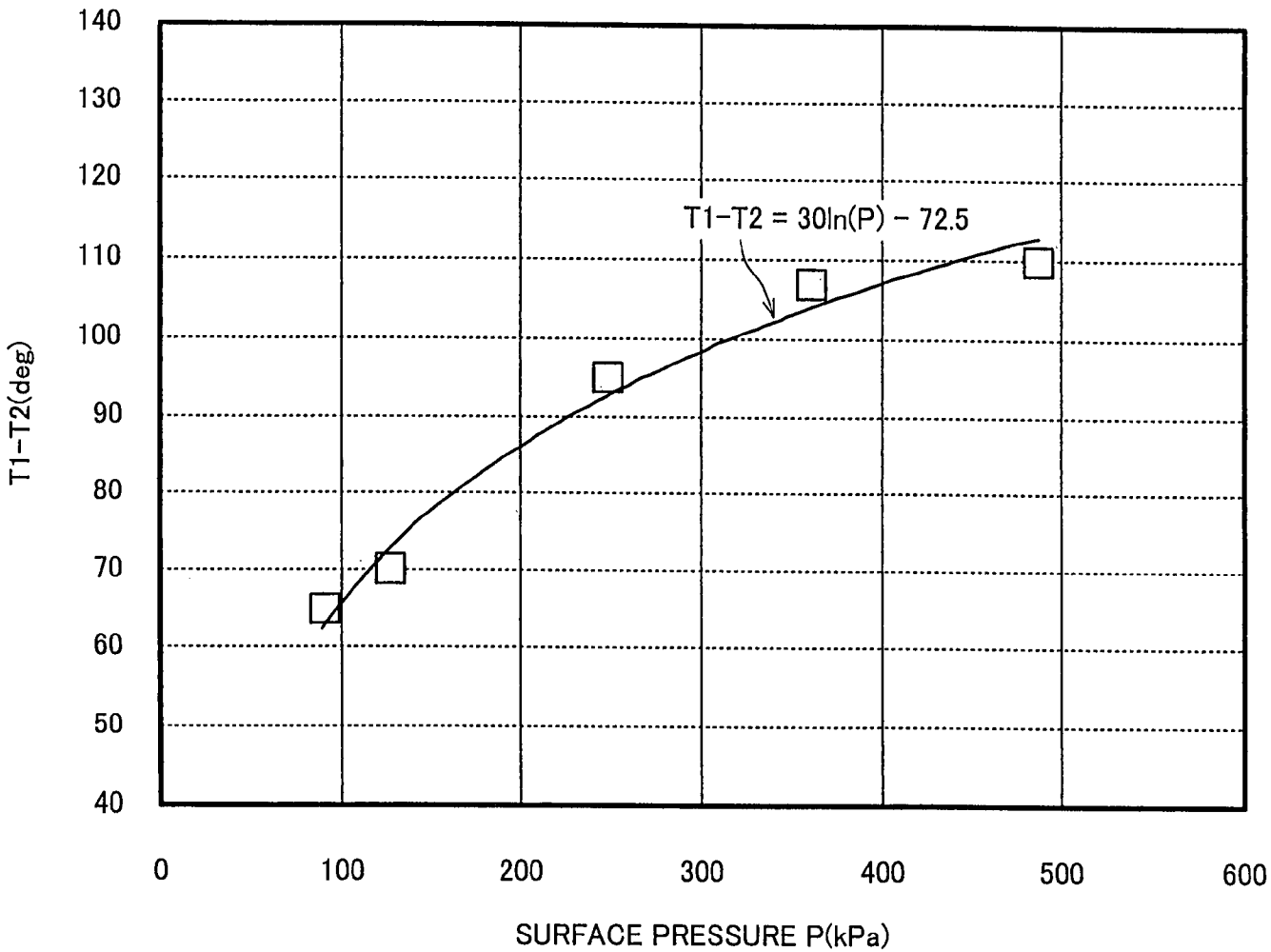
FIG. 2 is a graph showing a relationship between a required surface pressure (kPa) and a difference (° C.) between the surface temperature, T1, of a heat roller and the surface temperature, T2, of a pressure roller.

Now see FIG. 2 for a graphical representation of the relationship between the required surface pressure (kPa) and the difference, T1–T2 (° C.), between the surface temperature, T1, of the heat roller 231 and the surface temperature, T2, of the pressure roller 232, all data taken from Table 1.

As shown in the figure, approximating, by the least squares method, the relationship between the required surface pressure P (kPa) and the difference, T1–T2 (° C.), in temperature between the heat roller 231 and pressure roller 232 based on comparative examples (I) to (III) and arrangements (I) to (III), we obtain T1–T2=30×ln(P)−72.5.

As mentioned earlier, a smaller difference, T1–T2 (° C.), in temperature between the heat roller 231 and the pressure roller 232 allows more thermal energy transfer from the pressure roller 232 to the recording paper P, and hence a less required fixing load. Taking these facts into account, it is preferred if the relationship between the required surface pressure P (kPa) and the difference, T1–T2 (° C.), in temperature between the heat roller 231 and the pressure roller 232 is given by equation (1):

$$T1-T2 \leqq 30\times\ln(P)-72.5 \quad (1)$$

The above description demonstrates that sufficient fixing performance is secured by heating the pressure roller 232 at a constant temperature using the external heat roller 233.

As in the foregoing, the fixer 23 includes the mutually pressing heat roller 231 and pressure roller 232. The recording paper P is heated while transiting the fix nip section Y (press region) where the heat roller 231 and the pressure roller 232 meet. The toner T on the recording paper P is thereby fixed.

The external heat roller 233 heats up the pressure roller 232 from the outside. The transit time in which any given point on the recording paper P can pass through the fix nip section Y is $2.3\times10^{-2}$ sec. So, the fixer 23 is applicable to high speed apparatuses. Here, "T1–T2≦100 (° C.)" holds where T1 is the surface temperature of the heat roller 231 in degrees Celsius, and T2 is the surface temperature of the pressure roller 232 in degrees Celsius. It is preferable if T1–T2≦70 (° C.) holds.

Employing one of the above arrangements, the surface pressure in the fix nip section Y does not need to be increased in high speed apparatuses. The load applied to the rollers 231, 232 can be reduced.

Therefore, rollers, especially, the heat roller 231 can be reduced in thickness, hence in thermal capacity, which in turn reduces the warm-up time of the fixer 23. As a result, pre-heating of the fixer 23 becomes unnecessary. Power consumption in warm-up and standby is lowered.

Further, the reduced load on the rollers 231, 232 prevents the rollers 231, 232 from creeping and extends the rollers' lifetime.

The reduced thicknesses of the rollers 231, 232 allow for a more compact fixer 23. The reduced drive torques of the rollers 231, 232 allow for lower power consumption and extends lifetime of driver components.

The difference between the surface temperature of the heat roller 231 and the surface temperature of the pressure roller 232 is controlled by the external heat roller 233.

Specifically, the fixer 23 includes the temperature sensor 236 sensing the surface temperature of the external heat roller 233 and the control means (not shown) controlling the surface temperature of the external heat roller 233 based on the result of the sensing.

Thus, the surface temperature of the heat roller 231 and the surface temperature of the pressure roller 232 are controllable using a simple arrangement.

On the other hand, the surface temperature of the heat roller 231 is controlled at a substantially constant value.

Thus, the difference between the surface temperature of the heat roller 231 and the surface temperature of the pressure roller 232 is controllable by the external heat roller 233 through the control of only the surface temperature of the pressure roller 232.

It is preferred if the fixer 23 satisfies the equation:

$$T1-T2 \leqq 30 \times \ln(P)-72.5$$

where P is a surface pressure (kPa) on the recording paper P in the fix nip section Y, T1 is the surface temperature (° C.) of the heat roller 231, and T2 is the surface temperature (° C.) of the pressure roller 232.

Thus, T1−T2 can be reduced, and an increased quantity of heat can be transferred to the recording paper P. Therefore, the load on the pressure roller 232 can be reduced.

Now, referring to Table 2, the warm-up time and energy consumption efficiency are compared among the aforementioned comparative example (III) and arrangements (I) to (III). In arrangements (I) to (III), the thickness of the core metal 231*a* of the heat roller 231 was determined for each required fixing load so that the heat roller 231 did not warp exceeding the allowable amount.

TABLE 2

| | Comp. Ex. (III) | Arrgmt. (I) | Arrgmt. (II) | Arrgmt. (III) |
|---|---|---|---|---|
| Pressure roller heating means | Included (Internal) | Included (External roller) | Included (External roller) | Included (External roller) |
| Temp. T1 of heat roller (° C.) | 200 | 200 | 200 | 200 |
| Temp. T2 of pressure roller (° C.) | 130 | 105 | 130 | 135 |
| T1 − T2 (deg.) | 70 | 95 | 70 | 65 |
| Required fixing load (N) | 274 | 539 | 274 | 196 |
| Required surface Pressure (kPa) | 126 | 248 | 126 | 90 |
| Required thickness for heat roller (mm) | 0.4 | 0.8 | 0.4 | 0.3 |
| Thermal capacity of heat roller per unit length (j/m · ° C.) | 179 | 353 | 179 | 134 |
| Warm-up time (sec.) | 424 | 61 | 27 | 22 |
| Energy consumption efficiency (Wh/h) | 277 | 239 | 128 | 127 |

Note:
Comp. Ex. < Comparative Example
Arrgmt < Arrangement

Figure 3:
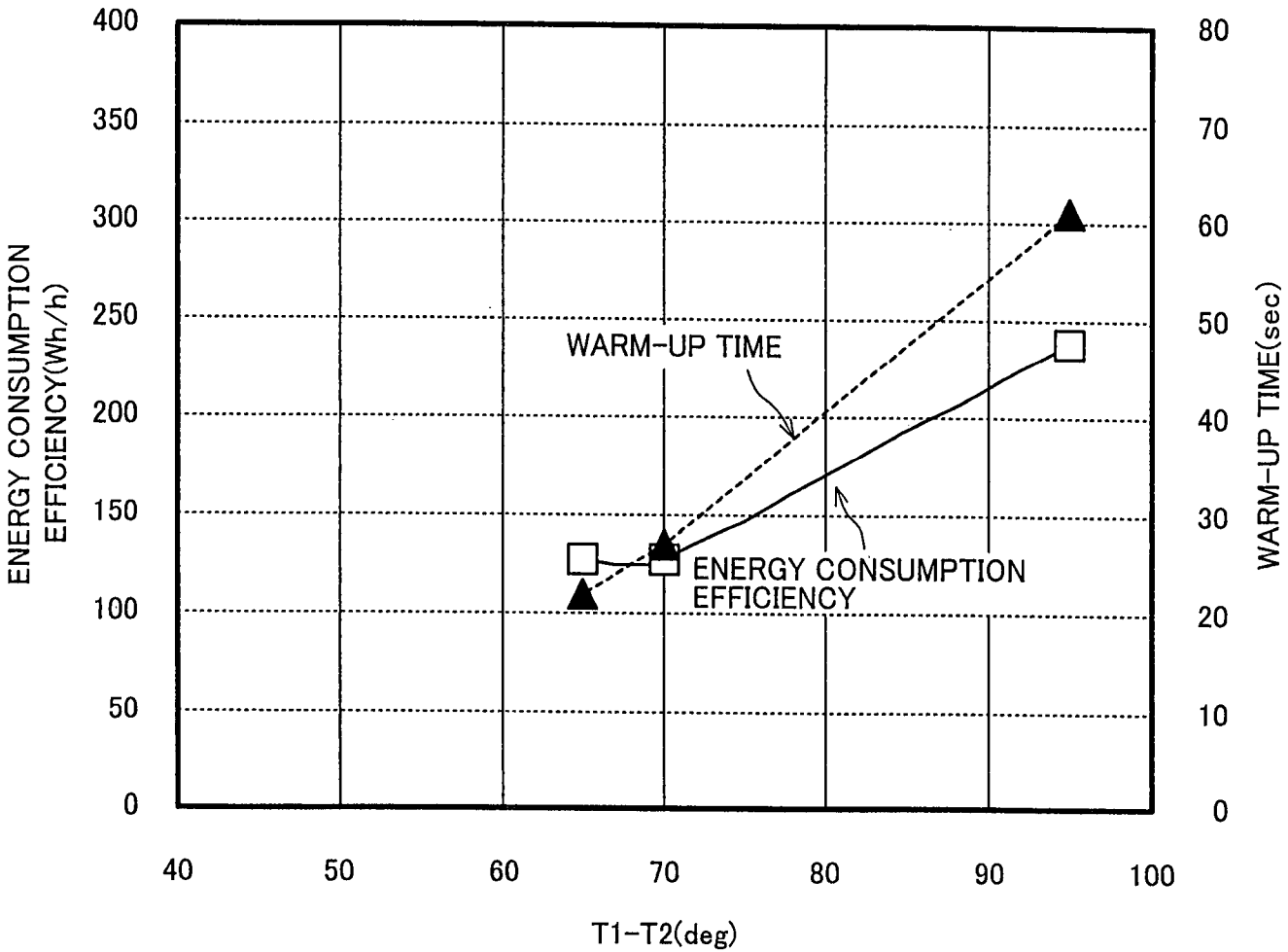
FIG. 3 is a graph showing relationships between a warm-up time (sec.), energy consumption efficiency (Wh/h), and a difference (° C.) between the surface temperature, T1, of a heat roller and the surface temperature, T2, of a pressure roller.

FIG. 3 is a graphical representation of the relationship between the warm-up time, energy consumption efficiency, and difference, T1−T2 (° C.), in temperature between the heat roller 231 and the pressure roller 232, all data taken from Table 2.

Table 2 shows that in comparative example (III) where the pressure roller 232 is heated by the heater lamp from the inside (which is not the case in arrangements (I) to (III), the warm-up time is 424 seconds, much longer than in arrangements (I) to (III).

This is because it takes a very long time to heat the surface of the pressure roller 232 to a predetermined temperature (here, 130° C.) due to the large thermal capacity of the pressure roller 232 and the poor heat conductance of the heat resistant elastic layer 232*b* made of silicone rubber.

These results show that the pressure roller 232 is preferably heated externally using, for example, the external heat roller 233, rather than internally using, for example, the heater lamp.

Table 2 and FIG. 3 demonstrate also that although arrangements (I) to (III) all employ an external heating approach, they do differ in energy consumption efficiency (power consumption per hour (Wh/h)): arrangements (II), (III) in which the pressure roller 232 is heated so that T1−T2≦70 (° C.) lowers the energy consumption efficiency further than arrangement (I).

This is because when T1−T2≦70 (° C.), the warm-up time (time taken for the heat roller to reach a predetermined fixing temperature) can be reduced to 30 seconds or less, and therefore the OFF mode can be started in 15 minutes or less of the shift time (standby mode) to the low power mode. Here, the standby mode is supposed to last for 6 minutes.

Figure 4:
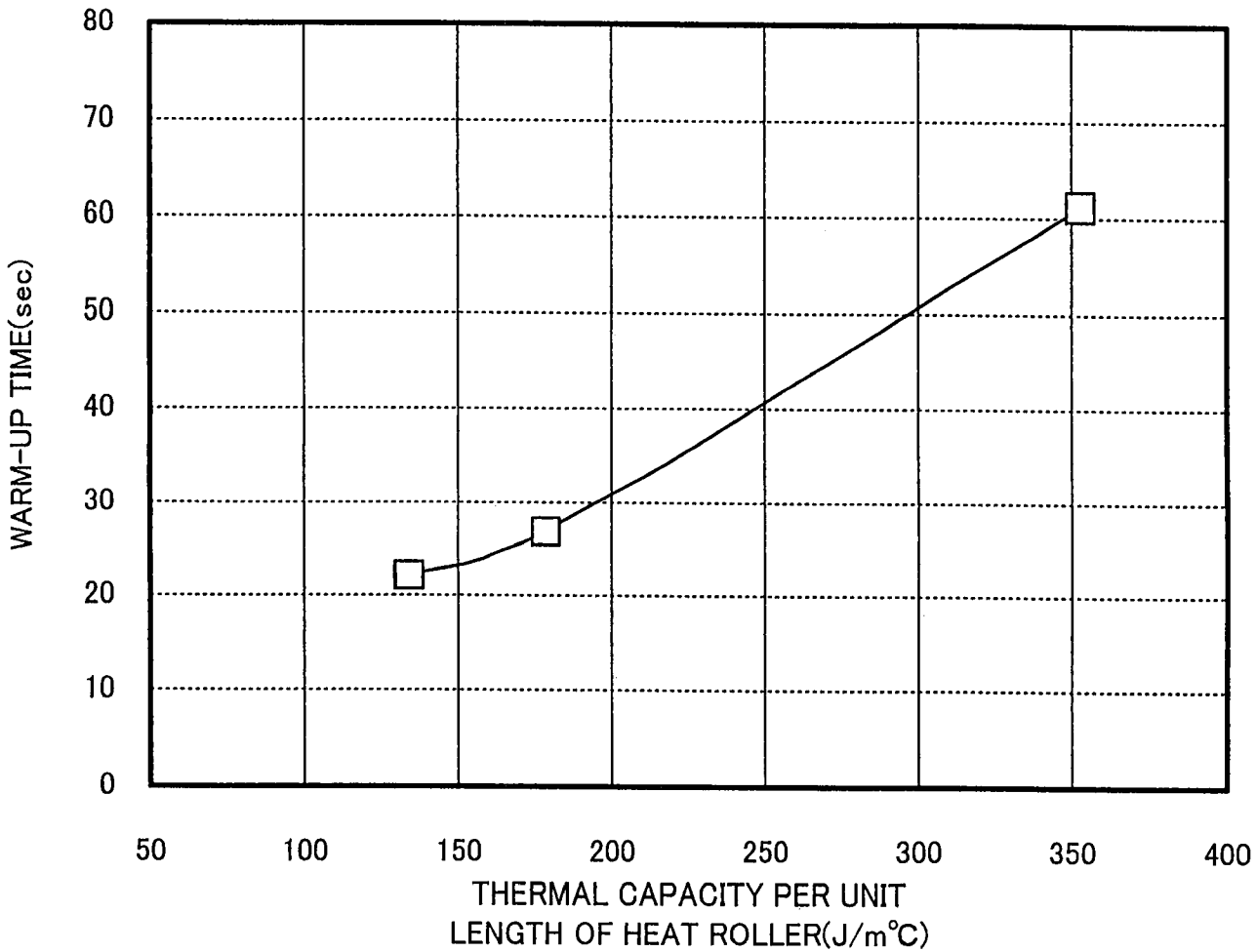
FIG. 4 is a graph showing a relationship between a warm-up time (sec.) and the thermal capacity (J/m·° C.) per unit length of a heat roller in its axis direction.

Now, move on to FIG. 4, a graphical representation of the relationship between the warm-up time (sec.) and the thermal capacity per unit length (J/m·° C.) of the heat roller 231 in the axis direction for arrangements (I) to (III), all data taken from Table 2.

The figure shows that to make the warm-up time 30 seconds or less, the thermal capacity per unit length of the heat roller 231 in the axis direction should be 200 (J/m·° C.) or less.

Incidentally, as mentioned earlier, a sufficient quantity of heat may not be transferred in some cases from the pressure roller 232 to the recording paper P, causing defects in the fixing of toner T. This can happen when, for example, the pressure roller 232 is made of a material with extremely poor heat conductivity even if the surface temperature, T2, of the pressure roller 232 is maintained at a high temperature state (hence, T1−T2≦100 (° C.) or T1−T2≦70 (° C.)).

Accordingly, the following will examine relationship between the thermal energy transferred from the heat roller 231 and the pressure roller 232 to the recording paper P and the required fixing load (N) (required surface pressure (kPa).

The thermal energy, Q1, transferred from the heat roller 231 to a sheet of recording paper P and the thermal energy, Q2, transferred from the pressure roller 232 to a sheet of recording paper P were calculated by two dimensional heat transmission simulation for comparative examples (I) to (III) and arrangements (I) to (III). Table 3 shows the thermal energies Q1, Q2, ratio of the energies Q1, Q2, required fixing load (N), required surface pressure (kPa), warm-up time, and energy consumption efficiency.

TABLE 3

| | Comp. Ex. (I) | Comp. Ex. (II) | Comp. Ex. (III) | Arrgmt. (I) | Arrgmt. (II) | Arrgmt. (III) |
|---|---|---|---|---|---|---|
| Pressure roller heating means | Not included | Not included | Included (Internal) | Included (External roller) | Included (External roller) | Included (External roller) |
| Fixing rate (mm/s) | 365 | 365 | 365 | 365 | 365 | 365 |
| Fix nip width (mm) | 6.5 | 7 | 7 | 7 | 7 | 7 |
| Nip transit time (ms) | 17.8 | 19.2 | 19.2 | 19.2 | 19.2 | 19.2 |
| Temp. T1 of heat roller | 200 | 200 | 200 | 200 | 200 | 200 |

TABLE 3-continued

| | Comp. Ex. (I) | Comp. Ex. (II) | Comp. Ex. (III) | Arrgmt. (I) | Arrgmt. (II) | Arrgmt. (III) |
|---|---|---|---|---|---|---|
| (° C.) | | | | | | |
| Temp. T2 of pressure roller (° C.) | 90 | 93 | 130 | 105 | 130 | 135 |
| Q1 (J) | 306 | 308 | 306 | 310 | 310 | 314 |
| Q2 (J) | 83 | 86 | 149 | 125 | 143 | 157 |
| Q2/(Q1 + Q 2) | 0.21 | 0.22 | 0.33 | 0.29 | 0.32 | 0.33 |
| Required fixing load (N) | 980 | 784 | 274 | 539 | 274 | 196 |
| Required surface Pressure (kPa) | 486 | 361 | 126 | 248 | 126 | 90 |
| Warm-up time (sec.) | — | — | — | 61 | 27 | 22 |
| Energy consumption efficiency (Wh/h) | — | — | — | 239 | 128 | 127 |

Note:
Comp. Ex. < Comparative Example
Arrgmt < Arrangement

Table 3 shows that in comparative examples (I), (II) from which the heating means was missing, the thermal energy, Q2, transferred from the pressure roller 232 to the recording paper P approximately accounted a mere 22% of the total heat quantity (total thermal energy), Q1+Q2, transferred to the recording paper P. These examples therefore require a very high fixing load (surface pressure of 350 kPa or greater).

On the other hand, comparative example (III) and arrangements (I) to (III) incorporate the heating means heating the pressure roller 232; the thermal energy, Q2, transferred from the pressure roller 232 to the recording paper P accounts for 25% or more. The required surface pressure drops to or below 300 kPa, allowing for a reduced required fixing load.

Figure 5:
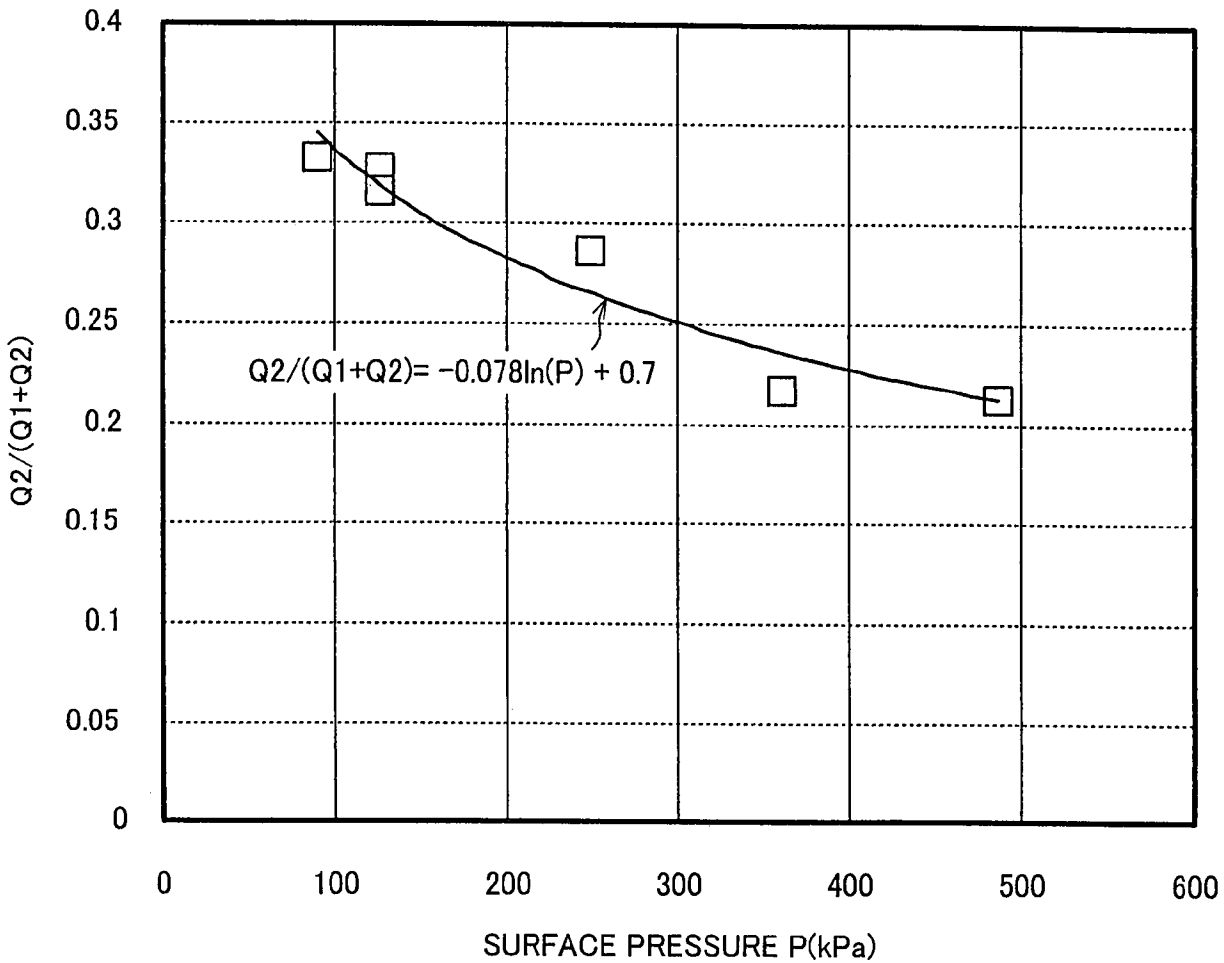
FIG. 5 is a graph showing a relationship between a required surface pressure P (kPa) and the ratio, Q2/(Q1+Q2), of a thermal energy, Q2, transferred from a pressure roller to recording paper P to a total heat quantity Q1+Q2.

FIG. 5 is a graphical representation of the relationship between the required surface pressure P (kPa) and the ratio, Q2/(Q1+Q2), of the heat quantity, Q2, transferred from the pressure roller 232 to the recording paper P to the total heat quantity Q1+Q2, all data taken from Table 3.

As shown in the figure, approximating, by least squares method, the relationship between the required surface pressure P (kPa) and the ratio, Q2/(Q1+Q2), of the heat quantity Q2 to the total heat quantity Q1+Q2 based on comparative examples (I) to (III) and arrangements (I) to (III), we obtain Q2/(Q1+Q2)=−0.078×ln(P)+0.7.

As mentioned earlier, a larger Q2/(Q1+Q2) results in a greater amount of thermal energy being transferred from the pressure roller 232 to the recording paper P, and allows for a reduced required fixing load.

Taking these facts into account, it is preferred if the relationship between the required surface pressure P (kPa) and the ratio, Q2/(Q1+Q2), of the heat quantity Q2 to the total heat quantity Q1+Q2 is given by equation (2):

$$Q2/(Q1+Q2) \geqq -0.078 \times \ln(P)+0.7 \quad (2)$$

The above description demonstrates that the external heat roller 233 heating the pressure roller 232 at a constant temperature increases Q2/(Q1+Q2), the ratio of the heat quantity Q2 transferred from the pressure roller 232 to the recording paper P, and lowers the required fixing load. Therefore, power consumption can be lowered. Sufficient fixing performance is secured for the toner T on the recording paper P.

Figure 6:
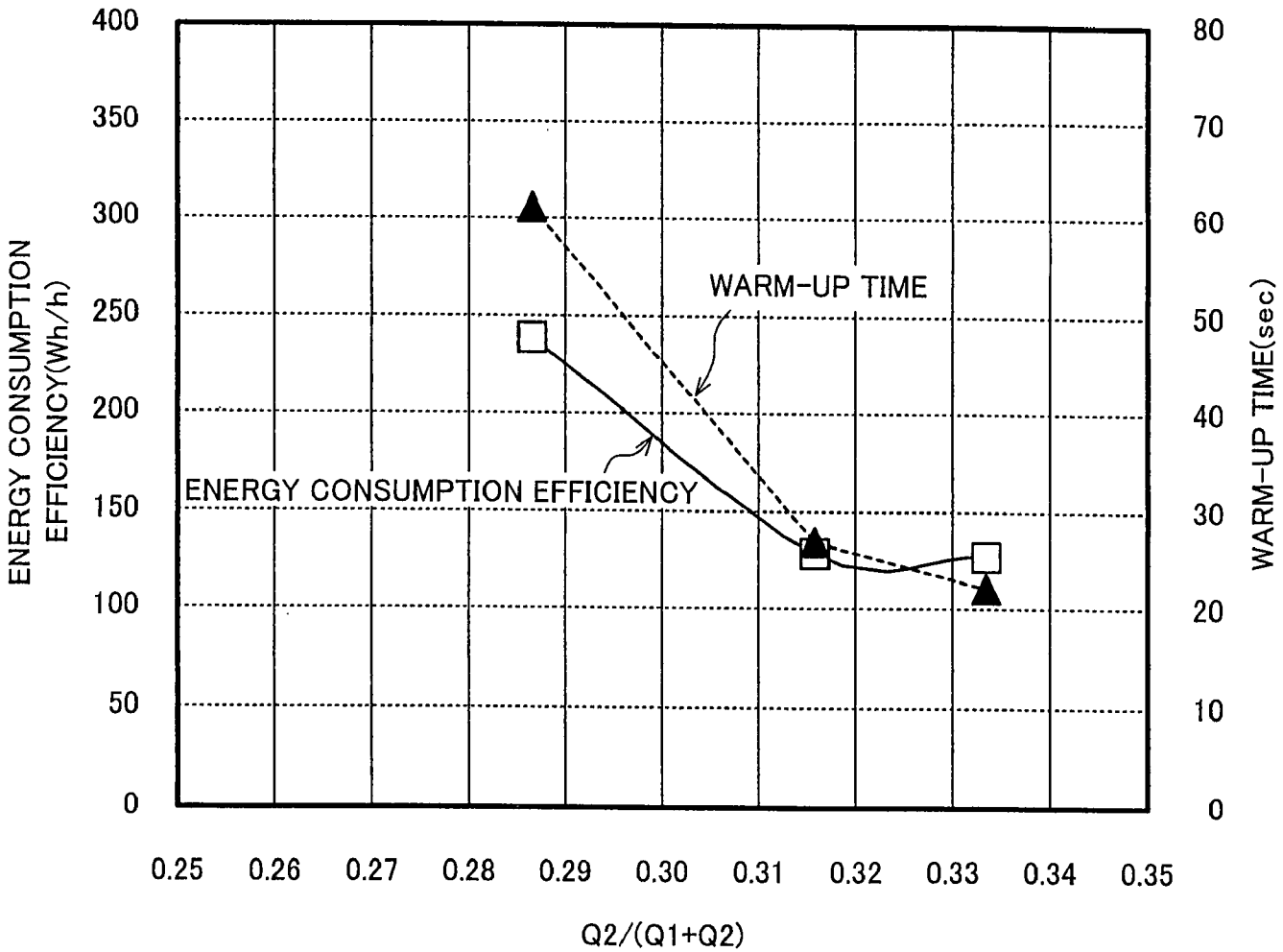
FIG. 6 is a graph showing relationships between a warm-up time, energy consumption efficiency, and the ratio, Q2/(Q1+Q2), of the heat quantity Q2 to the total heat quantity Q1+Q2.

Next, in reference to FIG. 6, arrangements (I) to (III) listed in Table 3 are compared regarding the warm-up time and the energy consumption efficiency.

FIG. 6 is a graphical representation of the relationship between the warm-up time, the energy consumption efficiency, and the ratio, Q2/(Q1+Q2), of the heat quantity Q2 to the total heat quantity Q1+Q2, all data taken from Table 3.

Table 3 and FIG. 6 shows that Q2/(Q1+Q2)≧0.313 holds in arrangements (II), (III), which means that the energy consumption efficiency is much lower than in arrangement (I).

This is because when Q2/(Q1+Q2)≧0.313 (0.3), the warm-up time can be reduced to 30 seconds or less, and therefore the OFF mode can be started in 15 minutes or less of the shift time (standby mode) to the low power mode. Here, the standby mode is supposed to last for 6 minutes.

The rollers 231, 232, 233 are not limited in any special manner to the aforementioned shape or composition.

The foregoing description took the fixer (heater) 23 as an example of a device including the rollers 231, 232, 233. The arrangement including the rollers 231, 232, 233 is not limited to this example, but also preferably applicable to, for example, a dryer device in a wet electrophotographic image forming apparatus, a dryer device in an inkjet printer, and a rewriteable medium eraser device.

The following will describe an example in which the aforementioned fixer 23 is applied to a dry electrophotographic image forming apparatus in reference to FIGS. 8 to 15.

Figure 8:
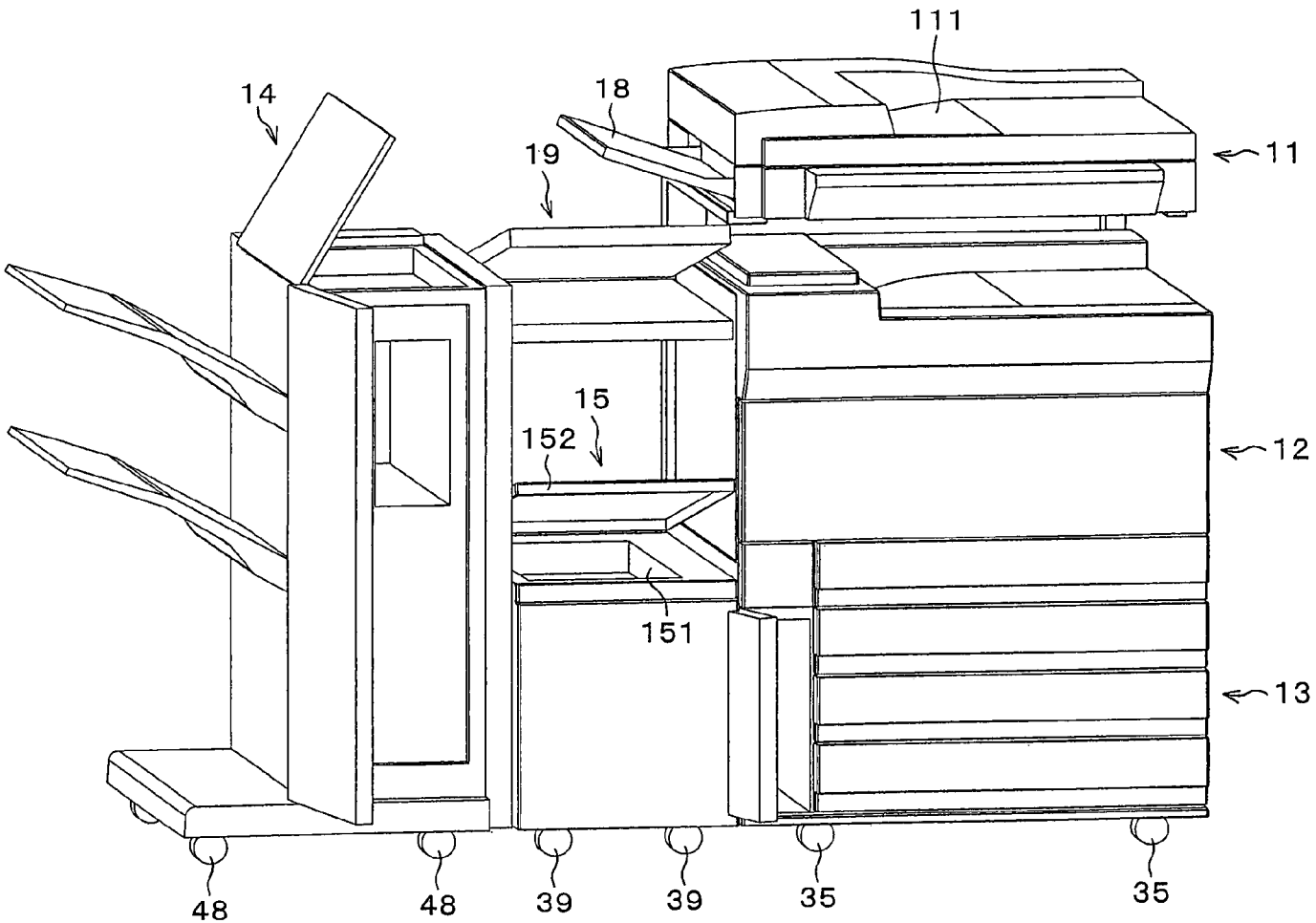
FIG. 8 is a perspective, external view showing the structure of an image forming apparatus including the fixer in FIG. 1.
Figure 9:
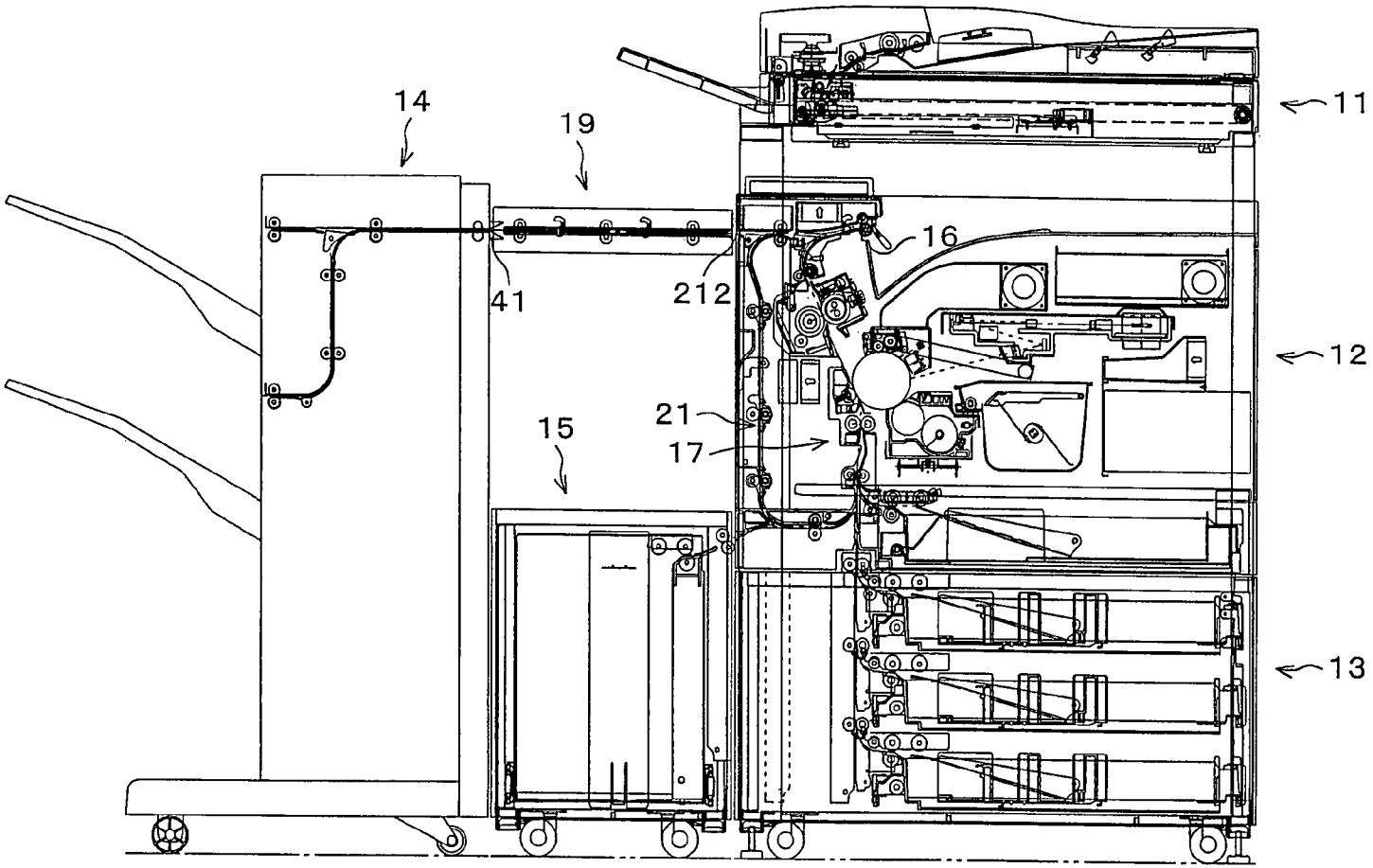
FIG. 9 is a drawing showing the internal structure of the image forming apparatus.

FIG. 8 is a perspective, external view showing the image forming apparatus. FIG. 9 is a drawing showing the internal structure of the image forming apparatus.

As shown in FIGS. 8, 9, the image forming apparatus includes an original image capture device 11, an image recording device 12, a recording material feeder device 13, a post-processing device 14, and an external recording material feeder device 15. The fixer 23 (see FIG. 11) is included in the image recording device 12 (detailed later).

Referring to FIG. 9, an image forming apparatus main body, such as a digital printer, is composed of the image recording device (image forming section) 12, the recording material feeder device (recording material feeder section) 13, and a transport section 17 transporting the recording material (recording paper P) from the recording material feeder device 13 via the image recording device 12 to a recording material eject section 16. The main body, if further including the original image capture device (image capture device) 11, forms a digital copying machine or facsimile machine.

The following will describe the operation of the image forming apparatus main body.

First, the original image capture device 11 captures an image data of an original and supplies the image data to the image recording device 12 where the input image data is subjected to a suitable image process.

Meanwhile, the recording material feeder device 13 delivers print paper, OHP (Over Head Projector) sheets, or like recording material sheets, a sheet at a time, to the image recording device 12 via a first transport path in the transport section 17.

The image recording device 12 prints or otherwise forms an image represented by the image data on the recording material. The recording material carrying a printed image is transported via a second transport path in the transport section 17 to the recording material eject section 16 where the material is ejected out of the apparatus.

Figure 10:
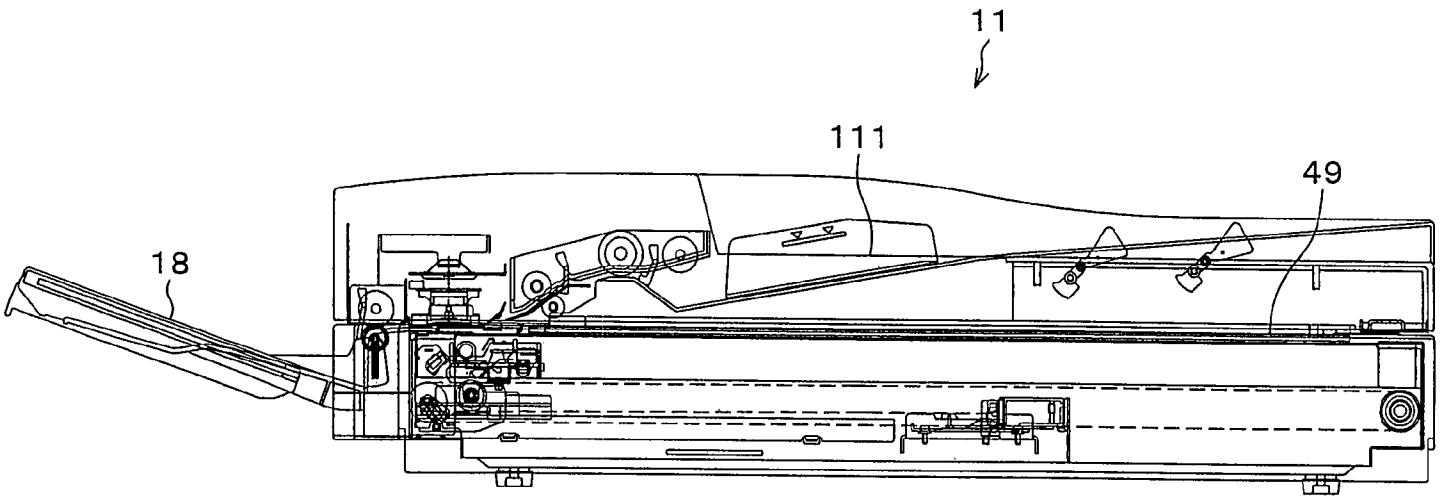
FIG. 10 is a drawing showing the structure of an original image capture device in the image forming apparatus.

As shown in FIG. 10, the original image capture device 11 is provided with an original document tray 18 acting as an original document feeder section or original document receiving section.

The original document tray 18 as an original document feeder section is capable of successively feeding multiple pages of an original document placed on it to the image capture section a page at a time.

On the other hand, the original document tray 18 as an original document receiving section is capable of receiving and holding in it the original pages successively ejected after an image capturing process.

For example, if printed recording material is ejected to the recording material eject section 16 as shown in FIG. 9 when two or more sets of the original is to be printed after image capturing, recording material sheets on which the same page is printed are successively ejected or otherwise mixed; the user therefore must separate the recording material after printing.

The post-processing device 14 is provided to the image forming apparatus main body to address the problem. The device 14, for example, separates the recording material so that it is ejected to a set of eject trays, preventing multiple pages from being mixed up. The image forming apparatus main body is positioned at a predetermined distance from the post-processing device 14. There is a space between the image forming apparatus main body and the post-processing device 14.

The image forming apparatus main body is connected to the post-processing device 14 through an external transport section 19. The recording material carrying a printed image is transported from the transport section 17 via the external transport section 19 to the post-processing device 14.

There is demand for a double-sided print function for savings in energy and cost related to print paper and other recording material. The function is realized by a double-sided printing transport section 21. The section 21 turns over recording material carrying a printed image on one side and transports it again to the image recording device 12.

The recording material carrying a printed image on one side is transported again to the image recording device 12, not to the recording material eject section 16 or the post-processing device 14, after turned over in the double-sided printing transport section 21. The image recording device 12 then prints an image on the blank side, completing double-sided printing.

When recording material of types or quantities exceeding the capacity of the recording material feeder device 13 is to be fed, the external recording material feeder device 15 as a peripheral providing an expanded function is connected to the image forming apparatus main body. Recording material of desired types and quantities can be fed as being put in the external recording material feeder device 15.

Next, the image forming apparatus will be described in more detail, focusing on devices and members constituting it.

Figure 11:
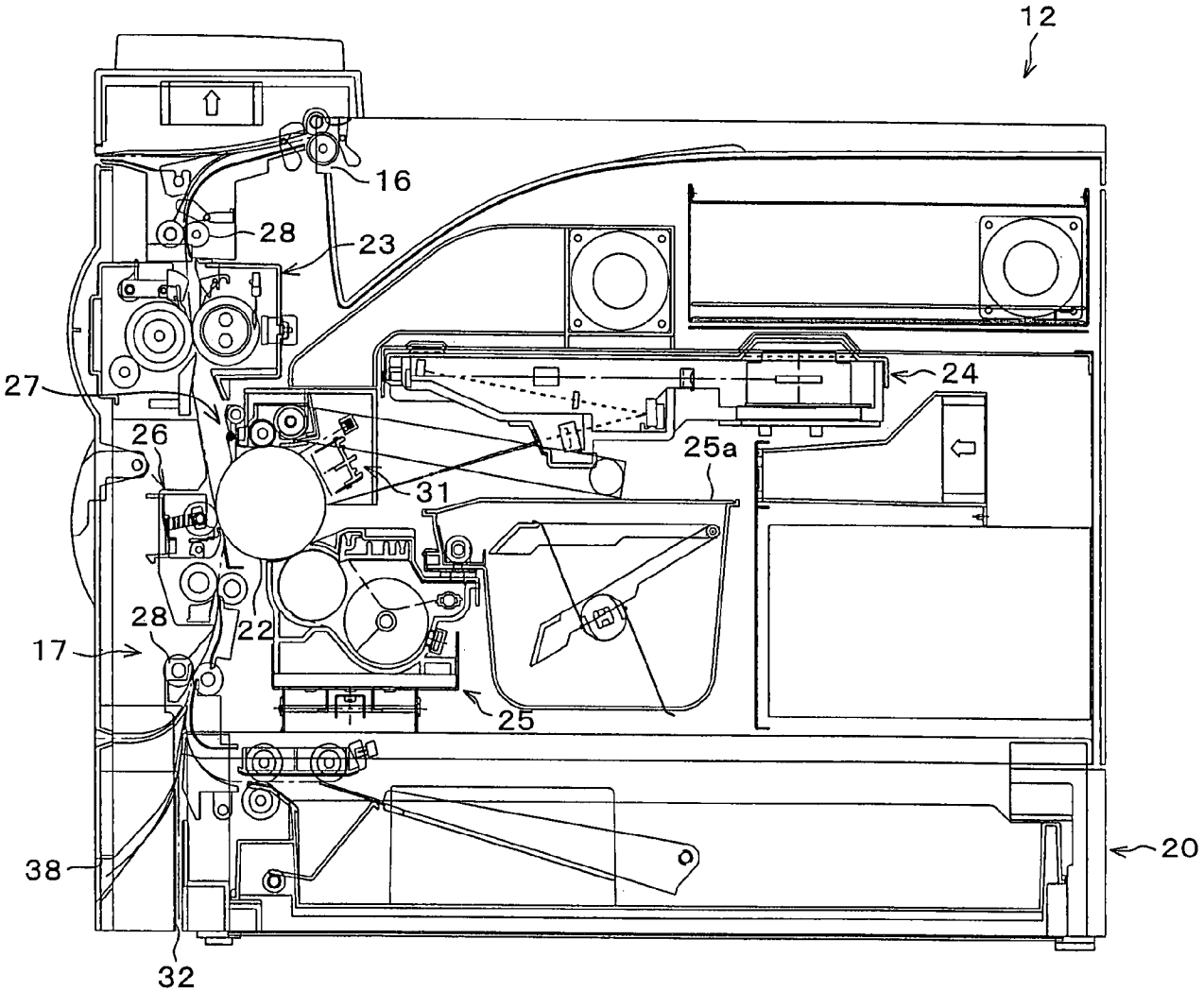
FIG. 11 is a drawing showing the structure of an image recording device in the image forming apparatus.

FIG. 11 is a drawing showing the structure of the image recording device 12. As shown in the figure, slightly to the left of the center of the image recording device 12 is there provided an electrophotographic processing section around a photosensitive drum 22.

Around the photosensitive drum 22 are there provided among others: an electrostatic charging unit 31 uniformly charging the surface of the photosensitive drum 22; an optical scan unit 24 scanning the uniformly charged photosensitive drum 22 to write an electrostatic latent image; a developing unit 25 developing the electrostatic latent image written by the optical scan unit 24 with a developing agent; a transfer unit 26 transferring the image developed on the surface of the photosensitive drum 22 to the recording material; and a cleaning unit 27 removing residual developing agent from the surface of the photosensitive drum 22 to allow the formation of a new image on the photosensitive drum 22, the units being disposed in this order.

Above the electrophotographic processing section (image transfer device) is there provided a fixer 23 sequentially receiving the recording material onto which an image has been transferred by the transfer unit 26 and thermally fixing the developing agent (toner) transferred to the recording material.

The recording material carrying a printed image is ejected with the printed side facing downward (facedown) by the recording material eject section 16 in the upper part of the image recording device 12. The residual developing agent removed by the cleaning unit 27 is retrieved and returned to a developing agent supply section 25*a* in the developing unit 25 for reuse.

In the lower part of the image recording device 12, a recording material feeder section 20 is provided containing recording material. The recording material feeder section 20 feeds the recording material sheet by sheet to the electrophotographic processing section.

The transport section 17 is made up of a set of rollers 28 and guides. The recording material is delivered from the recording material feeder section 20 through the first transport path defined primarily by the rollers, the guides, the photosensitive drum 22, and the transfer unit 26. After an image is printed, the recording material is delivered through the second transport path defined primarily by the rollers, the guides, and the fix unit 31 for ejection to the recording material eject section 16.

To refill the recording material feeder section 20 or replace the recording material in the section 20, a recording material containing tray is pulled out perpendicularly to the transport direction for the image recording device 12, that is, toward the front side.

On the bottom of the image recording device 12 is there provided a recording material receiving section 32 receiving the recording material delivered from the recording material feeder device 13 (see FIG. 12) as an expansion unit and sequentially supply the material between the photosensitive drum 22 and the transfer unit 26.

In the empty space around the optical scan unit 24 are there provided among others: a process control unit (PCU) board controlling the electrophotographic processing section; an interface board receiving image data from the outside of the apparatus; an image control unit (ICU) board carrying out predetermined image processes on the image data fed from the interface board and the image data captured by the original image capture device 11 for the optical scan unit to record the image by scanning; and a power supply unit supplying electric power to these various boards and units.

The image recording device 12 alone is capable of acting as a printer connecting to a personal computer or other external device via the interface board and forming an image on recording material according to the image data from the external device.

The foregoing description assumed that there is only one recording material feeder section 20 mounted inside the image recording device 12. This is by no means limiting the invention; two or more recording material feeder sections can be mounted in the device.

Figure 12:
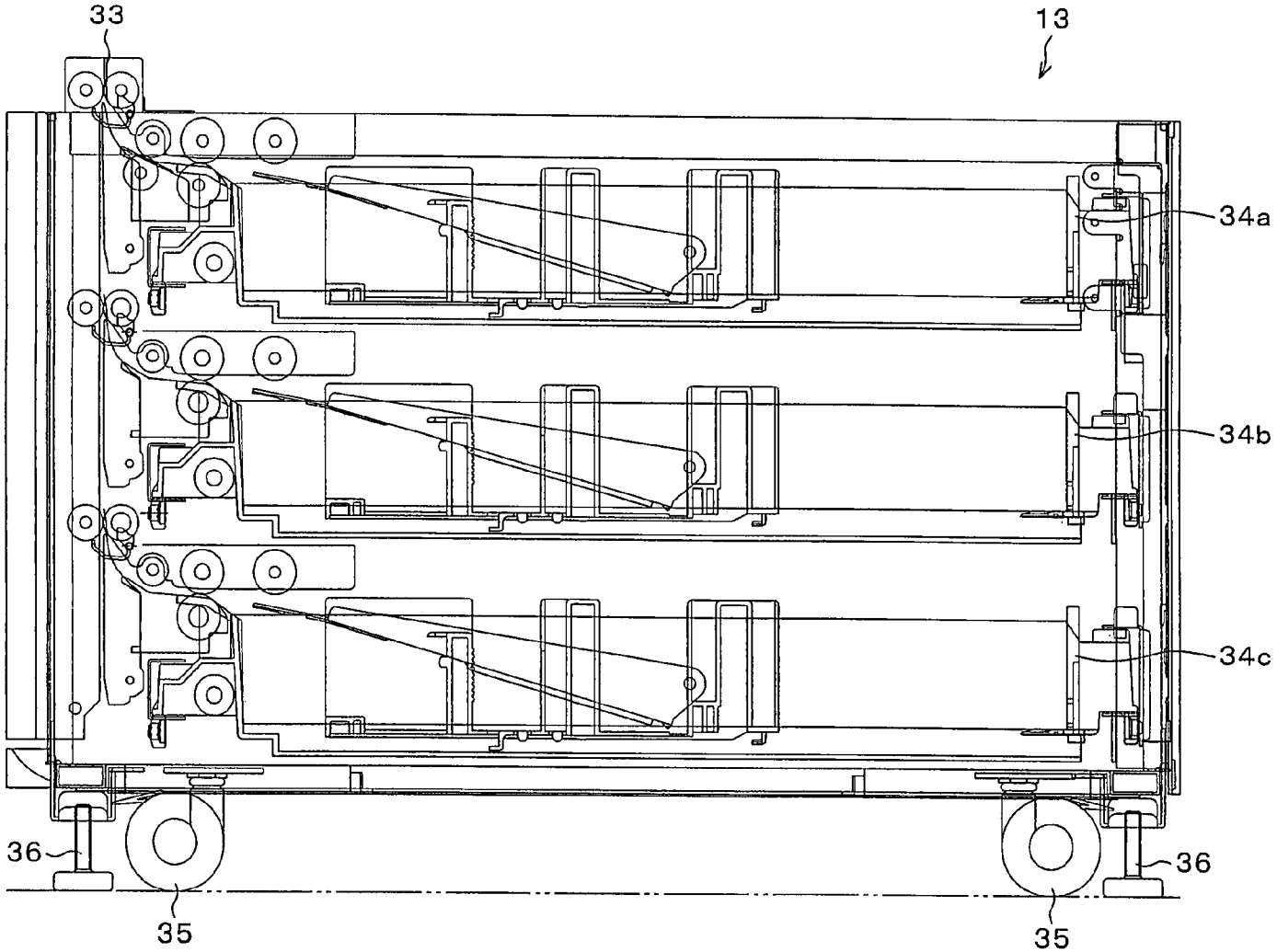
FIG. 12 is a drawing showing the structure of a recording material feeder device in the image forming apparatus.

FIG. 12 is a cross-sectional view showing the structure of the recording material feeder device 13 as an expansion unit. The recording material feeder device 13 can be attached as an expanded part of the image recording device 12 when, for example, the recording material feeder section 20 is incapable of providing the recording material in sufficient quantities.

The recording material feeder device 13 may contain recording material of a larger size than the recording material in the recording material feeder section 20. The device 13 separates the individual sheets of the recording material in it and sends out to the recording material eject section 33 on top of the recording material feeder device 13.

In the recording material feeder device 13, three recording material containing trays 34*a*–34*c* are provided. One of the stacked recording material containing trays 34*a*–34*c* containing desired recording material is selectively operated under the control of the PCU for individual delivery of the sheets of the recording material contained.

The recording material sent out from the tray is transported through the recording material eject section 33 and the recording material receiving section 32 in the lower part of the image recording device 12 before reaching the electrophotographic processing section. To refill the recording material feeder device 13 or replace the recording material in the device 13, one of the recording material containing trays 34*a*–34*c* is pulled out toward the front side of the recording material feeder device 13.

The foregoing description assumed that the three recording material containing trays 34*a*–34*c* are stacked up; alternatively, the stack may include, for example, at least one tray or three or more trays.

The recording material feeder device 13 has on its bottom a set of wheels 35, rendering movable the whole image forming apparatus main body including the readily recording material feeder device 13 when the device 13 is attached to the main body, for example. Stoppers 36 may be used to render the apparatus and device stationary in place.

Figure 13:
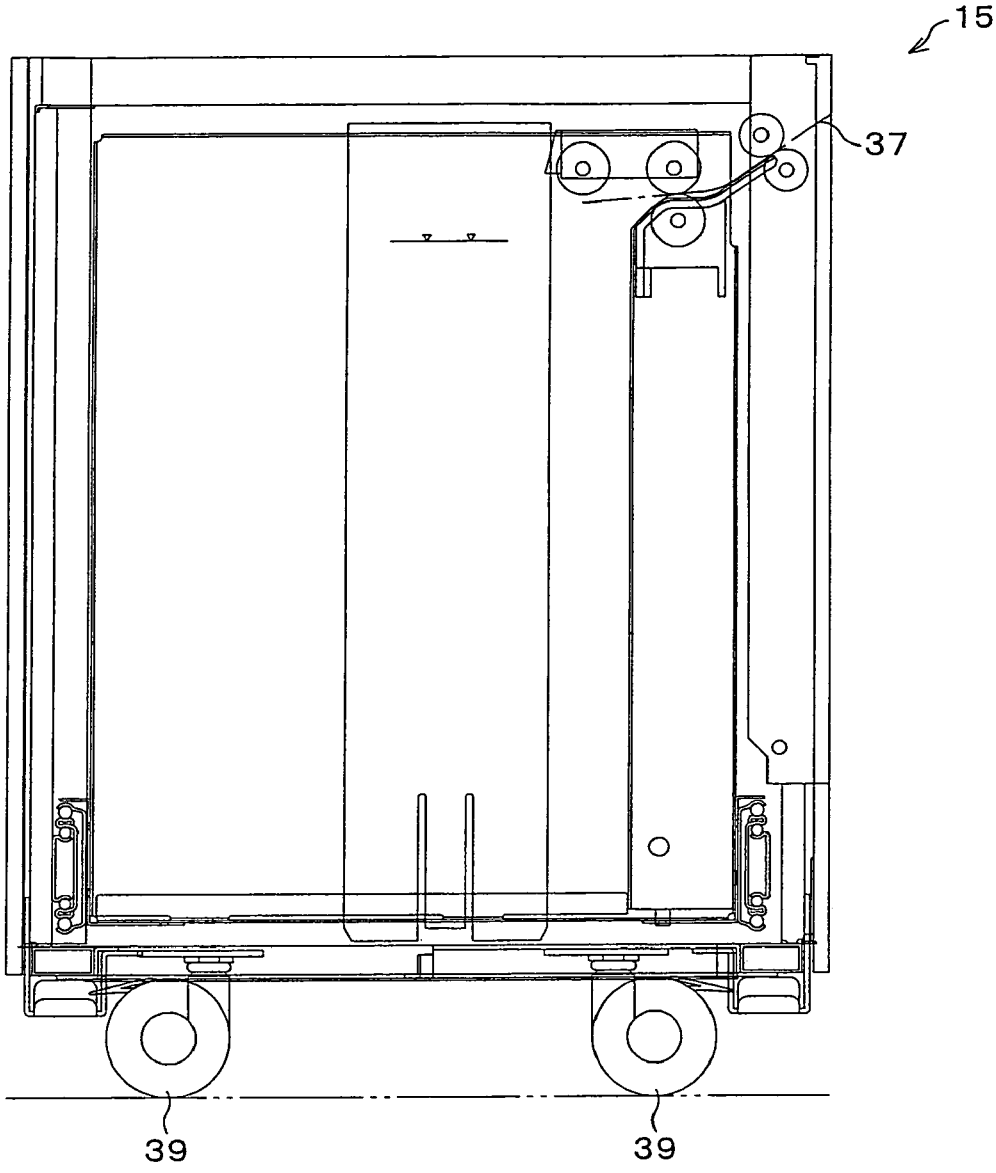
FIG. 13 is a drawing showing the structure of an external recording material feeder device for the image forming apparatus.

FIG. 13 is a drawing showing the structure of the external recording material feeder device 15. The external recording material feeder device 15 is capable of containing recording material of types and quantities exceeding the capacity of the recording material feeder device 13 attached to the image recording device 12, and sends out the contained recording material a sheet at a time to the recording material eject section 37 in the upper part of the device.

The recording material sent out from the recording material eject section 37 is transported to an external recording material receiving section 38 (see FIG. 11) in the lower side part of the image recording device 12.

When the external recording material feeder device 15 is in use, recording material can be additionally put into the external recording material feeder device 15 or substituted for the recording material in the device 15 through a refill opening 151 formed on top of the external recording material feeder device 15 as shown in FIG. 8. The refill opening 151 may have a reclosable lid 152 which is opened for refill or substitution and otherwise kept closed.

As shown in FIG. 13, a set of wheels 39 are provided on the bottom of the external recording material feeder device 15 so that the device 15 is readily movable when expanded. Stoppers may be used to render the device 15 stationary in place.

Figure 14:
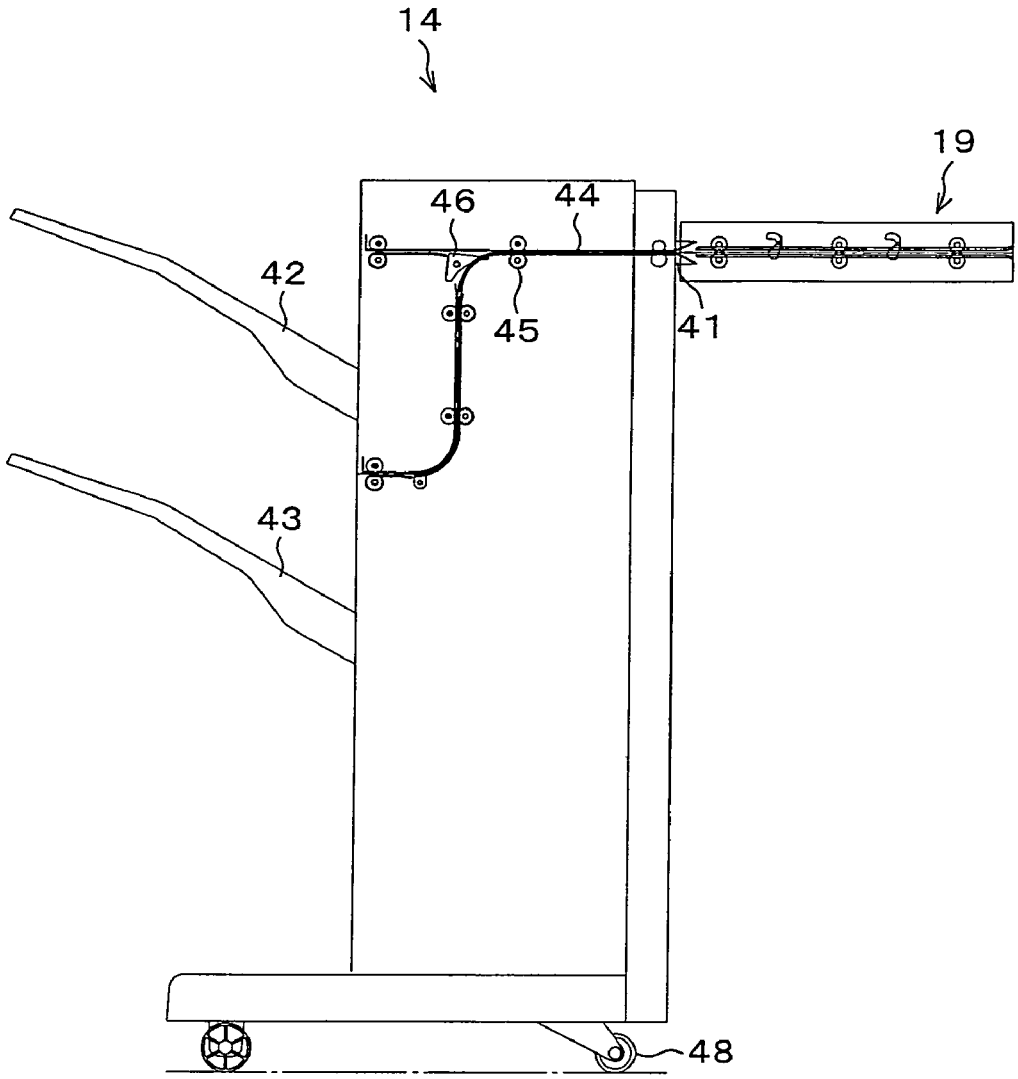
FIG. 14 is a drawing showing the structure of a post-processing device in the image forming apparatus.

FIG. 14 is a drawing showing the structure of the post-processing device 14. As shown in FIG. 9, the post-processing device 14 is placed at a predetermined distance from the image forming apparatus main body. The post-processing device 14 is connected to the image forming apparatus main body by the external transport section 19, so that the external transport section 19 transports the recording material carrying an image printed in the image forming apparatus main body is transported through to the post-processing device 14.

An end of the external transport section 19 is connected to an external eject section 212 of the image recording device 12, while the other end is connected to a recording material receiving section 41 in the post-processing device 14.

As shown in FIG. 14, the post-processing device 14 has a sorting transport section 44 capable of selectively ejecting the transported recording material to either one of eject trays 42, 43. The sorting transport section 44 is made up of a set of rollers 45, a guide, and a transport direction switch guide 46. Through the control of the transport direction switch guide 46, the sorting transport section 44 can switch between eject trays. A user can select one of the eject trays 42, 43 to which the recording material will be ejected, to sort out the recording material carrying a printed image upon ejection.

Apart from the aforementioned sort process, post-processing may involve stapling predetermined pages of recording material, folding prints of B4, A3, or another size, opening a hole through the recording material for filing purposes.

Wheels 48 are attached on the bottom of the post-processing device 14 to provide mobility.

The structure of the external transport section 19 is not limited in any particular manner. The external transport section 19 may be mounted to the post-processing device 14 so that the external transport section 19 can detachably connect to the image recording device 12. Alternatively, the external transport section 19 may be detachably mounted to the post-processing device 14 and the image forming apparatus main body 20.

FIG. 10 is a drawing showing the structure of the original image capture device 11. The original image capture device 11 operates in automatic image capture mode whereby an automatic original document feeder device (so-called ADF) automatically feeds original sheets for image capturing through optical scanning a sheet at a time and also in manual image capture mode whereby the user manually places original sheets bounded or otherwise rendered impossible for the ADF to handle for image capturing.

The original placed on a transparent original image capture platen 49 which is an image capture section is optically scanned to form an image on photoelectric conversion elements for conversion to electrical signals to obtain image data. The obtained image data is output through a connection to the image recording device 12.

To capture an image of both sides of the original, both sides of the original can be simultaneously scanned somewhere down the original document transport path.

To capture an image of the bottom side of the original, a movable optical scan system scanning the bottom of the original document platen, stationary at a predetermined position along the original document transport path, forms an optical image on CCDs. To capture the top side of the original document, there are provided among others: a light source above the original document transport path which shines light to the original document; optical lenses directing an optical image to the photoelectric conversion elements; a contact image sensor (CIS) built integrally from photoelectric conversion elements converting an optical image into image data.

On the selection of image capturing of both sides of the original, the original placed on the original document feeder section 111 is transported sheet by sheet for simultaneous image capturing of both sides of the sheet during the course of the transport.

The original image capture device 11 includes the original document tray 18 attached to it. The original document tray 18 is used to supply an original document before image capturing or receive the original after image capturing. In the former case, as an original before image capturing is placed on the original document tray 18, the original is loaded by a loader section of the ADF for transport to the original image capture platen 49. After the image capturing, the original is ejected from the device by an original document eject section. In the latter, as an original is placed on the original document feeder section 111, the original is loaded by the loader section of the ADF for transport to the original image capture platen 49. After the image capturing, the original is ejected to the original document tray 18 by the original document eject section.

Figure 15:
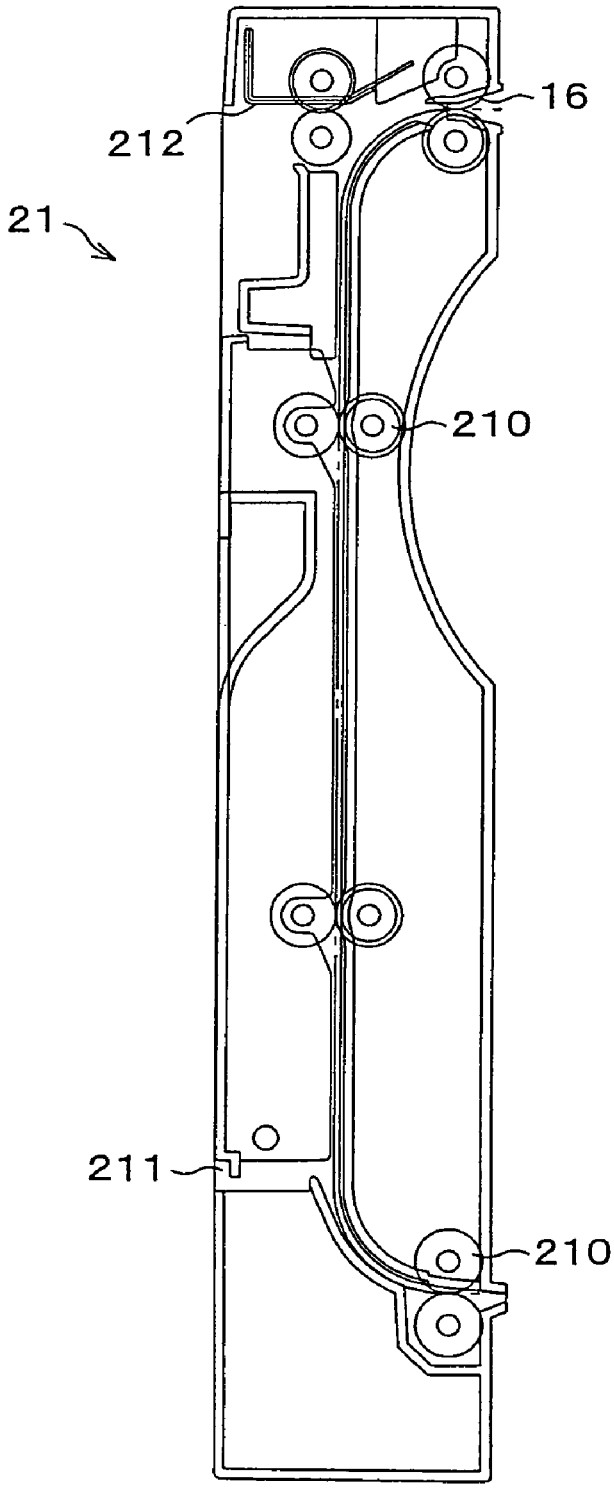
FIG. 15 is a drawing showing the structure of a double-sided printing transport section in the image forming apparatus.
Figure 16:
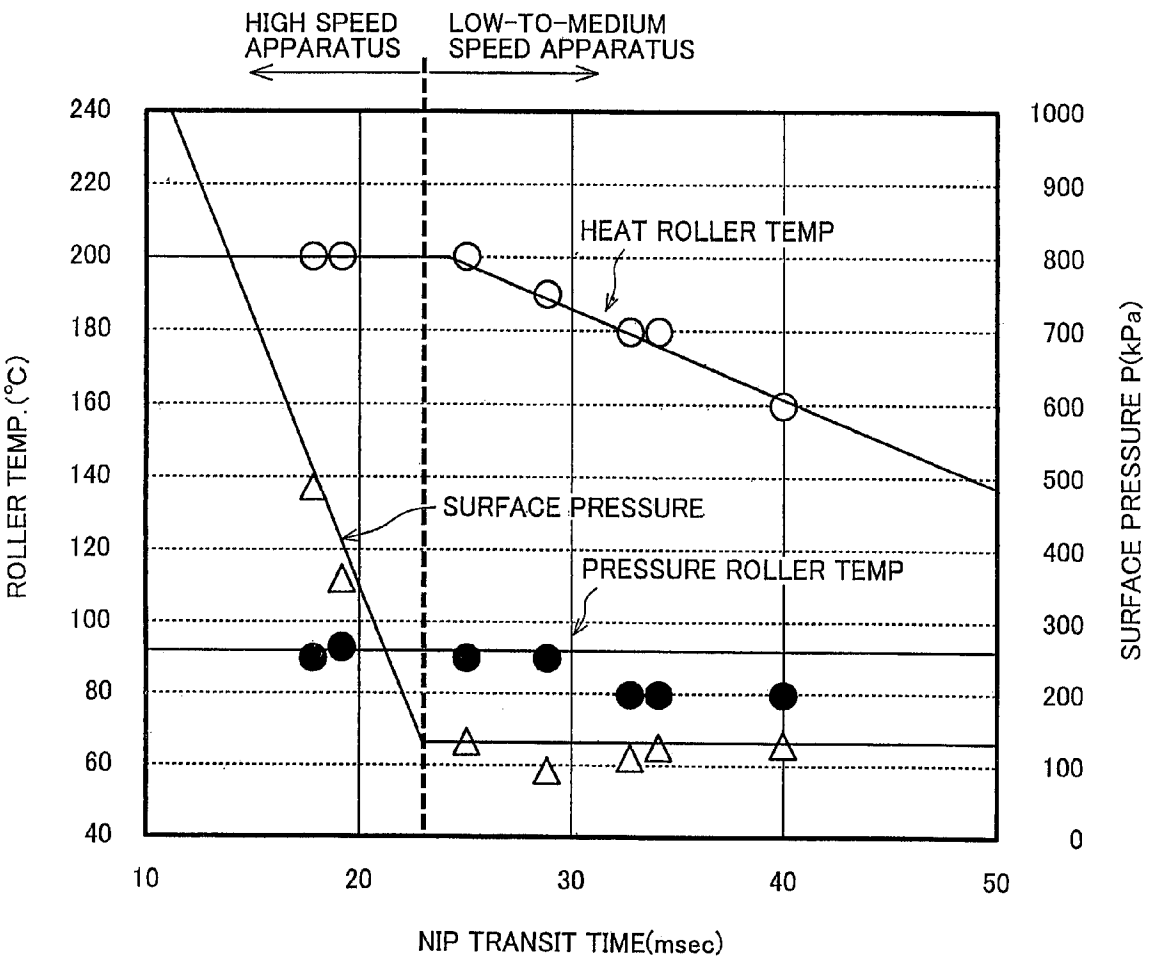
FIG. 16 PRIOR ART
FIG. 16 is a graph showing relationships between a nip transit time, a roller temperature, and a surface pressure applied to recording paper passing through a fix nip section in conventional low-to-medium and high speed apparatuses.

FIG. 15 is a drawing the structure of the double-sided printing transport device 21. The double-sided printing transport device 21 includes a double-sided printing transport section and attached to a side of the image recording device 12 shown in FIG. 11.

The double-sided printing transport section includes a set of rollers 210 transports the recording material ejected from the fixer 23 through a switchback, using the recording material eject section 16 in the upper part of the image recording device. That is, the recording material is turned over, and supplied again between the photosensitive drum 22 and the transfer device 26 in the electrophotographic processing section of the image recording device 12.

In the image forming apparatus 12, the recording material can be guided to the post-processing device 14 in FIG. 14 and the double-sided printing transport device 21 shown in FIG. 15, by transporting the recording material carrying a printed image in a switchback in the transport path ejecting the recording material to the recording material eject section 16 in the upper part of the device.

[Embodiment 2]

Figure 7:
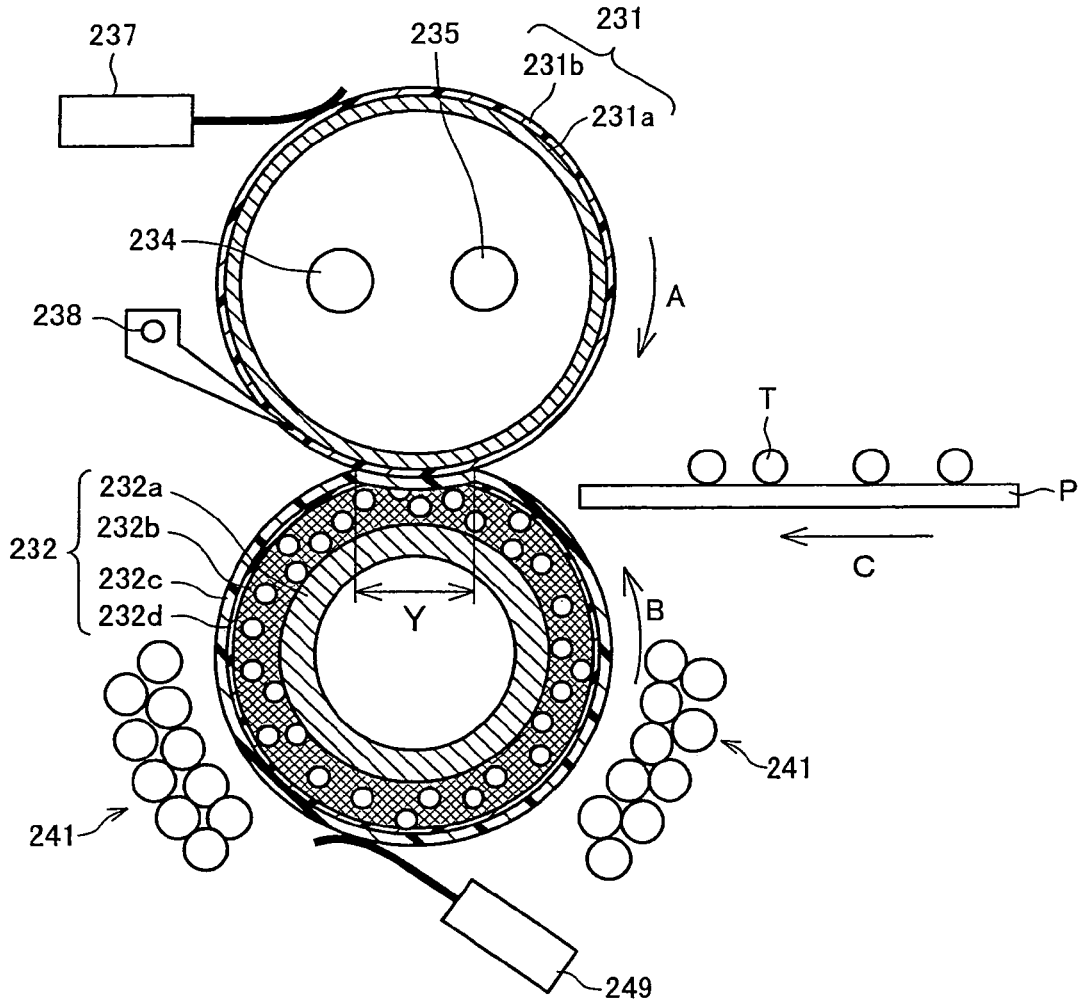
FIG. 7 is a drawing showing the structure of a major part of a fixer in accordance with another embodiment of the present invention.

Referring to FIGS. 1, 7, the following will describe another embodiment of the present invention. Here, for convenience, members of the present embodiment that have the same function as members of embodiment 1, and that are mentioned in that embodiment are indicated by the same reference numerals and description thereof is omitted.

The fixer in accordance with the present embodiment includes an induction heating coil (external heating member) 241 shown in FIG. 7 as heating means in place of the external heat roller 233 shown in FIG. 1. The induction heating coil 241 is connected a drive power supply (not shown). The cleaning roller is omitted in FIG. 7.

A pressure roller 232 in accordance with the present embodiment constructed of four layers: a core metal 232*a*, a heat resistant elastic material layer 232*b* formed of, for example, a silicone rubber on the core metal 232*a*, a heating layer 232*d* on the layer 232*b*, and a releasing layer 232*c* as the outermost layer.

The core metal 232*a* is iron, stainless steel, aluminum, or a like metal and measures 28 mm in diameter. The heat resistant elastic layer 232*b* is formed of a 6-mm thick silicone rubber foam on the core metal 232*a*.

The core metal 232*a* is preferably aluminum for the purpose of preventing induction heating.

The heating layer 232*d* is a member which heats up by induction heating. Its thickness is reduced to 40 μm to 50 μm to cut down on the rise time of the surface temperature.

Since the heating layer 232*d* needs to heat up by induction heating (heated by current generated by electromagnetic induction), the layer 232*d* is made of iron, SUS430 stainless steel, or any other electrically conductive, magnetic material. Especially preferred materials are those with high specific permeability (for example, 1 or greater), including a silicon steel board, an electromagnetic steel board, and nickel steel.

Non-magnetic materials, such as SUS304 stainless, which shows high resistivity (for example, $9.8\times10^{-6}$ ohm centimeters or greater) may also be used, because such materials heat up by induction heating. The base of the roller 232 may be non-magnetic (for example, ceramics) provided that the layer 232*d* exhibits sufficient conductance and high specific permeability. Here, the heating layer 232*d* is made of 40-μm thick nickel by electroforming. The heating layer 232*d* maybe made up of multiple sublayers of different materials for increased heating.

The releasing layer 232*c* is formed on the (outer) surface of the heating layer 232*d* to prevent the toner T from, when heated in the fix nip section Y, sticking to the heat roller 231 due to reduced viscosity. The layer 232*c* is made of a fluororesin, such as PTFE (polytetrafluoroethylene) and PFA (a copolymer of tetrafluoroethylene and perfluoroalkylvinylether); elastic materials, such as a silicone rubber, fluororubber, and fluorosilicon rubber; or sublayers each made of one of these materials.

The pressure roller 232 is pressed to the heat roller 231 by a spring or other pressure member (not shown) with a force of 274 N. Thus, the fix nip section Y, about 7 mm wide, is formed between the pressure roller 232 and the heat roller 231.

The induction heating coil 241 provides a means of heating the pressure roller 232 as shown in the figure. The coil 241 is structured to surround the outer rim of the pressure roller 232. The structure gives a curvature to the induction heating coil 241, which in turn develops a concentration of magnetic flux inside the induction heating coil 241 and hence increases the magnitude of eddy current. This works in favor of quickly increasing the surface temperature of the pressure roller 232.

Here, the induction heating coil 241 is made of a single aluminum wire (coated with a surface insulating layer, for example, oxidation film) for better heat resistance. Alternatively, the coil 241 may be made of a copper wire, a copper-based composite wire, or a litz wire (for example, multistranded enameled wire). No matter which material is used, the total resistance of the induction heating coil 241 should be 0.5 Ω or less, preferably 0.1 Ω or less, in order to restrain the Joule loss in the induction heating coil 241, Two or more induction heating coils 241 may be provided depending on the size of the recording paper P to which toner T is fixed.

The pressure roller 232 is induction heated by an alternating magnetic field generated by high-frequency current supplied from an excitation circuit (not shown) to the induction heating coil 241.

Around the pressure roller 232 is there provided a thermistor (temperature line sensor) 249 as temperature sensing means to sense the surface temperature of the pressure roller 232. Temperature control means (control means; not shown) controls the electric current feed to the induction heating coil 241 on the basis of obtained temperature data, so as to maintain the surface of the pressure roller 232 at a predetermined temperature.

Now, see Table 4 showing the heating efficiency (equal to the heat transfer to the pressure roller 232 divided by the power consumption by the power source) and average power consumption for 20 page copying under two sets of conditions for comparison. Arrangement (IV) employed the induction heating coil 241 (the induction heating method) as the heating means for the pressure roller 232, whilst arrangement (II) employed the aforementioned external heat roller 233 (the heat roller method) in embodiment 1.

TABLE 4

| | Arrgmt. (II) | Arrgmt. (IV) |
|---|---|---|
| Pressure roller heating means | Included (External roller) | Included (External roller) |
| Fixing rate (mm/s) | 365 | 365 |
| Fix nip width (mm) | 7 | 7 |
| Nip transit time (ms) | 19.2 | 19.2 |
| Temp. T1 of heat roller (° C.) | 200 | 200 |
| Temp. T2 of pressure roller (° C.) | 130 | 120 |
| T1 − T2 (deg.) | 70 | 80 |
| Required fixing load (N) | 274 | 274 |
| Heating efficiency (%) | 51.5 | 70 |
| Power consumption in external heat source when paper is in transit (W) | 139.9 | 52.2 |

Note:
Arrgmt < Arrangement

As shown in Table 4, by the heat roller method, heat is transferred from the heat roller 231 to the pressure roller 233 by conductance due to difference in temperature. The induction heating method, whereby the direct pressure roller 232 heats up by itself, achieves better heating efficiency than the heat roller method.

In the induction heating method, the induction heating coil 241 itself hardly heats up; therefore little heat dissipates into the air like in the heat roller method. The average power consumption while paper is in transit in the induction heating method is 37% that in the heat roller method. The method therefore allows for reduction in power consumption,

[Embodiment 3]

Referring to FIGS. 1, 7, the following will describe another embodiment of the present invention. Here, for convenience, members of the present embodiment that have the same function as members of embodiment 1, and that are mentioned in that embodiment are indicated by the same reference numerals and description thereof is omitted.

In the fixer (heater) 23 in accordance with the present embodiment, as shown in FIG. 1, the core metal 231*a* is iron (STKM (carbon steel)) and has a diameter of 40 mm and a thickness of 1.3 mm to give it low thermal capacity. The combined power rating of the heater lamps 234, 235 is 800 W.

The pressure roller 232 is rotatable in the direction indicated by arrow B in the figure. The roller 232 is pressed to the heat roller 231 by a spring or other pressure member (not shown) with a force of 745N (76 kgf). Thus, the fix nip section Y, about 6 mm wide, is formed between the pressure roller 232 and the heat roller 231.

The external heat roller 233 has a heater lamp 239 in it to heat the pressure roller 232. The heater lamp 239, rated at 400 W, is similarly constructed to the aforementioned heater lamps 234, 235. The core metal 233*a* is an aluminum cylinder shaft measuring 15 mm in diameter and 1.0 mm in thickness.

To sufficiently fix toner T onto the recording paper P, it is preferred to raise the surface temperature of the external heat roller 233 and the temperature of the pressure roller 232. Nevertheless, raising the temperature of the rollers 233, 232 increases the power consumption in the fixer 23.

The following will examine optimal structural conditions of the external heat roller 233 in view of toner fixing performance and power consumption.

First, we prepared six external heat rollers 233 of which the core metal was aluminum. They are identical in thermal capacity (34.4 J/° C.), and hence in warm-up conditions. The six rollers however differed in roller diameter (core metal diameter) and roller thickness (core metal thickness).

For each external heat roller, the load applied to it was determined so that the maximum warpage of the roller equaled 0.1 mm which was the upper limit of the range within which the warpage causes no problems in practice. Under these settings, the width (the length in the direction indicated by arrow B in FIG. 1) was measured of the heating nip section Z formed between the external heat roller and the pressure roller.

Table 5 below shows the roller diameter (mm), roller thickness (mm), thermal capacity (roller thermal capacity) (J/° C.), load (N), maximum warpage (roller maximum warpage) (mm), and width (heating nip width) of the heating nip section Z (mm) of each of the six external heat rollers. Each roller had an aluminum core.

The aluminum composing the core metal of the external heat roller had a Young modulus of 7200 (kgf/mm$^2$).

TABLE 5

| | | | | | | |
|---|---|---|---|---|---|---|
| Core material of roller (mm) | Al | Al | Al | Al | Al | Al |
| Diameter of roller (mm) | 9.43 | 12.5 | 18.6 | 24.7 | 30.8 | 43.0 |
| Thickness of Roller | 1.85 | 1.25 | 0.79 | 0.58 | 0.46 | 0.33 |
| Thermal capacity of roller (j/° C.) | 34.4 | 34.4 | 34.4 | 34.4 | 34.4 | 34.4 |
| Load (N) | 6.08 | 12.7 | 32.3 | 57.8 | 92.1 | 182.3 |
| Roller Maximum warpage (mm) | 0.10 | 0.10 | 0.10 | 0.10 | 0.10 | 0.10 |
| Heating nip width (mm) | 0.25 | 0.5 | 1.0 | 1.5 | 2.0 | 3.0 |

Using these six external heat rollers shown in Table 5, 40 A4 sheets in landscape orientation were passed through the fixer under the three sets of conditions shown in Table 6, to examine the surface temperature of the external heat roller (hereinafter, "the external heat roller temperature") and the total power consumption in the fixer (hereinafter, "the power consumption during paper transit") which achieved sufficient fixing performance (sufficient fixing of the toner T onto the recording paper P).

TABLE 6

| | Condition Set 1 | Condition Set 2 | Condition Set 3 |
|---|---|---|---|
| Print Paper Transit Speed | 60 (pages/min.) | 65 (pages/min.) | 70 (pages/min.) |
| Fixing Rate | 325 (mm/s) | 365 (mm/s) | 395 (mm/s) |

The recording paper transit speed (hereinafter, "paper transit speed" (transit speed (copies per minute)) in Table 6 indicates how many A4 sheets of recording paper P in landscape orientation are loaded into the fixer, hence, pass a point in the fix nip section Y, per minute. The fixing rate (transit speed (mm/sec.)) indicates the speed at which a point on the sheet of recording paper P passes through the fix nip section Y. The paper transit speed and the fixing rate are interrelated.

Figure 17:
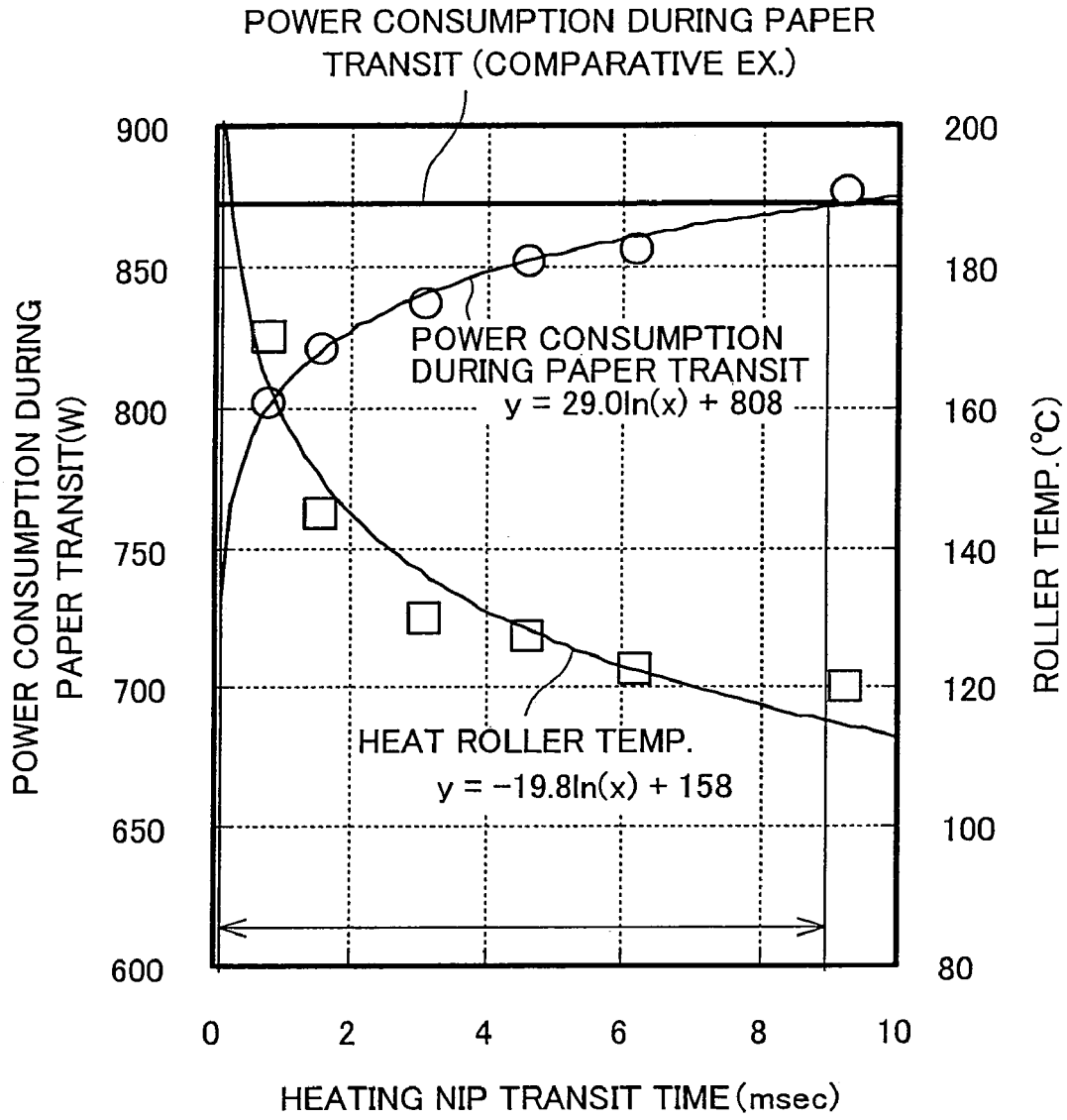
FIG. 17 is a graph showing relationships between an external heat roller temperature (roller temperature) (° C.), a power consumption (W) during paper transit, and a heating nip transit time (ms) when the external heat roller is made of aluminum, and the fixing rate is 325 mm/sec.

Relationships between the external heat roller temperature (roller temperature) (° C.), the power consumption (W) during paper transit, and the heating nip transit time (ms) which is the time taken for a point on the external heat roller to pass through the heating nip section Z (i.e., the width of the heating nip section Z divided by the fixing rate) are shown which are results of the 40 sheets being passed. FIG. 17 shows the relationships under the set of conditions 1, FIG. 18 under the set of conditions 2, and FIG. 19 under the set of conditions 3.

Figure 18:
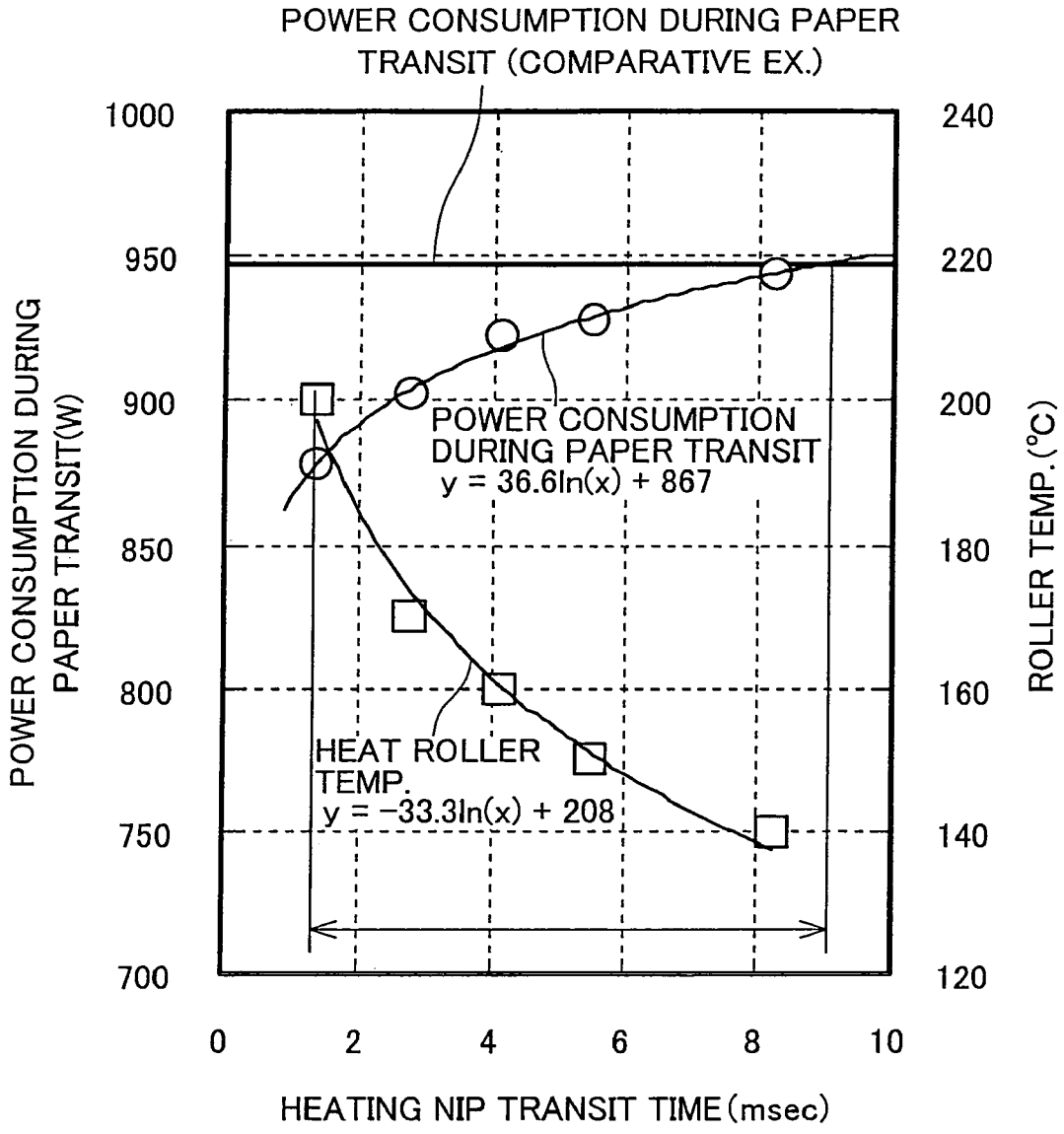
FIG. 18 is a graph showing relationships between an external heat roller temperature (roller temperature) (° C.), a power consumption (W) during paper transit, and a heating nip transit time (ms) when the external heat roller is made of aluminum, and the fixing rate is 365 mm/sec.
Figure 19:
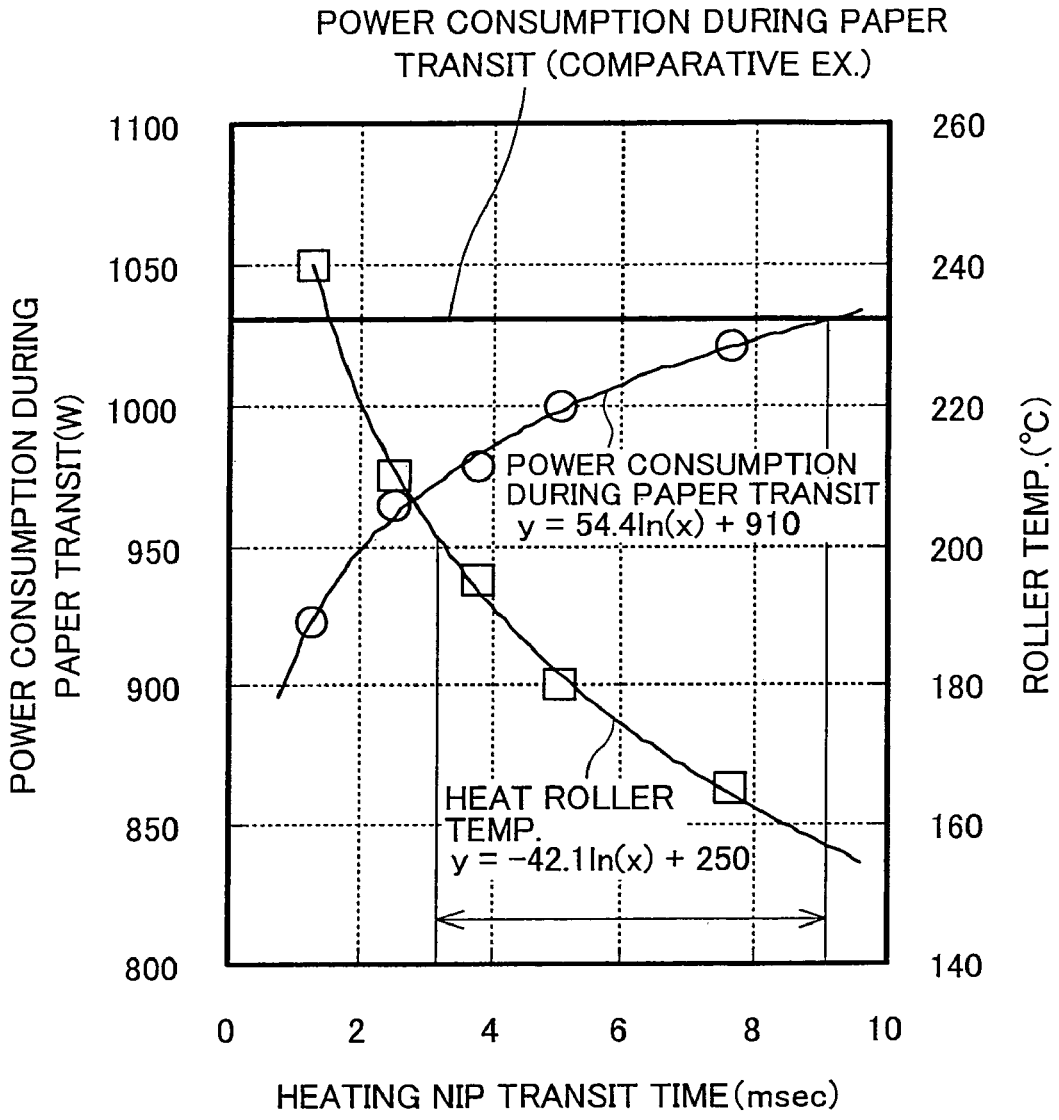
FIG. 19 is a graph showing relationships between an external heat roller temperature (roller temperature) (° C.), a power consumption (W) during paper transit, and a heating nip transit time (ms) when the external heat roller is made of aluminum, and the fixing rate is 395 mm/sec.

In FIGS. 17 to 19, the relationship between the external heat roller temperature (roller temperature) (° C.) and the heating nip transit time (ms) is indicated by squares, whilst the relationship between the power consumption (W) during paper transit and the heating nip transit time (ms) is indicated by circles.

As shown in FIGS. 17 to 19, a longer heating nip transit time, hence a greater width of the heating nip section Z, improves fixing of toner T even at low external heat roller temperatures. On the other hand, a longer heating nip transit time results in a greater power consumption during paper transit. Reasons will be examined in the following.

To increase the width of the heating nip section Z, the diameter of the external heat roller needs to be increased. Here, as shown in Table 5, the external heat rollers are varied only in thickness, disregarding their diameters, to give them equal thermal capacity. While all the rollers do have an equal thermal capacity (34.4 J/° C.), a greater diameter of the external heat roller gives the roller a greater surface area, which results in increased thermal radiation and convection, and hence heat loss from the rollers. The increase in heat loss presumably exceeds the reduction in heat consumption realized by the lowered surface temperature of the external heat roller. The result is an increased total power consumption.

FIGS. 17 to 19 also show as a comparative example the relationship, in for a fixer having no external heat roller, between the heating nip transit time and the power consumption during paper transit under the conditions. The fixer for the comparative example is identical in structure to the fixer 23 shown in FIG. 1, except that the external heat roller 233 is removed.

Figure 20:
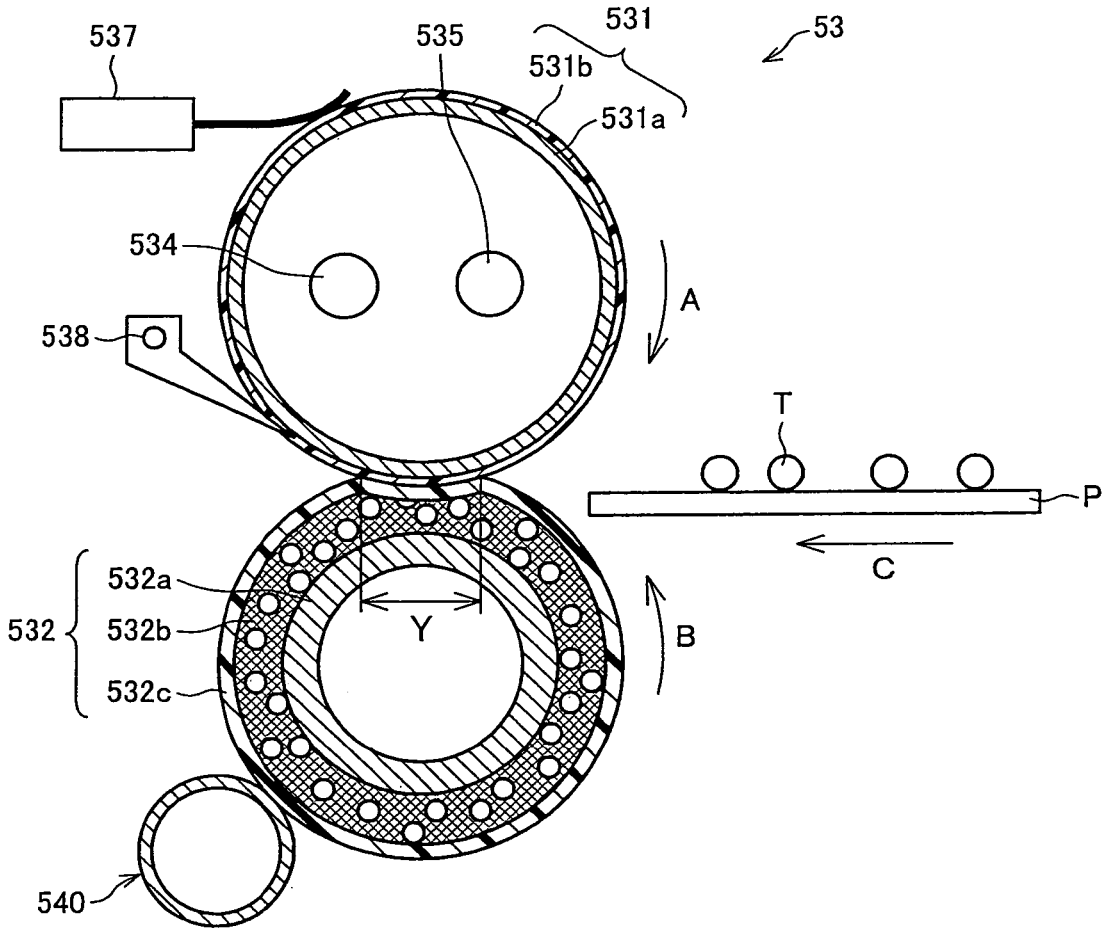
FIG. 20 is a drawing showing the structure of a major part of a fixer as a comparative example.

The structure of the comparative example fixer is shown in FIG. 20. Specifically, the comparative example fixer 53 includes a heat roller 531, a pressure roller 532, a cleaning roller 540, heater lamps 534, 535, a temperature sensor 537, and a guide section 538.

The heat roller 531 is equivalent to the heat roller 231 (see FIG. 1), the pressure roller 532 to the pressure roller 232 (see FIG. 1), the cleaning roller 540 to the cleaning roller 240 (see FIG. 1), the heater lamps 534, 535 to the heater lamp 234, 234 (see FIG. 1), the temperature sensor 537 to the temperature sensor (see FIG. 1), and the guide section 538 to the guide section 238 (see FIG. 1). These members in the fixer 53 have the same structure as the respective equivalent members in FIG. 1. The fixer 53 has the identical structure as the fixer 23 except the missing external heat roller 233.

The following description will focus on the distinctions of the fixer 53 over the fixer 23. Description on common features will be omitted.

As with the core metal 231*a* of the heat roller 231, the core metal 531*a* of the heat roller 531 in the fixer 53 is carbon steel (STKM). The core metal 531*a* however measures 55 mm in diameter and 1.3 mm in thickness. The heater lamps 534, 535 have a combined power rating of 1200 W.

As with the core metal 232*a* of the pressure roller 232, the core metal 532*a* of the pressure roller 532 in the fixer 53 is stainless steel. The core metal 532*a* however measures 43 mm in diameter.

The pressure roller 532 is pressed to the heat roller 531 by a spring or other pressure member (not shown) with a force of 980 N (100 kgf). Thus, a fix nip section Y', about 8 mm wide, is formed between the heat roller 531 and the pressure roller 532.

Consequently, in the fixer 23, the rollers 231, 232 measure about 40 mm in diameter; the load necessary to fix toner T onto recording paper P (hereinafter, "required fixing load"), that is, the pressure of the pressure roller 232 to the heat roller 233 is 745N; and the fix nip section Y is 6 mm wide. In contrast, in the fixer 53, the roller 531, 532 measure about 55 mm in diameter; the required fixing load is 980 N; and the fix nip section Y' is 8 mm wide.

As discussed in the foregoing, the roller diameter, fixing load, fix nip section width are specified to greater values in the fixer 53 than in the fixer 23, because the fixer 53, including no external heat roller, inevitably requires a greater fixing load, fix nip section width, etc. to achieve equivalent fixing performance at the same fixing rate (recording paper transit speed) as in the fixer 23.

The heating nip transit time t (ms) is preferably determined to meet two conditions: (a) The power consumption during paper transit is less than or equal to the power consumption during paper transit of the fixer 53 with a conventional structure. (b) The surface temperature of the external heat roller is 200° C. or lower.

In condition (b), the surface temperature of the external heat roller is 200° C. or lower. This is because an examination of the aforementioned heat resistance of the external heat roller revealed that the heat resistance temperature (upper limit value) was about 200° C.

Here, in FIGS. 17 to 19, the range of heating nip transit time meeting conditions (a), (b) is indicated by two arrows.

Table 7 shows the upper and lower limits of the range for the heating nip transit time meeting conditions (a), (b) at the paper transit speeds (fixing rates) shown in Table 6 as derived from FIGS. 17 to 19.

TABLE 7

| Paper | Optimal Nip Transit Time (ms) | |
|---|---|---|
| Transit Time | Maximum | Minimum |
| 50 | 0.12 | 9.12 |
| 65 | 1.37 | 9.04 |
| 70 | 3.26 | 9.11 |

Figure 21:
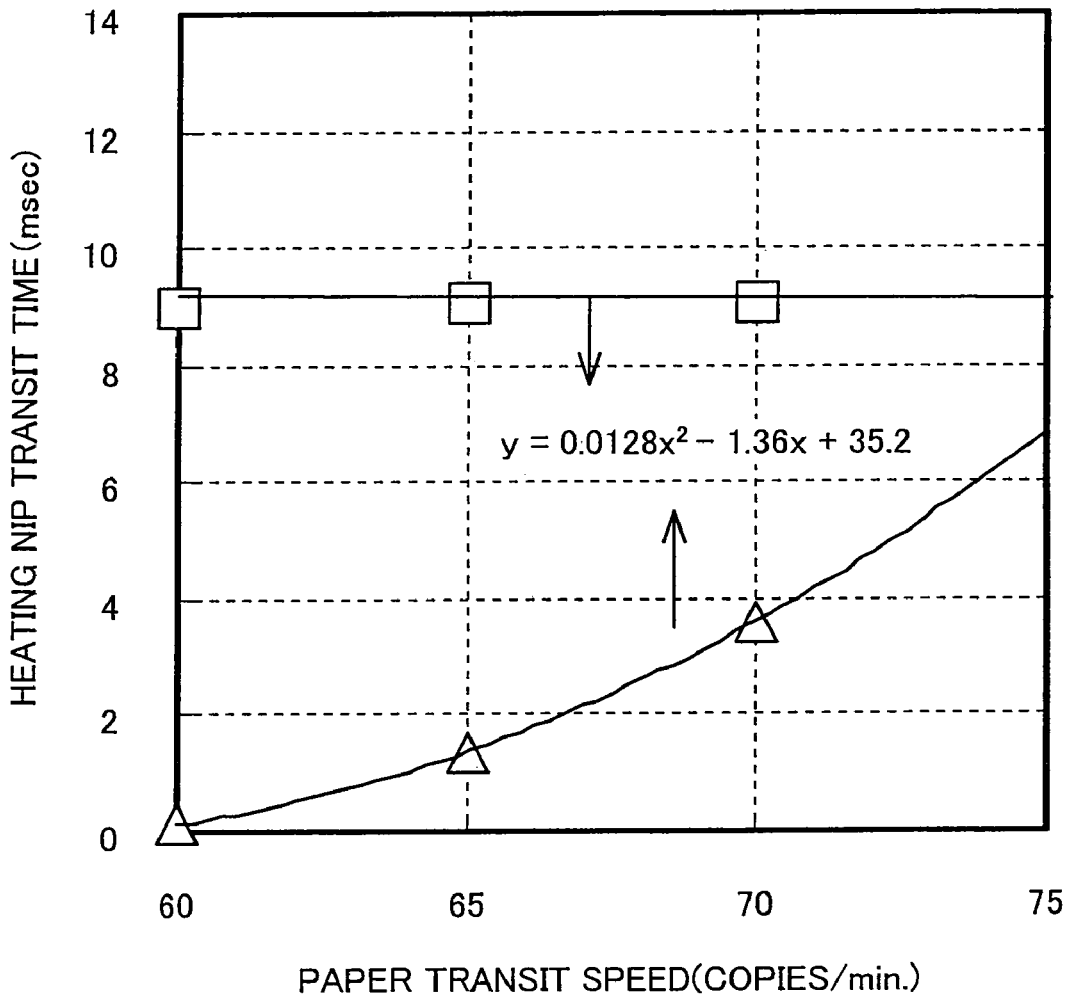
FIG. 21 is a graph showing a relationship between a heating nip transit time (ms) and a recording paper transit speed (copies per minute) when the external heat roller is made of aluminum, the power consumption during paper transit is less than or equal to that of the comparative example, and the surface temperature of an external heat roller is 200° C. or below.

FIG. 21 shows the relationship between the range of the heating nip transit time meeting conditions (a), (b) as derived from FIGS. 17 to 19 and the recording paper transit speed (paper transit speed). In FIG. 21, the x-axis indicates the paper transit speed (copies per minute), and the y-axis indicates the heating nip transit time (ms).

As shown in the figure, approximating, by the least squares method, the relationship between the paper transit speed P (copies per minute) and the lower limit value t1 of the heating nip transit time, we obtain $t1=0.0128P^2-1.36P+35.2$.

The upper limit value t2 of the heating nip transit time is substantially constant at 9.15 or less without regard to the paper transit speed P (copies per minute).

Therefore, the relationship between the heating nip transit time t (ms) and the paper transit speed P (copies per minute) is preferably given by equation (3):

$$0.0128P^2-1.36P+35.2 \leqq t \leqq 9.15 \quad (3)$$

Figure 22:
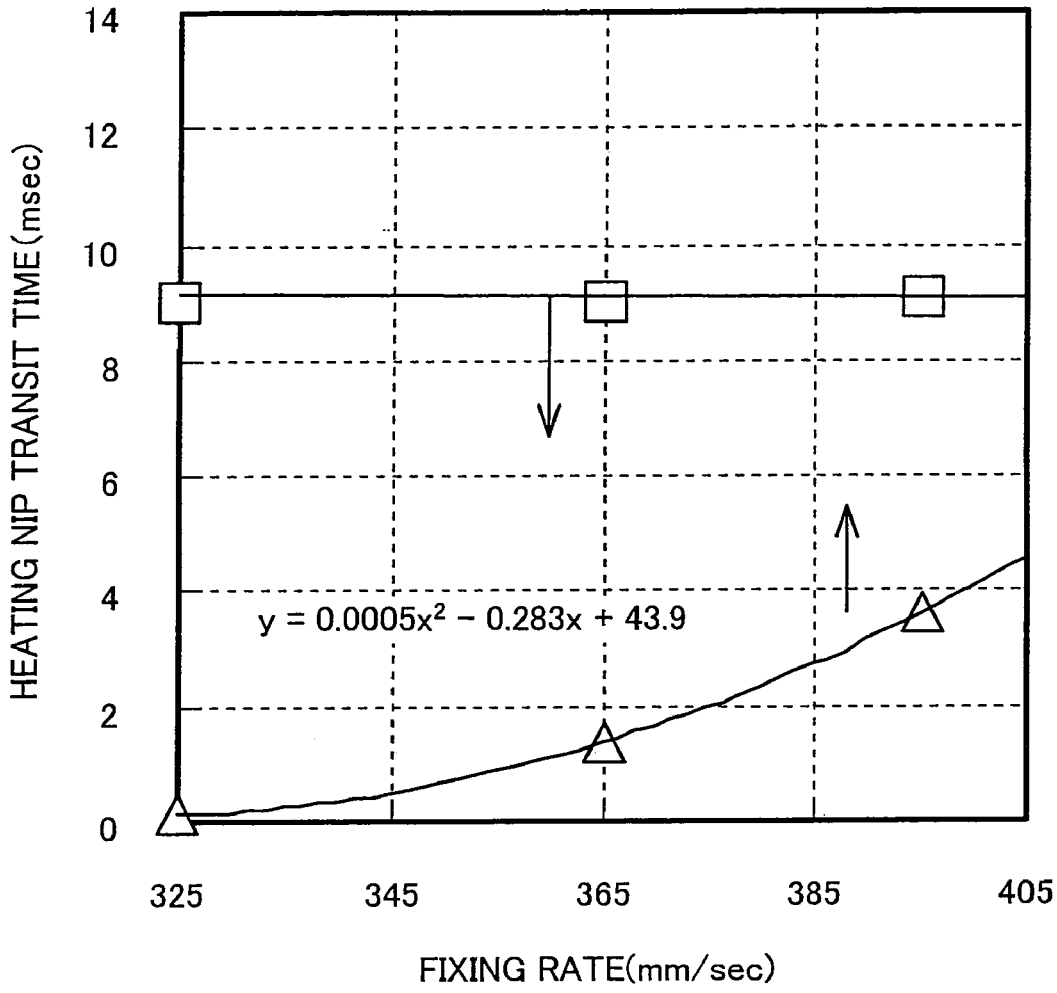
FIG. 22 is a graph showing a relationship between a heating nip transit time (ms) and a fixing rate (mm/sec.) when the external heat roller is made of aluminum, the power consumption during paper transit is less than or equal to that of the comparative example, and the surface temperature of an external heat roller is 200° C. or below.

Further, FIG. 22 shows the relationship between the range of the heating nip transit time meeting conditions (a), (b) as derived from FIGS. 17 to 19 and the fixing rate. In FIG. 22, the x-axis indicates the fixing rate (mm/sec.), and the y-axis indicates the heating nip transit time (ms).

As shown in the figure, approximating, by the least squares method, the relationship between the fixing rate V (mm/sec.) and the lower limit value t1 of the heating nip transit time, we obtain $t1=0.0005V^2-0.283V+43.9$.

As mentioned earlier, the upper limit value t2 of the heating nip transit time is substantially constant at 9.15 or less without regard to the fixing rate V (mm/sec.).

Therefore, the relationship between the heating nip transit time t (ms) and the fixing rate V (mm/sec.) is preferably given by equation (4):

$$0.0005V^2-0.283V+43.9 \leqq t \leqq 9.15 \quad (4)$$

As in the foregoing, the fixer 23 includes the heat roller 231 and the pressure roller 232 pressing each other and heats up the recording paper P by passing the recording paper P through the fix nip section Y. The external heat roller 233, in contact with the pressure roller 232 to rotate with the pressure roller 232, heats the pressure roller 232 so that the surface of the pressure roller 232 reaches a predetermined temperature (for example, the limit for the heat resistance temperature).

The heating nip transit time required for any given point on the rotating pressure roller 232 to pass through the heating nip section Z is decided on the basis of the material and thermal capacity of the external heat roller 233, the power consumption by the fixer 23 (heat roller 231, pressure roller 232, and external heat roller 233) during the transit of the recording paper P, and the surface temperature of the external heat roller 233 during the transit of the recording paper P.

In other words, the fixer 23 is arranged to meet equation (3) or (4) in the case of an aluminum external heat roller 233 (core metal 233*a*). When this is the case, the external heat roller 233 has a thermal capacity of 34.4 J/° C.

Thus, the heating nip transit time can be determined in accordance with the material and thermal capacity of the external heat roller 233 so that, for example, the heater's power consumption during the transit of the recording paper P is smaller that in the comparative example with no external heat roller 233 or the surface temperature of the external heat roller 233 during the transit of the recording paper P does not exceed a predetermined temperature (for example, heat resistance temperature (here, 200° C.)).

Therefore, power consumption can be lowered although the external heat roller 233 is included.

The following will examine an external heat roller (equivalent to the external heat roller 233) with a carbon steel (steel) core metal (equivalent to the core metal 233*a* shown in FIG. 1). To obtain external heat rollers with an equal thermal capacity (here, 34.4 J/° C.), and thereby the same warm-up conditions, five external heat rollers were prepared with varying roller diameters and roller thicknesses.

The load to the external heat roller was determined so that the warpage of each external heat roller does not exceed 0.1 mm, which was the upper limit of the practically problem-free range. Under the conditions, the width of the heating nip section Z formed between the external heat roller and the pressure roller was measured.

Shown in Table 8 are the roller diameters (mm), roller thicknesses (mm), thermal capacities (roller thermal capacities) (J/° C.), loads (N), maximum warpages (roller maximum warpages) (mm), and widths (heating nip widths) (mm) of the heating nip section Z of the five carbon steel external heat rollers.

The carbon steel composing the core metal of the external heat roller had a Young modulus of 21000 (kgf/mm$^2$)

TABLE 8

| Core material of roller | Carbon Steel | Carbon Steel | Carbon Steel | Carbon Steel | Carbon Steel |
|---|---|---|---|---|---|
| Diameter of roller (mm) | 9.7 | 14.2 | 18.8 | 23.4 | 32.5 |
| Thickness of Roller (mm) | 1.16 | 0.73 | 0.54 | 0.43 | 0.31 |
| Thermal capacity of roller (j/° C.) | 34.4 | 34.4 | 34.4 | 34.4 | 34.4 |
| Load (N) | 15.2 | 37.7 | 69.1 | 108.8 | 215.6 |
| Roller Maximum warpage (mm) | 0.10 | 0.10 | 0.10 | 0.10 | 0.10 |
| Heating nip width (mm) | 0.5 | 1.0 | 1.5 | 2.0 | 3.0 |

Similarly to the external heat rollers made of an aluminum compound, using these five external heat rollers shown in Table 8, 40 A4 sheets in landscape orientation were passed through the fixer under the aforementioned sets of conditions 1 to 3 to examine the temperatures and power consumption by the external heat rollers during paper transit, which achieved sufficient fixing performance.

Figure 23:
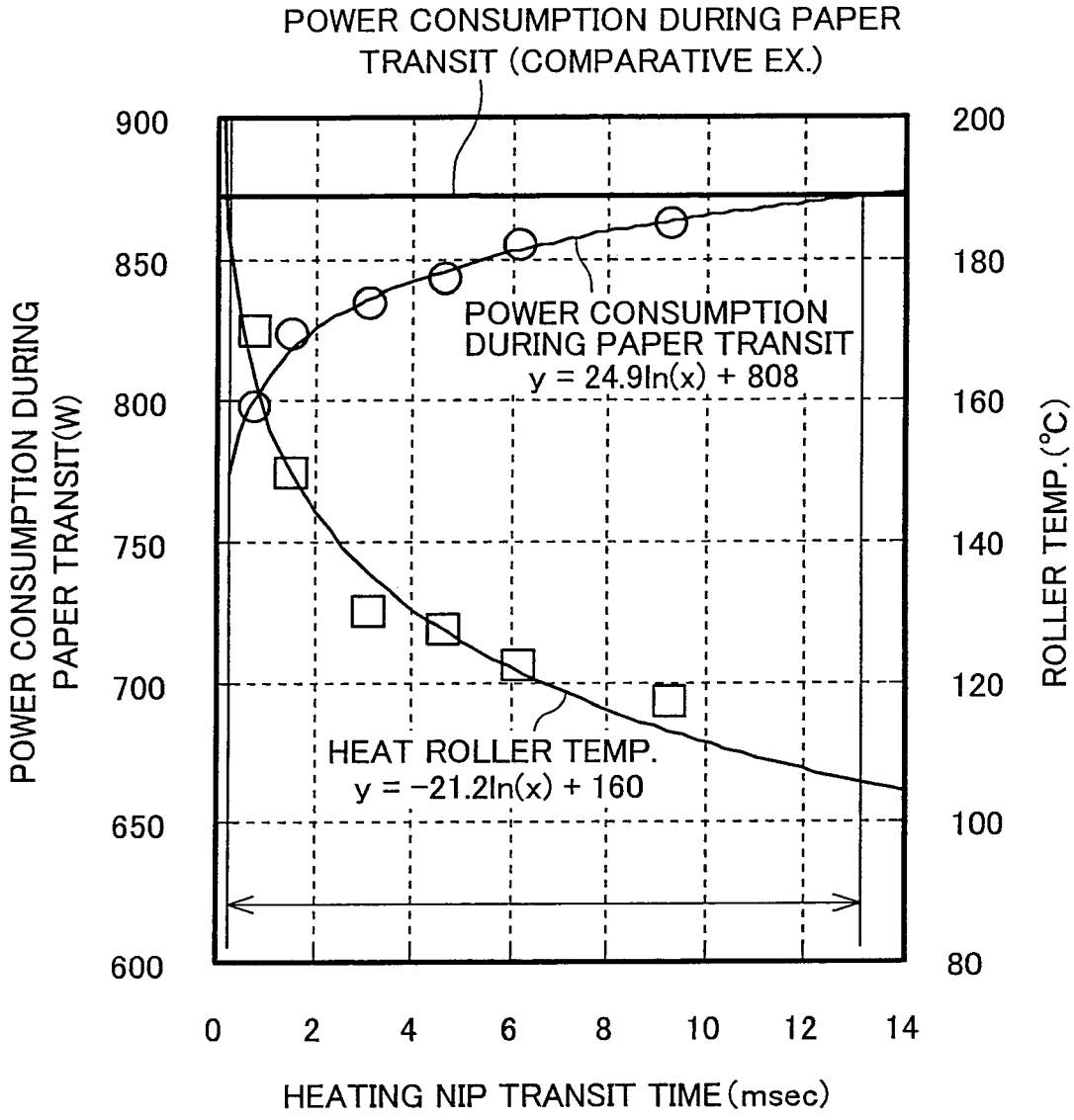
FIG. 23 is a graph showing relationships between an external heat roller temperature (roller temperature) (° C.), a power consumption (W) during paper transit, and a heating nip transit time (ms) when the external heat roller is made of carbon steel, and the fixing rate is 325 mm/sec.

Relationships between the external heat roller temperature (roller temperature) (° C.), the power consumption (W) during paper transit, and the heating nip transit time (ms) are shown which are results of the 40 sheets being passed. FIG. 23 shows the relationships under the set conditions 1, FIG. 24 under the set of conditions 2, and FIG. 25 under the set of conditions 3.

Figure 24:
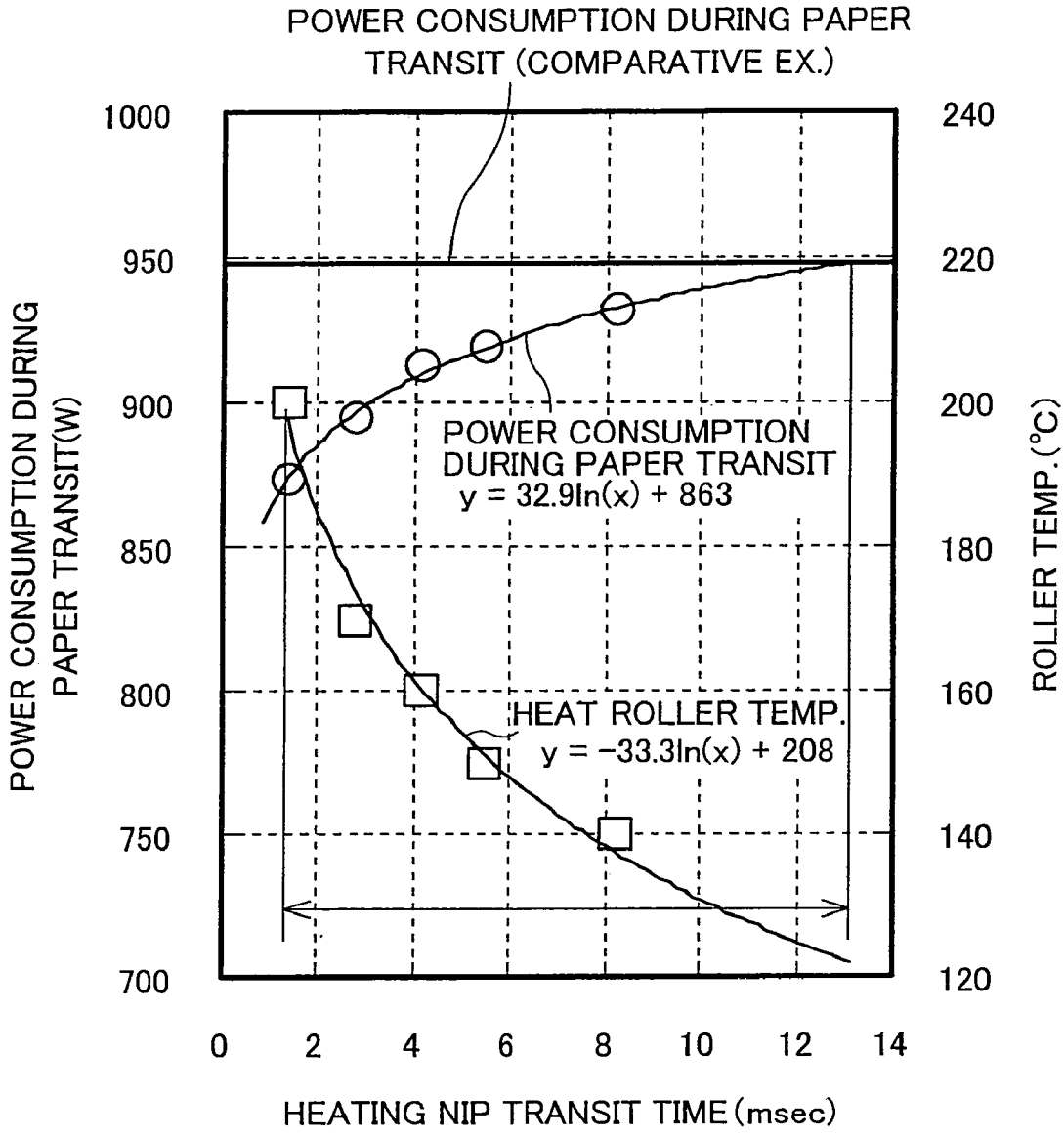
FIG. 24 is a graph showing relationships between an external heat roller temperature (roller temperature) (° C.), a power consumption (W) during paper transit, and a heating nip transit time (ms) when the external heat roller is made of carbon steel, and the fixing rate is 365 mm/sec.
Figure 25:
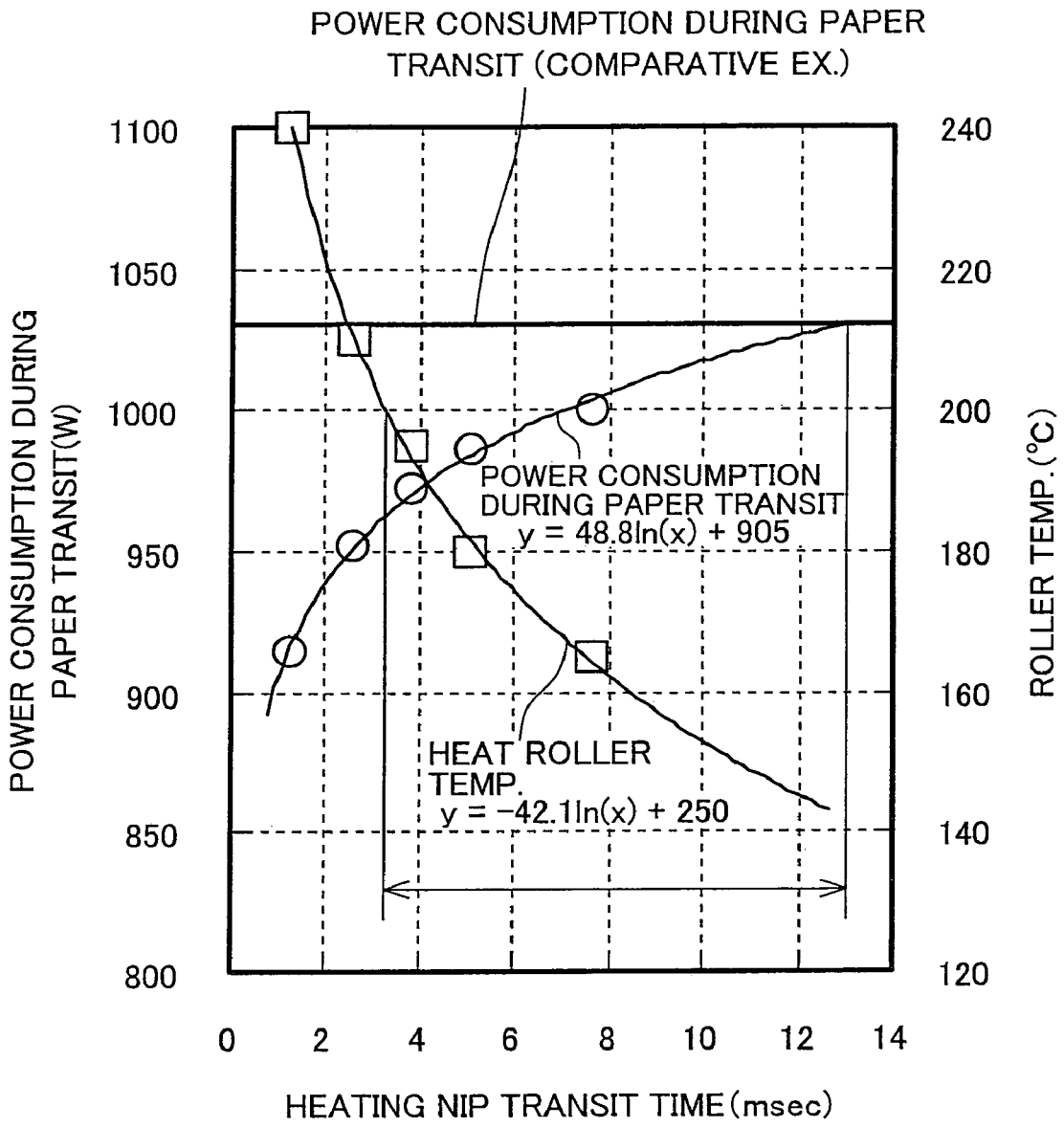
FIG. 25 is a graph showing relationships between an external heat roller temperature (roller temperature) (° C.), a power consumption (W) during paper transit, and a heating nip transit time (ms) when the external heat roller is made of carbon steel, and the fixing rate is 395 mm/sec.

In FIGS. 23 to 25, the relationship between the external heat roller temperature (roller temperature) (° C.) and the heating nip transit time (ms) is indicated by squares, whilst the relationship between the power consumption (W) during paper transit and the heating nip transit time (ms) is indicated by circles.

As shown in FIGS. 23 to 25, similarly to the external heat rollers made of an aluminum compound, a long heating nip transit time sufficiently fixes toner T even at low external heat roller temperatures, but results in an increased power consumption during paper transit.

Here, in FIGS. 23 to 25, the range of heating nip transit time meeting conditions (a), (b) is indicated by two arrows.

Table 9 shows the upper and lower limits of the range for the heating nip transit time meeting conditions (a), (b) at the paper transit speeds (fixing rates) shown in Table 6 as derived from FIGS. 23 to 25.

TABLE 9

| Paper | Optimal Nip Transit Time (ms) | |
|---|---|---|
| Transit Time | Maximum | Minimum |
| 60 | 0.12 | 13.06 |
| 65 | 1.27 | 13.04 |
| 70 | 3.26 | 13.07 |

Figure 26:
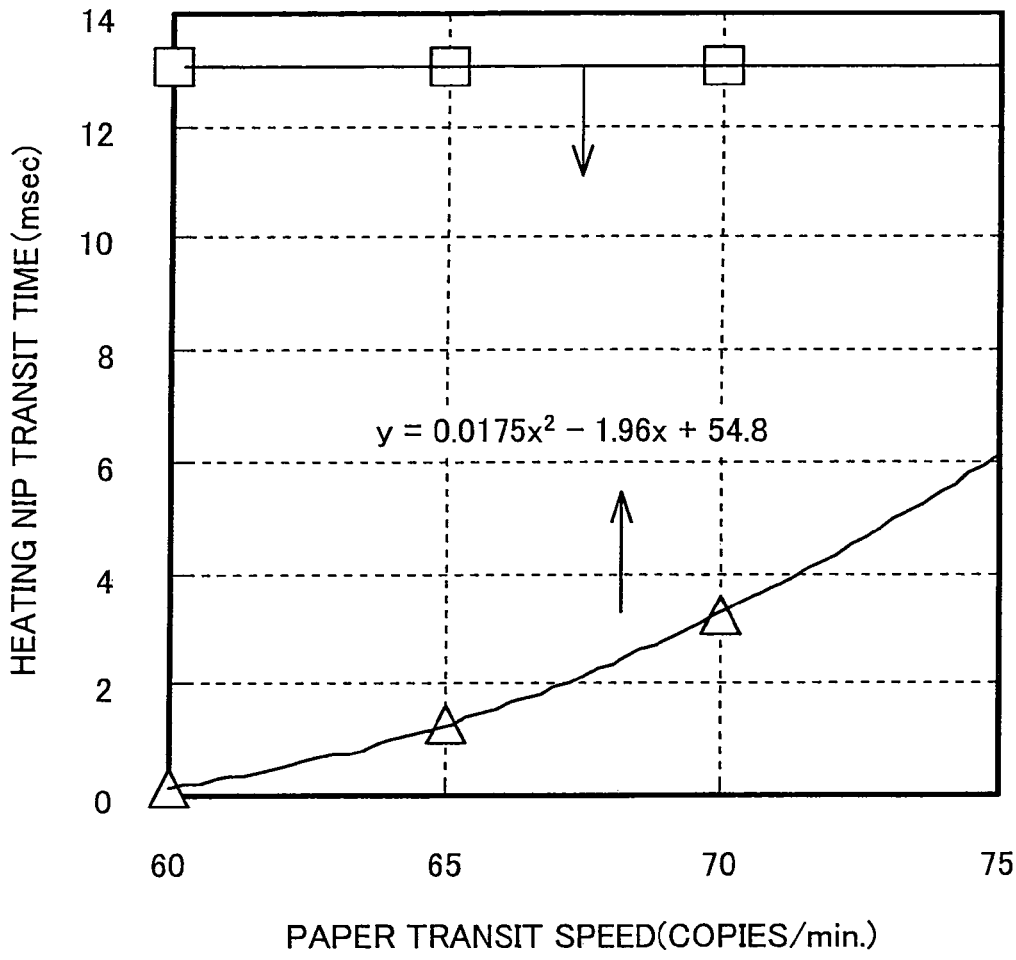
FIG. 26 is a relationship between a heating nip transit time (ms) and a recording paper transit speed (copies per minute) when the external heat roller is made of carbon steel, the power consumption during paper transit is less than or equal to that of the comparative example, and the surface temperature of an external heat roller is 200° C. or below.

FIG. 26 shows the relationship between the range of the heating nip transit time meeting conditions (a), (b) as derived from FIGS. 23 to 25 and the recording paper transit speed (paper transit speed). In FIG. 26, the x-axis indicates the paper transit speed (copies per minute), and the y-axis indicates the heating nip transit time (ms).

As shown in the figure, approximating, by the least squares method, the relationship between the paper transit speed P (copies per minute) and the lower limit value t1 of the heating nip transit time, we obtain $t1=0.0175P^2-1.96P+54.8$.

The upper limit value t2 of the heating nip transit time is substantially constant at 13.10 or less without regard to the paper transit speed P (copies per minute).

Therefore, the relationship between the heating nip transit time t (ms) and the paper transit speed P (copies per minute) is preferably given by equation (5):

$$0.0175P^2-1.96P+54.8 \leqq t \leqq 13.10 \quad (5)$$

Figure 27:
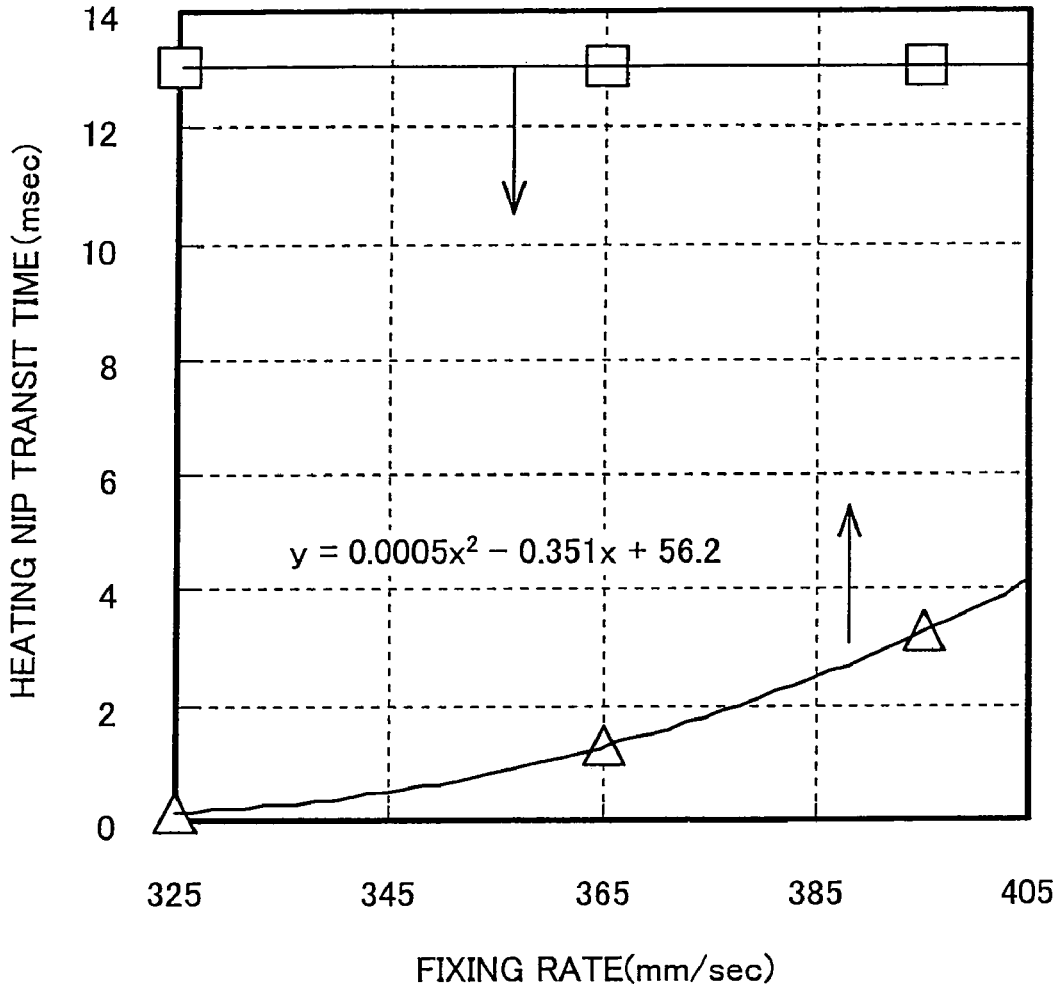
FIG. 27 is a graph showing a relationship between a heating nip transit time (ms) and a fixing rate (mm/sec.) when the external heat roller is made of carbon steel, the power consumption during paper transit is less than or equal to that of the comparative example, and the surface temperature of an external heat roller is 200° C. or below.

Further, FIG. 27 shows the relationship between the range of the heating nip transit time meeting conditions (a), (b) as derived from FIGS. 23 to 25 and the fixing rate. In FIG. 27, the x-axis indicates the fixing rate (ms), and the y-axis indicates the heating nip transit time (ms).

As shown in the figure, approximating by the least squares method, the relationship between the fixing rate V (mm/sec.) and the lower limit value t1 of the heating nip transit time, we obtain $t1=0.0005V^2-0.351V+56.2$.

As mentioned earlier, the upper limit value t2 of the heating nip transit time is substantially constant at 13.10 or less without regard to the fixing rate V (mm/sec.).

Therefore, the relationship between the heating nip transit time t (ms) and the paper transit speed V (mm/sec.) is preferably given by equation (6):

$$0.0005V^2-0.351V+56.2 \leqq t \leqq 13.10 \quad (6)$$

As in the foregoing, the fixer 23 is arranged to meet equation (5) or (6) in the case of a carbon steel external heat roller 233 (core metal 233*a*). When this is the case, the external heat roller 233 has a thermal capacity of 34.4 J/° C.

Thus, the heating nip transit time can be determined in accordance with the material and thermal capacity of the external heat roller 233 so that, for example, the heater's power consumption during the transit of the recording paper P is smaller than in the comparative example with no external heat roller 233 or the surface temperature of the external heat roller during the transit of the recording paper P does not exceed a predetermined temperature (for example, heat resistance temperature (here, 200° C.)).

Therefore, power consumption can be lowered although the external heat roller 233 is included.

The external heat roller 233 may be made of any given material, but preferably of carbon steel or stainless steel with a high Young modulus. These materials improve the mechanical strength of the external heat roller 233.

The foregoing description took the fixer (heater) 23 as an example of a device including the rollers 231, 232, 233. The embodiment is not limited to this, and may be preferably applied to, for example, a dryer device in the wet electrophotographic image forming apparatus, a dryer device in the inkjet printer, and an eraser device for the rewriteable medium.

[Embodiment 4]

Referring to FIGS. 1, 7, the following will describe another embodiment of the present invention. Here, for convenience, members of the present embodiment that have the same function as members of embodiment 1, and that are mentioned in that embodiment are indicated by the same reference numerals and description thereof is omitted.

Figure 28:
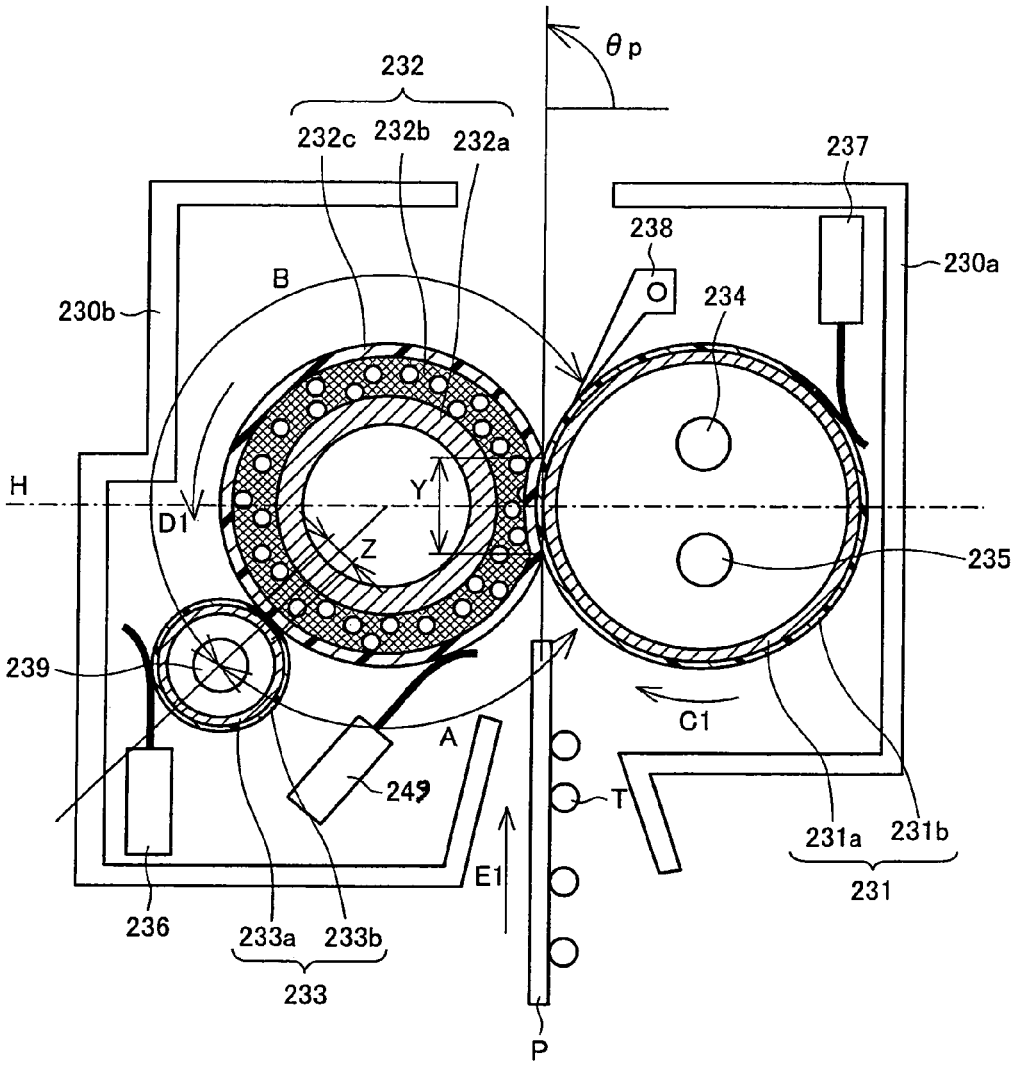
FIG. 28 is a drawing showing a structure of a major part of a fixer in accordance with a further embodiment of the present invention.

FIG. 28 shows the structure of a major part of the fixer (heater) 23 in accordance with the present embodiment. As shown in the figure, the fixer 23 includes in covers 230*a*, 230*b* a heat roller (first heating member) 231, a pressure roller (second heating member) 232, and an external heat roller 233.

The following will describe an example of the fixer 23 applied to an electrophotographic copying machine. The fixer 23 fixes toner T to recording paper P by applying heat and pressure the recording paper P carrying an image formed by unfixed toner T.

As shown in FIG. 28, the heat roller 231 is rotatable in the direction indicated by arrow C1 in the figure. The roller 231 is provided to heat the recording paper P while transiting a fix nip section Y where the heat roller 231 and the pressure roller 232 (detailed later) touch the recording paper P to fix the toner T onto the recording paper P. See a later description for details about the section. The heat roller 231 is made up of a cylindrical core metal 231*a* and a releasing layer 231*b*.

The pressure roller 232 is rotatable in the direction indicated by arrow D1 in the figure. The core metal 233*a* is an aluminum cylinder shaft measuring 15 mm in diameter and 1.0 mm in thickness.

Now, the fixer 23 will be described in terms of its operation. Still referring to FIG. 28, the recording paper P carrying an image formed by unfixed toner T is transported in the direction indicated by arrow E1 in the figure. The recording paper P is heated by the external heat roller 233 heated to a predetermined temperature and the heat roller 231 heated to 200° C. by the heater lamps 234, 235. The paper P is then passed between the heat roller 231 and the pressure roller 232 which is being pressed by the roller 231, that is, through the fix nip section Y.

While passing through the section Y, the unfixed toner T melts and firmly adheres onto the recording paper P under heat and pressure from the rollers 231, 232. Hence, the fixer 23 arranged as above is capable of fixing the toner T onto the recording paper P passing between the rollers 231, 232.

A typical copying machine operates in copy mode, warm-up mode, standby mode, etc.

warm-up mode is the mode in which the copying machine operates immediately after its power supply is turned on. In that mode, the copying machine first feeds current to the heater lamps 234, 235 to heat up the heat roller 231 to a predetermined temperature (here, 200° C.). As the heat roller 231 reaches the predetermined temperature, the machine turns on the drive motor, driving the rollers 231, 232, 233 to rotate at a peripheral speed (fixing rate) of 365 mm/sec. and simultaneously with the driving, feeds electric current to the heater lamp 239. The external heat roller 233 is continuously heated until it reaches a predetermined temperature (here, 190° C. (at which time the pressure roller 232 reaches 150° C.)).

In copy mode, the copying machine forms an image on the recording paper P moving at a predetermined speed. It is in this mode that the fixer 23 fixes toner onto the recording paper P. In copy mode, the electric current feeds to the heater lamps 234, 235, 239 are controlled so as to maintain the heat roller 231 and the pressure roller 232 at predetermined temperatures (here, for example, 200° C. and 136° C. respectively).

Specifically, the heater lamp 239 in the external heat roller 233 is so controlled as to maintain the external heat roller 233 at a temperature (170° C.) required to maintain the surface temperature of the pressure roller 232 at a predetermined temperature (136° C.).

In copy mode, if the recording paper P is A4 in landscape orientation, 65 sheets per minute of the recording paper P are fed to the fix nip section Y. Under these conditions, the nip transit time (time taken for any given point on the recording paper P to pass through the fix nip section Y) is 19.2 milliseconds.

In standby mode, electric consumption is maintained at such a level that the copying machine can enter copy mode immediately in response to a print request. After copying is finished, the copying machine is in standby mode for some time before entering low power mode.

The thermal energy dissipated in the form of radiation from the fixer 23 varies depending on the place of the fixer 23, the transport direction of the recording paper P, and the positional relationship between the pressure roller 232 and the external heat roller 233.

The following will examine the layout in the fixer 23, the transport direction of the recording paper P, and the positional relationship between the pressure roller 232 and the external heat roller 233 so as to reduce the thermal energy dissipated in the form of radiation (radiation energy) from the fixer 23.

The fixer 23 is placed so that the recording paper P is transported vertically upward in the fixer 23 (the paper transit direction is the direction indicated by arrow E1 in the figure) (arrangement (V).

In comparative example (IV), arrangement (VI), and arrangement (VII), all as comparative examples, the fixer differs from arrangement (V) in accordance with the present embodiment in the layout in the fixer, the transport direction of the recording paper P, and the positional relationship between the pressure roller 232 and the external heat roller 233. Comparative example (IV) and arrangements (VI), (VII) were compared to arrangement (V) regarding radiation energy.

Table 10 shows the arrangement (paper transit direction, positional relationship (contact position of the external heat roller 233) between the external heat roller 233 and the pressure roller 232, orientation, area Sa, and temperature of region A, and orientation, area Sb, and temperature of region B) of comparative example (IV) and arrangements (V) to (VII). The "temperature" of regions A, B refers to the mean temperature in the regions.

TABLE 10

| | Comp. Ex. (IV) | Arrangement (VI) | Arrangement (VII) | Arrangement (VIII) |
|---|---|---|---|---|
| Paper Transit Direction (Angle) | Horizontal (0°) | Vertically Up (90°) | Vertically Down (270°) | Vertically Up (90°) |

TABLE 10-continued

| | Comp. Ex. (IV) | Arrangement (VI) | Arrangement (VII) | Arrangement (VIII) |
|---|---|---|---|---|
| Contact Position of External Heat Roller (Angle) | Under Pressure Roller (315°) | On Pressure Roller (135°) | On Pressure Roller (135°) | Under Pressure Roller (225°) |
| Orientation of Region A | | Down | Up | Up |
| Area Sa of Region A ($mm^2$) | 1.40E+04 | 2.34E+04 | 1.40E+04 | 1.40E+04 |
| Temp. of Region A (° C.) | 136 | 136 | 136 | 136 |
| Orientation of Region B | Down | Up | Down | Up |
| Area Sb of Region B ($mm^2$) | 2.34E+04 | 1.40E+04 | 2.34E+04 | 2.34E+04 |
| Temp. of Region B (° C.) | 119 | 119 | 119 | 119 |
| Radiation Energy from Fixer (W) | 259 | 251 | 256 | 238 |

Note:
Comp. Ex. < Comparative Example

As viewed in a cross section, showing the external heat roller 233, vertical to the center of rotation (rotation axis) of the pressure roller 232, region B (second region) is a part of the surface of the pressure roller 232 stretching from the recording-paper-P-ejecting end of the fix nip section Y to the heating position of the external heat roller 233 in the rotational direction of the pressure roller 232. Similarly, region A (first region) is another part of the surface of the pressure roller 232 stretching from the heating position of the external heat roller 233 to the recording-paper-P-loading end of the fix nip section Y.

The angles (θp) in the description below is measured counterclockwise off a line (dash-dot line H in the figure (facing the right hand side)) vertical to a normal to the plane on which is installed the copying machine incorporating the fixer 23 (substantially parallel to the ground), the line H present on a plane parallel to that plane. For example, as shown in FIG. 28, in arrangement (V), the paper transit direction is vertical upward (its angle is 90°), and the external heat roller 233 is positioned at 225° on the pressure roller 232. In other words, the line linking the center of the pressure roller 232 to the center of the external heat roller 233 is 225° off line H, with the external heat roller 233 disposed lower than the pressure roller 232 in terms of the rollers' centers.

As shown in FIG. 28, region A is located lower than region B in arrangement (V) in terms of the widthwise center lines of regions A, B. In other words, as shown in Table 10, region A faces downward, and region B upward.

The area Sa of region A is $1.40\times10^4$ ($mm^2$), whilst the area Sb of region B is $2.34\times10^4$ ($mm^2$). The temperature of region A is 136° C., whilst the temperature of region B is 119° C.

In arrangement (V), the radiation energy from the fixer is 238 W.

Figure 30:
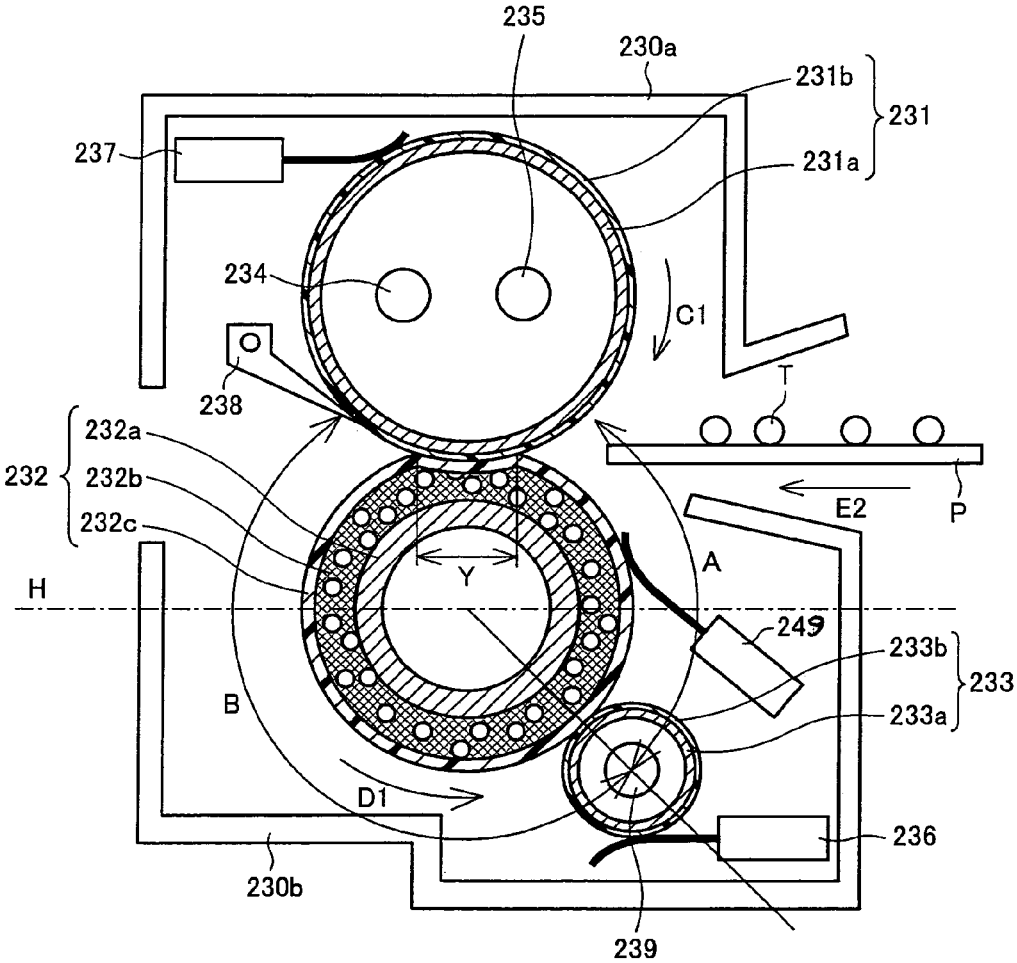
FIG. 30 is a drawing showing a structure of a fixer (comparative example (I) in which paper is passed in a horizontal direction.

As shown in Table 10 and FIG. 30, comparative example (IV) differs from arrangement (V) in that the fixer is rotated 90° counterclockwise. That is, in comparative example (IV), the paper transit direction is horizontal (in the direction indicated by E2 in FIG. 30; the angle is 0°), and the external heat roller 233 is positioned at 315° on the pressure roller 232 (lower than the pressure roller 232).

In comparative example (IV), the area Sa of region A, the area Sb of region B, the temperature of region A, and the temperature of region B are identical to those in arrangement (V). In comparative example (IV), the radiation energy from the fixer is 259 W.

Setting the paper transit direction to the vertical upward direction as in arrangement (V) as discussed in the foregoing improves heat efficiency by reducing radiation energy by about 9.1% compared to setting the paper transit direction to the horizontal direction as in comparative example (IV).

This is because of reduction in heat dissipation by convection from region A. Where the temperature of region A is Tpa, and the temperature of region B is Tpb, Tpa>Tpb holds because region B is yet to be heated by the external heat roller 233, and region A has been already heated by the external heat roller 233. Therefore, region A is likely to lose heat to the air by radiation compared to region B. In addition, in the case of arrangement (V), region A faces downward, resulting in less heat dissipation from region A by convection. The total heat dissipation from the pressure roller 232 is therefore less than in comparative example (IV).

In arrangement (V), the recording paper P is moved (transported) in a substantially vertical direction. This makes a part of the surface of the heat roller 231 face downward. The downward region (part) dissipates less heat by convection. Still in the case of arrangement (V), part of the air heated by the heat roller 231 flows toward the pressure roller 232, heating the pressure roller 232. This improves the heat efficiency of the fixer.

Still in the case of arrangement (V), the paper transit direction of the recording paper P is substantially vertical. The space in the fixer 23 is therefore divided into an upper half (hereinafter, "upper space") and a lower half (hereinafter, "lower space") by the heat roller 231 and the pressure roller 232. Since region A of the surface of the pressure roller 232 and the external heat roller 233 are in the lower space, the air in the lower space is heated to a higher temperature than the air in the upper space. The air heated to this higher temperature hardly flows out of the fixer 23 and remains inside the lower space, improving the heat efficiency of the fixer 23.

Now, referring to FIG. 31 and Table 10, arrangement (VI) will be described as an example where the external heat roller 233 is in a different position from arrangement (V).

Figure 31:
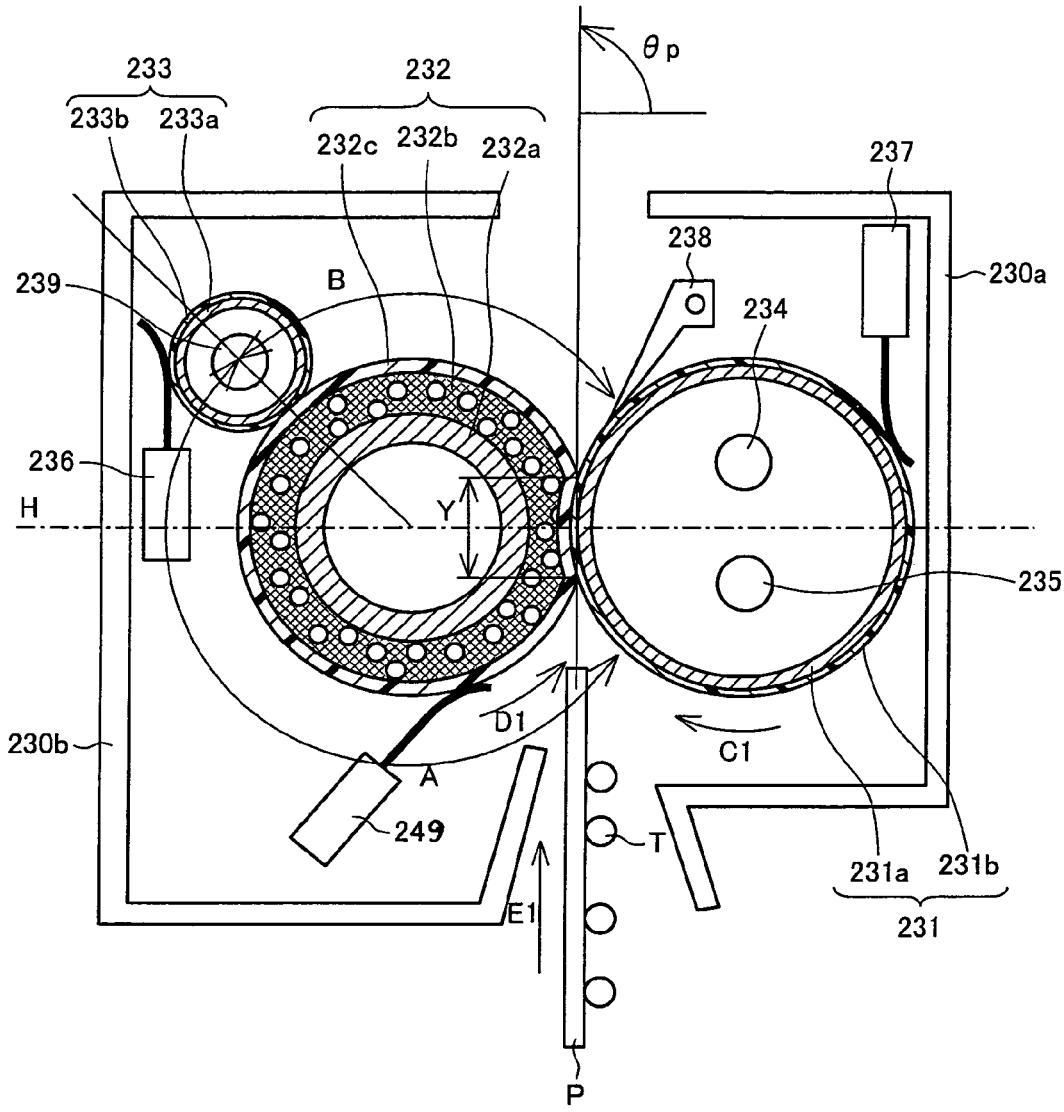
FIG. 31 is a drawing showing a structure when the external heat roller is positioned to form a 135° angle with a pressure roller.

As shown in FIG. 31, in arrangement (VI), the external heat roller 233 is positioned at 135° on the pressure roller 232 (higher than the pressure roller 232).

Again in arrangement (VI), the area Sa of region A is $2.34\times10^4$ ($mm^2$), and the area Sb of region B is $1.40\times10^4$ ($mm^2$). The temperature of region A is 136° C., and the temperature of region B is 119° C. In the case of arrangement (VI), the radiation energy from the fixer 23 is 251 W.

Similarly to arrangement (V), the paper transit direction in arrangement (VI) is vertical; therefore, the radiation energy is smaller than in comparative example (IV).

Arrangement (V) improves heat efficiency by reducing radiation energy by about 5.2% compared to arrangement (VI).

This is because region A in arrangement (V) is smaller in terms of area, and hence dissipates less heat by convection, than region A in arrangement (VI).

Another reason is that the external heat roller 233 is present in the lower space in arrangement (V), which makes it difficult for the air heated by the external heat roller 233 to flow out of the fixer 23.

Figure 32:
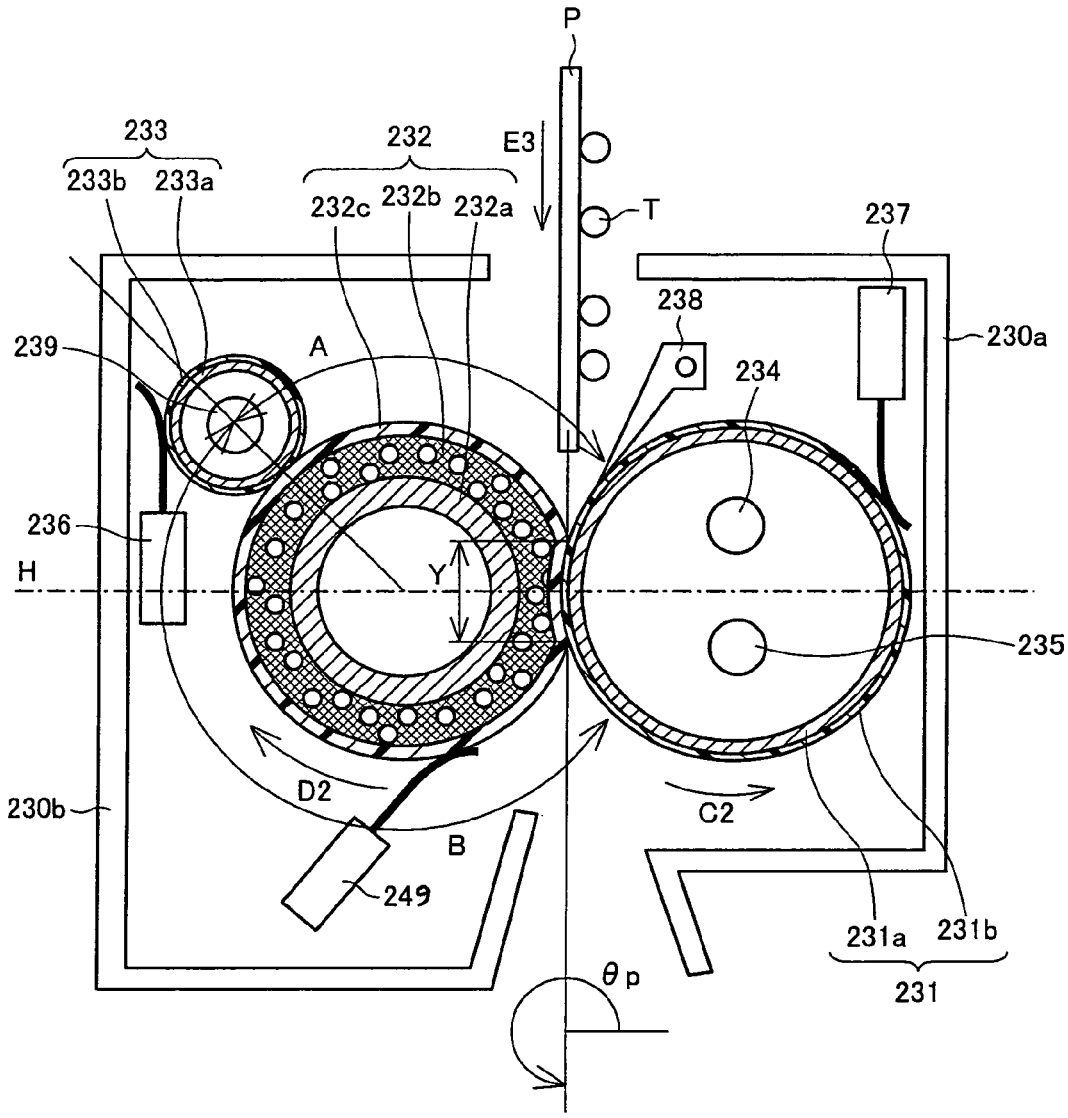
FIG. 32 is a drawing showing a structure in which paper is passed in an opposite direction to the case in FIG. 31.

Referring to FIG. 32 and Table 10, arrangement (VII) will be described as an example where the paper transit direction for the recording paper P differs from that in arrangement (VI).

As shown in FIG. 32, the paper transit direction in arrangement (VII) is vertically downward (in the direction indicated by arrow E3 in the figure; the angle is 270°). This is different from arrangements (V), (VI). Therefore, region A is located higher than region B. This is different from arrangements (V), (VI).

In arrangement (VII), the area Sa of region A is $1.40\times10^4$ ($mm^2$), and the area Sb of region B is $2.34\times10^4$ ($mm^2$). The temperature of region A is 136° C., and the temperature of region B is 119° C. In the case of arrangement (VII), the radiation energy from the fixer 23 is 256 W.

Similarly to arrangement (V), the paper transit direction in arrangement (VII) is again vertical; therefore, the radiation energy is smaller than in comparative example (IV).

Arrangement (V) improves heat efficiency by reducing the radiation energy by about 7.0% compared to arrangement (VII).

This is because region A in arrangement (VII) faces upward and dissipates more heat by convection than region A in arrangement (V). The total heat dissipation from the pressure roller 232 is therefore more than in arrangement (V).

Another reason is that in arrangement (VII) the paper transit direction is upward; therefore, the heat roller 231 and the pressure roller 232 rotate upward where they face the cover 230*a* and the cover 230*b* respectively, exerting such a force to generate an upward flow of air in their vicinity.

This helps the air in the lower space heated by the heat roller 231, pressure roller 232, and external heat roller 233 move into the upper space and flow out of the fixer 23 through, for example, a paper ejection opening on the fixer 23. On the other hand, if the paper transit direction is upward as in arrangement (V), the heat roller 231 and the pressure roller 232 rotate downward where they face the cover 230*a* and the cover 230*b* respectively, exerting such a force to generate an downward flow of air in their vicinity. This helps the air in the lower space heated by the heat roller 231, pressure roller 232, and external heat roller 233 remain in the lower space.

As detailed in the foregoing, the arrangement where the paper transit direction is vertically upward and the external heat roller 233 is provided such that region A faces downward and is greater than region B (arrangement (V)) achieves the greatest reduction in radiation energy. Somewhat less significant, nevertheless similarly meaningful, reduction in radiation energy is achieved by arranging one of the paper transit direction, the placement (region A, B) of the external heat roller 233, etc. similarly to arrangement (V) (arrangements (VI), (VII)).

A cleaning roller 240 may be provided near the surface of the pressure roller 232. An arrangement incorporating such a cleaning roller 240 will be now described.

The following will examine the relationship between the radiation energy from the fixer 23 and the placement of the cleaning roller 240.

The cleaning roller 240 is supported at its axis so that it is rotated by the rotation of the pressure roller 232. The cleaning roller 240 is a core material made of aluminum or a like metal and has a cylindrical shape. Here, the cleaning roller 240 is made of stainless steel.

Arrangement (VIII) is identical to aforementioned arrangement (V), except the cleaning roller 240 provided upstream to the external heat roller 233. In arrangement (VIII), the cleaning roller 240 is positioned at 135° on the pressure roller 232.

Figure 29:
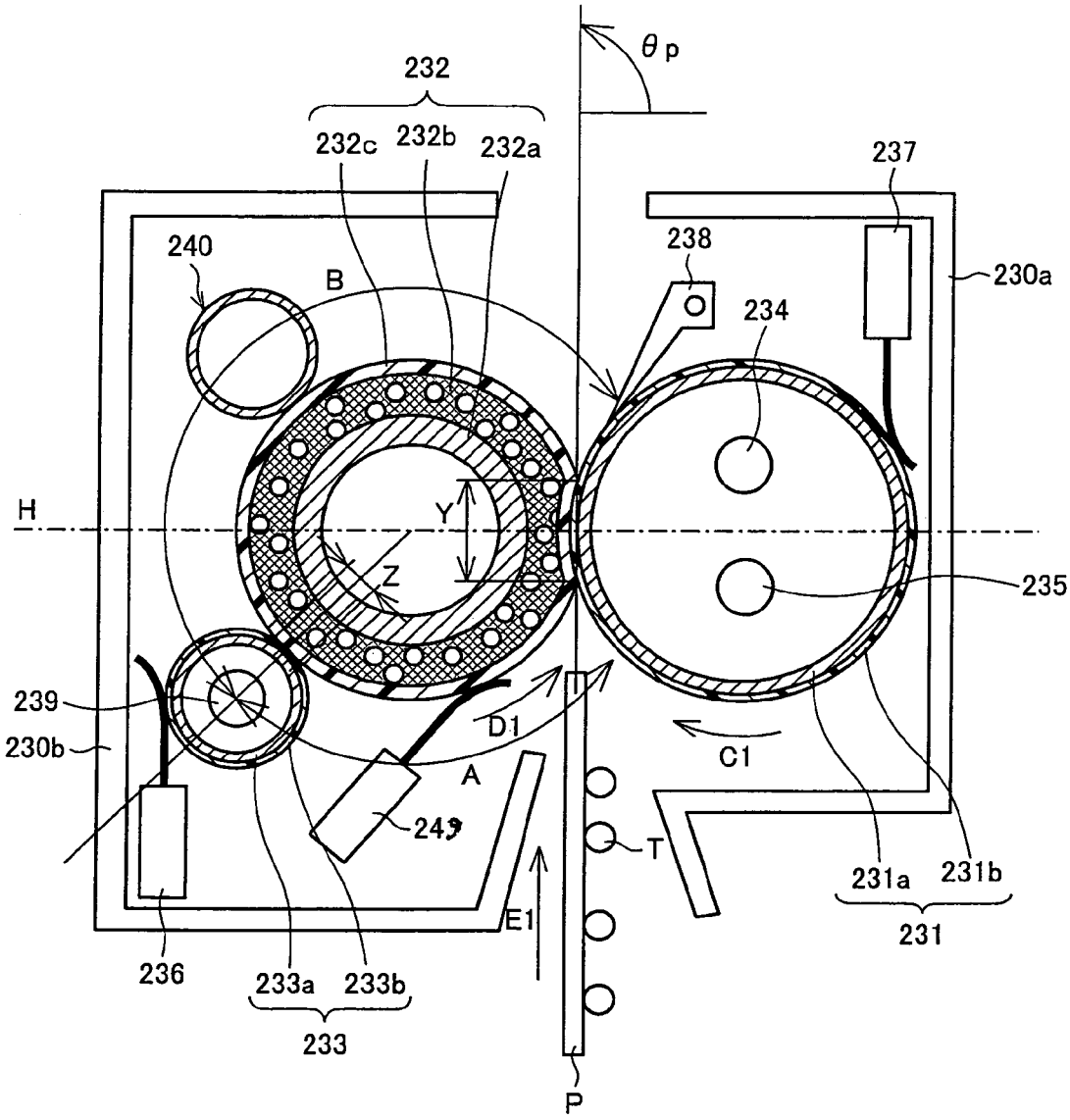
FIG. 29 is a drawing showing a structure of the fixer in FIG. 28 incorporating a cleaning roller.

In comparative examples (V), (VI), the position of the cleaning roller 240 differs from arrangement (VIII). Comparative examples (V), (VI) were compared to arrangement (VIII) (FIG. 29) regarding radiation energy.

Table 11 shows the arrangement (paper transit direction, positional relationship (contact position of the external heat roller 233) between the external heat roller 233 and the pressure roller 232, orientation, area Sa, and temperature of region A, and orientation, area Sb, and temperature of region B), the position of the cleaning roller 240 (positional relationship with the external heat roller 233), and the radiation energy of comparative examples (V), (VI) and arrangement (VIII).

TABLE 11

| | Comp. Ex. (V) | Comp. Ex. (VI) | Arrangement (VIII) |
|---|---|---|---|
| Paper Transit Direction (Angle) | Vertically Up (90°) | Vertically Up (90°) | Vertically Up (90°) |
| Contact Position of External Heat Roller (Angle) | Under Pressure Roller (225°) | Under Pressure Roller (225°) | Under Pressure Roller (225°) |
| Orientation of Region A | Down | Down | Down |
| Area Sa of Region A ($mm^2$) | 1.40E+04 | 1.40E+04 | 1.40E+04 |
| Temp. of Region A (° C.) | 136 | 136 | 136 |
| Orientation of Region B | Down | Up | Up |
| Area Sb of Region B ($mm^2$) | 2.34E+04 | 2.34E+04 | 2.34E+04 |
| Temp. of Region B (° C.) | 119 | 119 | 119 |
| Contact Position of Cleaning Roller (Angle) | Upstream to External Heat Roller (90°) | Upstream to External Heat Roller (270°) | Upstream to External Heat Roller (135°) |
| Radiation Energy from Fixer (W) | 252 | 256 | 245 |

Note:
Comp. Ex. < Comparative Example

Figure 34:
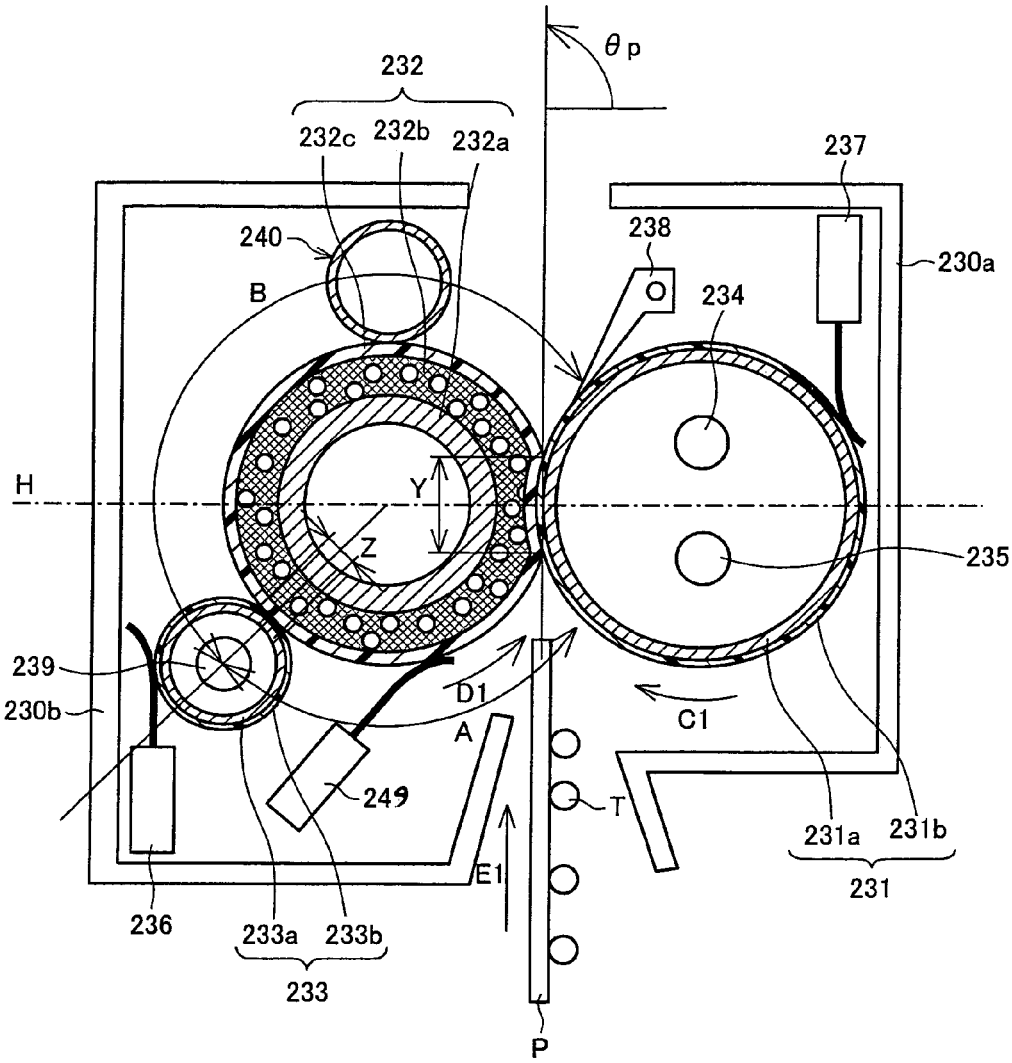
FIG. 34 is a drawing showing a structure of a fixer as another comparative example in which a cleaning roller is disposed at a different position from the one in FIG. 29.
Figure 35:
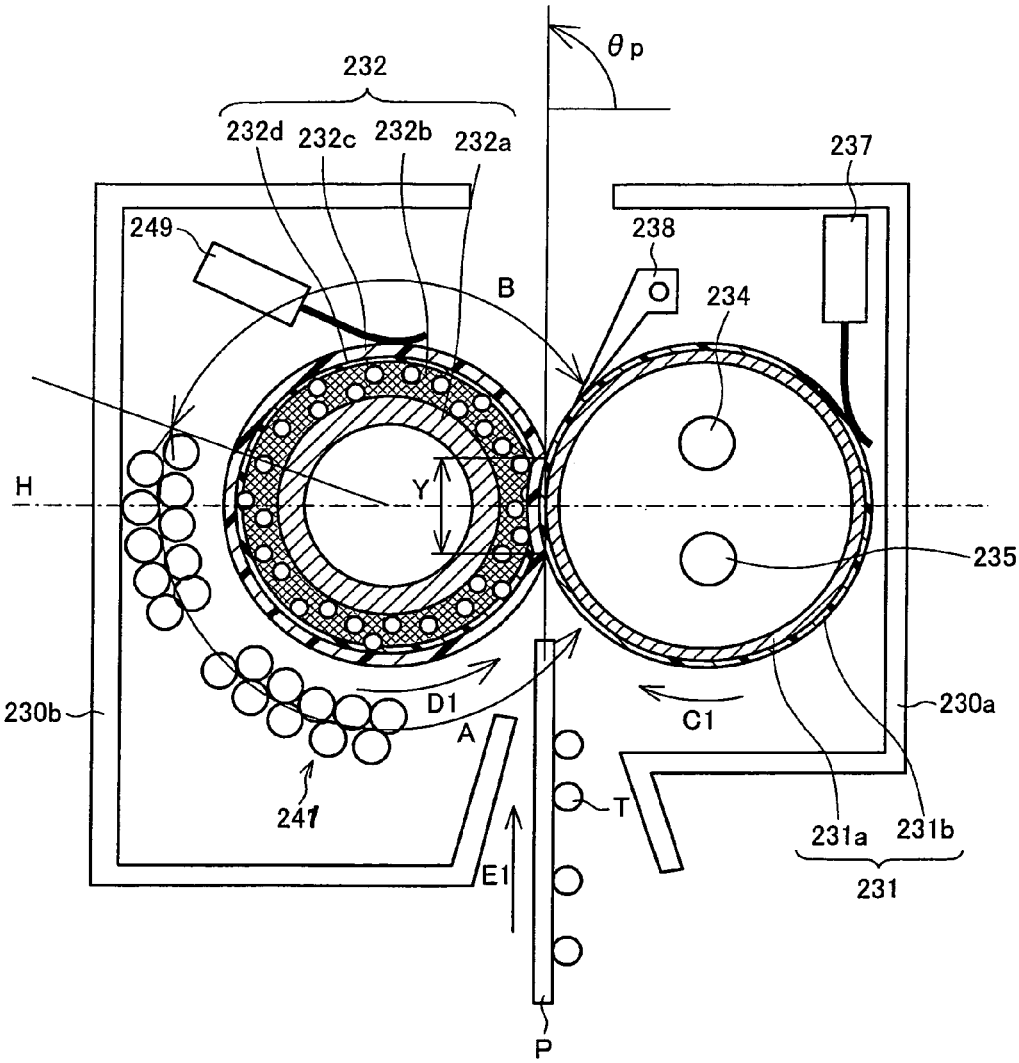
FIG. 35 is a drawing showing the structure of a major part of a fixer in accordance with yet another embodiment of the present invention.

As shown in Table 11 and FIG. 34, in comparative example (V), the cleaning roller 240 is positioned upstream to the external heat roller 233, at 90° on the pressure roller 232. The radiation energy in comparative example (V) is 252 W.

Figure 33:
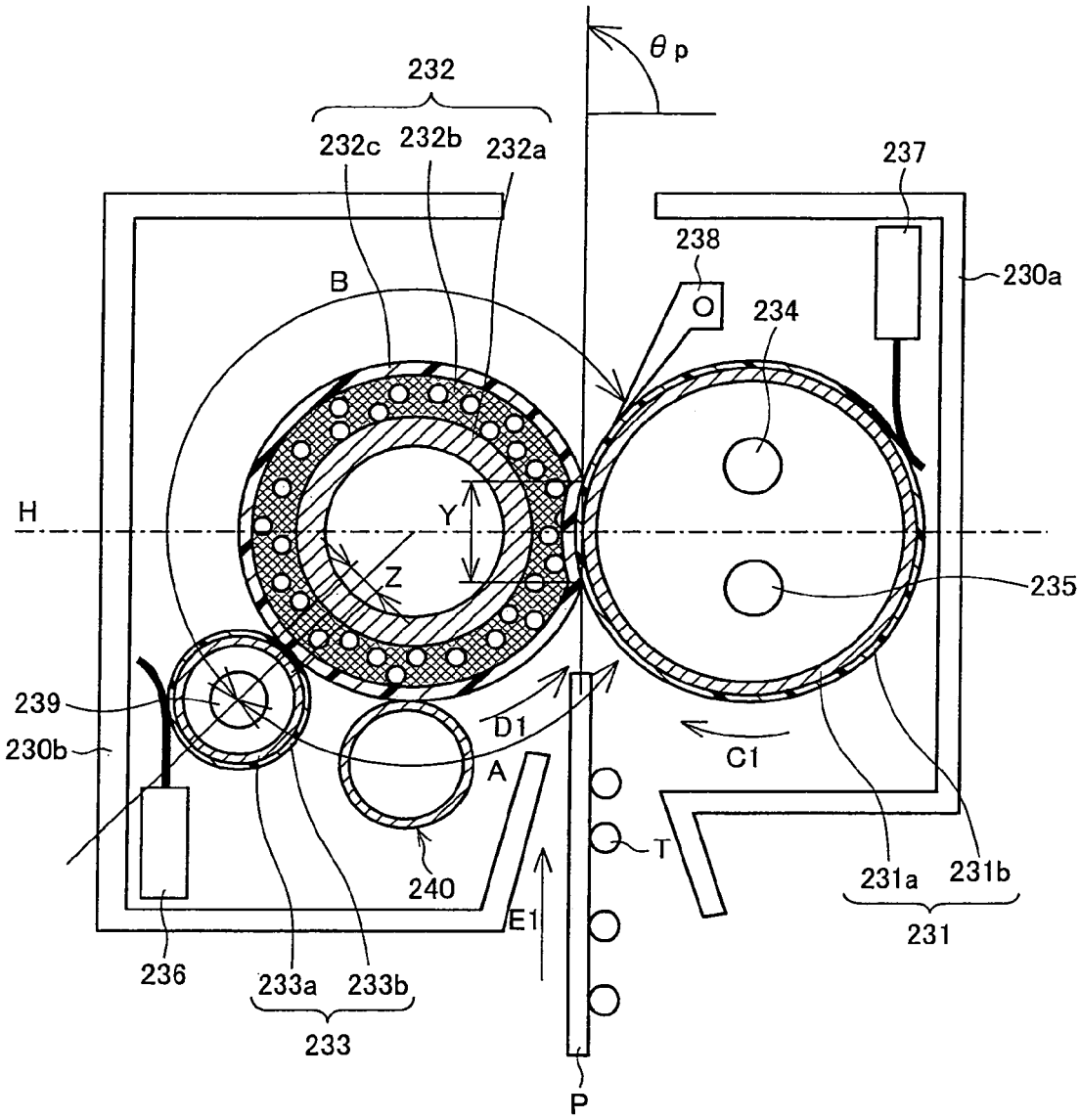
FIG. 33 is a drawing showing a structure of a fixer as a comparative example in which a cleaning roller is disposed at a different position from the one in FIG. 29.

As shown in FIG. 33, the cleaning roller 240 in comparative example (V) is positioned downstream to the external heat roller 233, at 270° on the pressure roller 232. The radiation energy in comparative example (VI) is 256 W.

The radiation energy in arrangement (VIII) is 245 W.

As discussed in the foregoing, arrangement (VIII) improves heat efficiency by reducing radiation energy by about 4.3% compared to comparative example (VI).

This is because the cleaning roller 240 is positioned above the external heat roller 233 in arrangement (VIII). This is different from comparative example (VI). The cleaning roller 240 in arrangement (VIII) is capable of preventing the air heated by the external heat roller 233 from flowing out of the fixer 23 through a paper ejection opening on the fixer 23.

When in contact with the pressure roller 232, the cleaning roller 240 in typical situations acts as a thermal load and adversely affects the external heat roller 233's function of heating the pressure roller 232. Comparative example (VI) is susceptible to the negative effects of the cleaning roller 240 positioned downstream to the external heat roller 233. Arrangement (VIII), however, is less affected by the cleaning roller 240 acting as a thermal load, because the air heated by the external heat roller 233 (thermal radiation) heats the cleaning roller 240 in advance.

Arrangement (VIII) improves heat efficiency by reducing the radiation energy by about 2.8% compared to comparative example (V).

In comparative example (V), as seen from the external heat roller 233, the entire cleaning roller 240 is hidden behind the pressure roller 232. The thermal radiation from the external heat roller 233 does not reach the cleaning roller 240. In contrast, in arrangement (VIII), the external heat roller 233 and the cleaning roller 240 are disposed almost to face each other, so as not to be obstructed by the pressure roller 232. In other words, the external heat roller 233 and the cleaning roller 240 are positioned to face each other around the pressure roller 232.

Therefore, in arrangement (VIII), the cleaning roller 240 absorbs part of the thermal radiation from the external heat roller 233, reducing the heat loss from the external heat roller 233.

The arrangement (for example, material, dimensions, shape, etc.) of the heat roller 231, pressure roller 232, external heat roller 233, and cleaning roller 240 is by no means limited to the aforementioned arrangement in any special manner.

The foregoing description took the fixer (heater) 23 as an example of a device including the rollers 231, 232, 233. The embodiment is not limited to this, and may be preferably applied to, for example, a dryer device in the wet electrophotographic image forming apparatus, a dryer device in the inkjet printer, and an eraser device for the rewriteable medium.

[Embodiment 5]

Referring to FIGS. 1, 7, the following will describe another embodiment of the present invention. Here, for convenience, members of the present embodiment that have the same function as members of embodiment 2, and that are mentioned in that embodiment are indicated by the same reference numerals and description thereof is omitted.

As shown in FIG. 28, a fixer in accordance with the present embodiment measures 40 mm in diameter and is made up of a core metal 232*a* and a heat resistant elastic layer 232*b* formed on the metal 232*a*. The core metal 232*a* is aluminum, iron, stainless steel, or a like metal. The heat resistant elastic layer. 232*b* is made of a 6-mm thick silicone rubber foam.

Table 12 shows comparison in the radiation energy from the fixer 23 between arrangement (IX) and arrangement (V). Arrangement (IX) employs an induction heating coil 241 (induction heating method) as heating means for the pressure roller 232. Arrangement (V) employs the aforementioned external heat roller 233 (heat roller method) in embodiment 1 (see FIG. 28).

TABLE 12

| | Arrangement (V) | Arrangement (IX) |
|---|---|---|
| Paper Transit Direction (Angle) | Vertically Up (90°) | Vertically Up (90°) |
| External Heating Means | External Heat Roller | Induction Heating Coil |
| Orientation of Region A | Down | Down |
| Area Sa of Region A ($mm^2$) | 1.40E+04 | 2.08E+04 |
| Temp. of Region A (° C.) | 136 | 136 |

TABLE 12-continued

| | Arrangement (V) | Arrangement (IX) |
|---|---|---|
| Orientation of Region B | Up | Up |
| Area Sb of Region B ($mm^2$) | 2.34E+04 | 1.66E+04 |
| Temp. of Region B (° C.) | 119 | 119 |
| Contact Position of Cleaning Roller (Angle) | Upstream to External Heat Roller (90°) | Upstream to External Heat Roller (135°) |
| Radiation Energy from Fixer (W) | 238 | 206 |

Note:
Comp. Ex. < Comparative Example

As shown in Table 12, the radiation energy in arrangement (V) is 238 W, whilst the radiation energy in arrangement (IX) is 206 W. Arrangement (IX) in accordance with the present embodiment improves heat efficiency by reducing the radiation energy by about 13.4% compared to arrangement (V).

This is because the heat roller method entails heat loss (about 47 W) from the surface of the external heat roller 233 through thermal radiation and convection, whereas the induction heating method allows the pressure roller 232 to directly heat up and causes the induction heating coil 241 itself to hardly heat up, let alone make heat loss.

Aforementioned embodiments 1, 2 assumed that the paper transit direction was preferably vertical. Needless to say, the paper transit direction does not need to be absolutely vertical, and may be substantially vertical (the recording paper P passes through the fix nip section Y between the heat roller 231 and the pressure roller 232 either upward or downward).

The invention being thus described, it will be obvious that the same way may be varied in many ways. Such variations are not to be regarded as a departure from the spirit and scope of the invention, and all such modifications as would be obvious to one skilled in the art are intended to be included within the technical scope of the present invention.

A heater in accordance with the present invention, as described in the foregoing, includes a first heating member and a second heating member pressing each other, heats a heated material by passing the heated material through a press region where the first heating member and the second heating member meet, and is arranged so that the heater includes an external heating member heating the second heating member from outside the second heating member, wherein: a transit time taken for any given point on the heated material to pass through the press region is less than or equal to $2.3\times10^{-2}$ sec.; and a surface temperature, T1 (° C.), of the first heating member and a surface temperature, T2 (° C.), of the second heating member satisfy $T1-T2\leqq100$ (° C.).

It is preferred if the heater is such that the surface temperature, T1, of the first heating member and the surface temperature, T2, of the second heating member satisfy $T1-T2\leqq70$ (° C.).

According to the arrangement, the surface temperature, T1 (° C.), of the first heating member and the surface temperature, T2 (° C.), of the second heating member satisfy either $T1-T2\leqq100$ (° C.) or $T1-T2\leqq70$ (° C.). This eliminates the need for an increase in surface pressure in the press region even in a high speed apparatus for which the transit time taken for any given point on the heated material to pass through the press region is less than or equal to $2.3\times10^{-2}$ sec. In other words, the arrangement allows for a smaller load being applied to the heating members.

This allows for construction of thinner and smaller thermal capacity heating members, and hence reduces the warm-up time of the heater. Therefore, pre-heating of the heating members becomes unnecessary. Power consumption in warm-up and standby is lowered.

The less load on the heating members, for example, prevents the heating members from creeping and extends the heating members' lifetime.

Further, the reduced thickness of the heating members allows for construction of a more compact heater. The reduced drive torque of the heating members allows for lower power consumption and extends lifetime of driver components.

It is preferred if the heater is such that the external heating member controls a difference between the surface temperature of the first heating member and the surface temperature of the second heating member.

Specifically, the heater preferably includes: temperature sensing means for sensing a surface temperature of the external heating member; and control means for controlling the surface temperature of the external heating member on the basis of a result of sensing by the temperature sensing means.

According to the arrangement, the external heating member heats the second heating member from outside the second heating member, thereby making it possible to readily control the surface temperature of the second heating member.

Thus, according to the arrangement, a simple structure enables the control of the difference between the surface temperature of the first heating member and the surface temperature of the second heating member.

It is preferred if the heater controls to maintain the surface temperature of the first heating member at a substantially constant value.

According to the arrangement, the surface temperature of the first heating member is maintained at a substantially constant value. The difference between the surface temperature of the first heating member and the surface temperature of the second heating member is therefore controlled by the external heating member based only on the surface temperature of the second heating member.

It is preferred if the heater is such that the surface temperature, T1 (° C.), of the first heating member and the surface temperature, T2 (° C.), of the second heating member satisfy $T1-T2\leqq30\times\ln(P)-72.5$ where P (kPa) is a surface pressure of the heated material in the press region.

The arrangement reduces T1−T2, which in turn increases the quantity of heat transferred to the heated material. This allows for a smaller load being applied to the heating members.

Another heater in accordance with the present invention, as described in the foregoing, includes a first heating member and a second heating member pressing each other, heats a heated material by passing the heated material through a press region where the first heating member and the second heating member meet, and is arranged so that: a transit time taken for any given point on the heated material to pass through the press region is less than or equal to $2.3\times10^{-2}$ sec.; and a quantity, Q1, of heat transferred from the first heating member to the heated material while the heated material is passing through the press region and a quantity, Q2, of heat transferred from the second heating member to the heated material while the heated material is passing through the press region satisfy $Q2/(Q1+Q2)\geqq0.25$.

It is preferred if the heater is such that the quantity Q1 and the quantity Q2 satisfy $Q2/(Q1+Q2)\geqq0.3$.

For example, when the material composing the second heating member has extremely poor heat conductivity, the second heating member in some cases transfers only an insufficient quantity of heat to the heated material, failing to provide sufficient heating, even if the surface of the second heating member is maintained at a high temperature.

However, the arrangement specifies the quantity of heat transferred to the heated material, not the temperature of the heating members. Regardless of from what material the heating members are made, similar effects are achieved to a case where the aforementioned surface temperature, T1, of the first heating member and surface temperature, T2, of the second heating member are determined to satisfy $T1-T2 \leqq 70$ (° C.).

In other words, the arrangement allows the load on the heating members to be reduced and enables lower power consumption.

It is preferred if the heater further includes: an external heating member heating the second heating member from outside the second heating member; and control means for controlling a ratio, $Q2/(Q1+Q2)$, of the quantity, Q2, of the heat transferred from the second heating member to the heated material and a total quantity, $Q1+Q2$, of heat transferred to the heated material by controlling a surface temperature of the external heating member.

According to the arrangement, the external heating member controls $Q2/(Q1+Q2)$. Therefore, according to the arrangement, the control of $Q2/(Q1+Q2)$ is enabled by a simple structure.

It is preferred if the heater is such that a ratio, $Q2/(Q1+Q2)$, of the quantity, Q2 (J), of the heat transferred from the second heating member to the heated material and a total quantity, $Q1+Q2$ (J), of heat transferred to the heated material satisfies $Q2/(Q1+Q2) \geqq -0.078 \times \ln(P)+0.7$ where P (kPa) is a surface pressure of the heated material in the press region.

The arrangement allows for an increased $Q2/(Q1+Q2)$ (In other words, the ratio of the quantity, Q2, of the heat transferred from the second heating member to the heated material) and a reduced required fixing load. This enables reduction in power consumption.

It is preferred if the heater is such that a surface pressure of the heated material in the press region is less than or equal to 300 (kPa).

The arrangement allows for load on the heating members and the heated material to be reduced.

It is preferred if the heater is such that the external heating member includes a heat source body and heats the second heating member by contacting a surface of the second heating member.

The arrangement enables direct heating of the surface of the second heating member, simplifying the structure of the external heating member. The simplified structure occupies less space. This facilitates the mounting of a cleaning roller and other components.

It is preferred if the heater is such that the external heating member is a roller rotating with the second heating member in contact with the second heating member.

According to the arrangement, the second heating member is heated using a simple structure occupying less space. This facilitates the mounting of a cleaning roller and other components.

It is preferred if the heater is such that the second heating member includes a member heated by induction heating, and the external heating member is an induction heating coil heating the second heating member by induction.

The arrangement enables the second heating member to directly heat up; there is little thermal radiation or convection heat loss from the surface of the second heating member. The external heating member hardly heats up, let alone make heat loss. This further improves heat efficiency.

It is preferred if the heater is such that the external heating member is shaped to have a curvature.

The arrangement develops a concentration of magnetic flux inside the induction heating coil as the external heating member and hence increases the magnitude of eddy current. This helps the second heating member heat up quickly.

It is preferred if the heater is such that a surface of the first heating member has a thermal capacity per unit length of less than or equal to 200 J/(m·° C.).

According to the arrangement, for example, warm-up time can be cut down to 30 seconds or less. This greatly reduces power consumption in standby.

It is preferred if the heater is such that the first heating member and the second heating member are rotatable rollers and fix toner on the heated material by passing the heated material in the press region.

The arrangement enables the use of the heater as a fixer. This enables reductions in power consumption through the smaller load, while securing toner's fixing performance, and prevents recording paper (recording medium) which is a heated material from creasing and curling up.

An image forming apparatus in accordance with the present invention is arranged so that it includes: an image transfer device forming an image of an unfixed toner on the heated material; and the heater described above fixing the unfixed toner on the heated material.

The arrangement provides a low power consumption image forming apparatus. In addition, for example, the heater can be used as a fixer. This enables reductions in power consumption through the smaller load, while securing toner's fixing performance, and prevents recording paper which is a heated material from creasing and curling up.

The arrangement also provides image forming apparatus containing a heater made up of long-life heating members and driver components.

A heating method in accordance with the present invention, as described in the foregoing, is a method of heating a heated material by passing the heated material through a press region where a first heating member and a second heating member meet so that any given point on the heated material passes through the press region in $2.3 \times 10^{-2}$ sec., and is arranged so that the method involves the step of heating the second heating member by an external heating member from outside the second heating member so that a surface temperature, T1 (° C.), of the first heating member and a surface temperature, T2 (° C.), of the second heating member satisfy $T1-T2 \leqq 100$ (° C.).

It is preferred if the heating method is such that the second heating member is heated by the external heating member from outside the second heating member so that the surface temperatures, T1, T2, of the first and second heating temperatures satisfy $T1-T2 \leqq 70$ (° C.).

According to the method, the surface temperature, T1 (° C.), of the first heating member and the surface temperature, T2 (° C.), of the second heating member satisfy either $T1-T2 \leqq 100$ (° C.) or $T1-T2 \leqq 70$ (° C.). This eliminates the need for an increase in surface pressure in the press region even in a high speed apparatus for which the transit time taken for any given point on the heated material to pass through the press region is less than or equal to $2.3 \times 10^{-2}$ sec. In other words, the method allows for a smaller load being applied to the heating members.

This allows for construction of thinner and smaller thermal capacity heating members, and hence reduces the warm-up time of the heater implementing the heating method. Therefore, pre-heating of the heating members becomes unnecessary. Power consumption in warm-up and standby is lowered.

It is preferred if the heating method controls the difference between the surface temperature of the first heating member and the surface temperature of the second heating member by controlling a surface temperature of the external heating member.

According to the method, the difference between the surface temperature of the first heating member and the surface temperature of the second heating member is controllable using a simple arrangement.

It is preferred if the heating method involves the step of controlling the surface temperature, T1 (° C.), of the first heating member and the surface temperature, T2 (° C.), of the second heating member so that $T1-T2 \leqq 30\times\ln(P)-72.5$ where P (kPa) is a surface pressure of the heated material in the press region.

The arrangement reduces T1−T2, which in turn increases the quantity of heat transferred to the heated material. This allows for a smaller load being applied to the heating members.

A heating method in accordance with the present invention, as described in the foregoing, is a method of heating a heated material by passing the heated material through a press region where a first heating member and a second heating member meet so that any given point on the heated material passes through the press region in $2.3\times10^{-2}$ sec., and is arranged so that the method involves the step of controlling so that a quantity, Q1, of heat transferred from the first heating member to the heated material while the heated material is passing through the press region and a quantity, Q2, of heat transferred from the second heating member to the heated material while the heated material is passing through the press region satisfy $Q2/(Q1+Q2) \geqq 0.25$.

It is preferred if the heating method involves the step of controlling so that the quantities Q1, Q2 satisfy $Q2/(Q1+Q2) \geqq 0.3$.

The method specifies the quantity of heat transferred to the heated material, not the temperature of the heating members. Regardless of from what material the heating members are made, similar effects are achieved to a case where the aforementioned surface temperature, T1, of the first heating member and surface temperature, T2, of the second heating member are determined to satisfy $T1-T2 \leqq 70$ (° C.). In other words, the method allows the load on the heating members to be reduced and enables lower power consumption.

It is preferred if the heating method involves the step of controlling a ratio, Q2/(Q1+Q2), of the quantity, Q2, of the heat transferred from the second heating member to the heated material and a total quantity, Q1+Q2, of heat transferred to the heated material by controlling a surface temperature of the second heating member using an external heating member heating the second heating member from outside.

According to the method, the external heating member controls Q2/(Q1+Q2). Therefore, according to the arrangement, the control of Q2/(Q1+Q2) is enabled by a simple structure.

It is preferred if the heating method involves the step of controlling so that a ratio, Q2/(Q1+Q2), of the quantity, Q2 (J), of the heat transferred from the second heating member to the heated material and a total quantity, Q1+Q2 (J), of heat transferred to the heated material satisfies $Q2/(Q1+Q2) \geqq -0.078\times\ln(P)+0.7$ where P (kPa) is a surface pressure of the heated material in the press region.

The arrangement allows for an increased Q2/(Q1+Q2) (In other words, the ratio of the quantity, Q2, of the heat transferred from the second heating member to the heated material) and a reduced required fixing load. This enables reduction in power consumption.

Another heater in accordance with the present invention, as described in the foregoing, includes a first heating member and a second heating member pressing each other, heats a heated material by passing the heated material through a press region where the first heating member and the second heating member meet, and is arranged so that the heater includes an external heating member rotating with the second heating member in contact with the second heating member and heating the second heating member so that the second heating member has a predetermined surface temperature, wherein a heating nip transit time taken for any given point on the second heating member in rotation to pass through a heating nip region where the second heating member contacts the external heating member is determined based on a material and thermal capacity of the external heating member, a power consumption in the heater while the heated material is passing through the press region, and a surface temperature of the external heating member while the heated material is passing through the press region.

According to the arrangement, the heating nip transit time can be determined in accordance with the material and thermal capacity of the external heating member so that, for example, the power consumption in the heater (first, second, and external heating members) while the heated material is passing through the press region is smaller than that in a heater without an external heating member and the surface temperature of the external heating member while the heated material is passing through the press region does not exceed a predetermined temperature (for example, heat resistance temperature).

Therefore, power consumption can be lowered by arranging the heater so as to achieve the determined heating nip transit time in this manner, although the external heating member is included.

It is preferred if the heater is such that when, for example, the external heating member is made of aluminum, the heating nip transit time t (ms) satisfies $0.0005V^2-0.283V+43.9 \leqq t \leqq 9.15$ where V (mm/sec.) is a transit speed at which the heated material passes through the press region.

It is preferred if the heater is such that when the heated material is a A4 sheet and passes through the press region so that a 210-mm long side of the heated material is parallel to a transit direction, the heating nip transit time t (ms) satisfies $0.0128P^2-1.36P+35.2 \leqq t \leqq 9.15$ where P (copies per minute) is a transit speed at which the heated material passes through the press region.

According to the arrangement, the heater allows for lower power consumption although the external heating member is included.

It is preferred if the heater is such that the external heating member warps 0.1 mm or less due to contact with the second heating member.

The arrangement provides the heating nip region and prevents the external heat roller from receiving excessive load.

It is preferred if the heater is such that when, for example, the external heating member is made of steel, the heating nip transit time t (ms) satisfies $0.0005V^2-0.351V+$ $56.2 \leqq t \leqq 13.10$ where V (mm/sec.) is a transit speed at which the heated material passes through the press region.

Alternatively, it is preferred if the heater is such that when the heated material is a A4 sheet and passes through the press region so that a 210-mm long side of the heated material is parallel to a transit direction (i.e., landscape orientation), the heating nip transit time t (ms) satisfies $0.0175P^2-1.96P+54.8 \leqq t \leqq 13.10$ where P (copies per minute) is a transit speed at which the heated material passes through the press region.

According to the arrangement, the heater allows for lower power consumption although the external heating member is included.

It is preferred if the heater is such that the steel either carbon steel or stainless steel.

Steels, such as carbon steel and stainless steel, have a high Young modulus. The arrangement therefore improves the mechanical strength of the external heating member.

It is preferred if the heater is such that the surface of the external heating member is covered with heat resistant resin.

According to the arrangement, the external heating member, as it rotates, smoothly contacts and separates from the second heating member. In addition, the external heating member is prevented from deforming due to an increased surface temperature of the external heating member.

It is preferred if the heater is such that a transit time taken for any given point on the heated material to pass through the press region is less than or equal to $2.3\times10^{-2}$ sec.

The arrangement enables the heater to be applicable to high speed apparatuses.

It is preferred if the heater is such that the first heating member and the second heating member are rotatable rollers and fix toner on the heated material by passing the heated material in the press region.

The arrangement enables the use of the heater as a fixer. This enables the image forming apparatus to incorporate a low power consumption fixer.

An image forming apparatus in accordance with the present invention is arranged so that it includes: an image transfer device forming an image of an unfixed toner on the heated material; and the heater described above fixing the unfixed toner on the heated material.

The arrangement enables the use of the heater as a fixer and provides a low power consumption image forming apparatus. In addition, when, the heater is applied to a high speed apparatus, the smaller load allows for a reduced power consumption even in a high speed apparatus, while securing toner's fixing performance and preventing recording paper (recording medium) which is a heated material from creasing and curling up.

A heating method in accordance with the present invention, as described in the foregoing, is a method of heating a heated material by passing the heated material through a press region where a first heating member and a second heating member meet, and is arranged so that the method involves the step of determining a heating nip transit time for any given point on the second heating member in rotation to pass through a heating nip region where the second heating member and the external heating member contact each other, based on a material and thermal capacity of an external heating member rotating with the second heating member in contact with the second heating member and heating the second heating member so that the second heating member has a predetermined surface temperature, power consumptions by the first heating member, the second heating member, and the external heating member, and a surface temperature of the external heating member.

According to the method, the heating nip transit time can be determined in accordance with the material and thermal capacity of the external heating member so that, for example, the power consumption in the heater (first, second, and external heating members) while the heated material is passing through the press region is smaller than that in a heater without an external heating member and the surface temperature of the external heating member while the heated material is passing through the press region does not exceed a predetermined temperature (for example, heat resistance temperature).

The method therefore heats the heated material on low power consumption by arranging the heater so as to achieve the determined heating nip transit time in this manner, although the external heating member is included.

It is preferred if the heating method is such that when, for example, the external heating member is made of aluminum, the heating nip transit time t (ms) satisfies $0.0005V^2-0.283V+43.9 \leqq t \leqq 9.15$ where V (mm/sec.) is a transit speed at which the heated material passes through the press region.

Alternatively, it is preferred if the heating method is such that when the heated material is a A4 sheet and passes through the press region so that a 210-mm long side of the heated material is parallel to a transit direction, the heating nip transit time t (ms) satisfies $0.0128P^2-1.36P+35.2 \leqq t \leqq 9.15$ where P (copies per minute) is a transit speed at which the heated material passes through the press region.

The method heats the heated material on low power consumption by specifying a range for the heating nip transit time t in accordance with the material (aluminum) of the external heating member, although the external heating member is included.

It is preferred if the heating method is such that when the external heating member is made of steel, the heating nip transit time t (ms) satisfies $0.0005V^2-0.351V+56.2 \leqq t \leqq 13.10$ where V (mm/sec.) is a transit speed at heated material passes through the press region.

Alternatively, it is preferred if the heating method is such that when the heated material is a A4 sheet and passes through the press region so that a 210-mm long side of the heated material is parallel to a transit direction, the heating nip transit time t (ms) satisfies $0.0175P^2-1.96P+54.8 \leqq t \leqq 13.10$ where P (copies per minute) is a transit speed at which the heated material passes through the press region.

The method heats the heated material on low power consumption by specifying a range for the heating nip transit time t in accordance with the material (steel) of the external heating member, although the external heating member is included.

A heater in accordance with the present invention, as described in the foregoing, includes a first heating member and a second heating member pressing each other, heats a heated material by passing the heated material through a press region where the first heating member and the second heating member meet, and is arranged so that the heater comprises an external heating member heating the second heating member so that the second heating member has a predetermined surface temperature, wherein the heated material passes through the press region between the first heating member and the second heating member either upward or downward.

According to the arrangement, the direction in which the heated material passes through the press region (transport direction for the heated material) is substantially vertical. A region is therefore downward with respect to the first and second heating members. This lowers heat dissipation by convection from the first and second heating members.

The air heated in the heater remain in the lower space than the first and second heating members, heating the second heating member. The heat efficiency of the heater is improved.

It is preferred if the heater the heated material passes through the press region in a substantially vertically upward direction.

According to the arrangement, for example, the heating members, where they face the cover housing the heater, rotate downward, exerting such a force to generate a downward flow of air in their vicinity. This helps the air in the heater heated by the first, second, and external heating members readily remain in the lower space.

It is preferred if the heater the first heating member and the second heating member pass the heated material by rotation; and most of a first region is positioned lower than a center of rotation of the second heating member, the first region being, in a cross-section, showing the external heating member, vertical to a center of rotation of the second heating member, a part of a surface of the second heating member stretching from a heating position of the external heating member to a heated material loading end of the press region in a rotational direction of the second heating member.

In typical situations, the second region is yet to be heated by the external heating member, whilst the first region is already heated by the external heating member; the temperature of the first region is therefore higher than the temperature of the second region. Therefore, the first region is likely to lose heat to the air by radiation compared to the second region.

However, according to the arrangement, most of the first region is positioned lower than center of rotation of the second heating member, and most of the first region faces downward. This reduces heat dissipation from the first region by convection. Therefore, the heater reduces radiation energy and improves heat efficiency.

It is preferred if the heater is such that a second region is wider than the first region, the second region being, in the cross-section, a part of the surface of the second heating member stretching from a heated material ejecting end of the press region to the heating position of the external heating member in the rotational direction of the second heating member.

The arrangement further reduces heat dissipation from the first region by convection. Therefore, the heater reduces radiation energy and improves heat efficiency.

It is preferred if the heater is such that the first heating member and the second heating member pass the heated material by rotation; and a center of a first region is positioned lower than a center of a second region, the first region being, in a cross-section, showing the external heating member, vertical to a center of rotation of the second heating member, a part of a surface of the second heating member stretching from a heating position of the external heating member to a heated material loading end of the press region in a rotational direction of the second heating member, the second region being, in the cross-section, a part of the surface of the second heating member stretching from a heated material ejecting end of the press region to a heating position of the external heating member.

According to the arrangement, the heated material is transported in a substantially vertically upward direction. Therefore, the air heated by the first, second, and external heating members readily remains in the lower space in the heater. This improves heat efficiency.

It is preferred if the heater is such that the external heating member is a roller rotating with the second heating member in contact with the second heating member.

According to the arrangement, the second heating member is heated using a simple structure occupying less space. This facilitates the mounting of a cleaning roller and other components.

It is preferred if the heater is such that a center of rotation of the external heating member is positioned lower than a center of rotation of the second heating member.

Typically, the air heated by the external heating member can readily flow out of the device through a heated material ejection opening.

However, according to the arrangement, the heated material ejection opening is located far from the external heating member in the heater. The structure better retains the heated air inside the heater. Heat efficiency is thus improved.

It is preferred if the heater is such that the second heating member includes a member heated by induction heating, and the external heating member is an induction heating coil heating the second heating member by induction.

The arrangement enables the second heating member to directly heat up; there is little thermal radiation or convection heat loss from the surface of the second heating member. The external heating member hardly heats up, let alone make heat loss. This further improves heat efficiency.

It is preferred if the heater is such that the external heating member is shaped to have a curvature.

The arrangement develops a concentration of magnetic flux inside the induction heating coil as the external heating member and hence increases the magnitude of eddy current. This helps the second heating member heat up quickly.

It is preferred if the heater is such that the first heating member and the second heating member pass the heated material by rotation; and the heater includes a cleaning member cleaning the surface of the second heating member, the cleaning member located upstream to the external heating member in the rotational direction of the second heating member.

It is preferred if the heater is such that the cleaning member is made of a metal.

According to the arrangement, the cleaning member is positioned above the external heating member. The cleaning member prevents the air heated by the external heating member from flowing out of the device through a heated material ejection opening on the heater. Heat efficiency thus improved.

In addition, the air heated by the external heating member pre-heats the cleaning member. The cleaning member therefore does not act as a thermal load. The provision of the cleaning member does not hamper the external heating member's function of heating the second heating member.

It is preferred if the heater is such that the cleaning member and the external heating member are positioned to face each other.

According to the arrangement, the thermal radiation heat from the external heating member is partly absorbed by the cleaning member, which reduces heat loss from the external heating member.

It is preferred if the heater fixes toner on the heated material by passing the heated material through the press region.

According to the arrangement, the heater is applicable as a fixer, providing a high heat efficiency fixer.

An image forming apparatus in accordance with the present invention is arranged so that it includes: an image transfer device forming an image of an unfixed toner on the heated material; and the heater described above fixing the unfixed toner on the heated material.

The arrangement provides a high heat efficiency image forming apparatus.

The embodiments and examples described in DESCRIPTION OF THE EMBODIMENTS are for illustrative purposes only and by no means limit the scope of the present invention. Variations are not to be regarded as a departure from the spirit and scope of the invention, and all such modifications as would be obvious to one skilled in the art are intended to be included within the scope of the claims below.

What is claimed is:

1. A heater, comprising a first heating member and a second heating member pressing each other, wherein said heater heats a heated material by passing the heated material through a press region where the first heating member and the second heating member meet, said heater further comprising an external heating member rotating with the second heating member in contact with the second heating member and heating the second heating member so that the second heating member has a predetermined surface temperature;

wherein a heating nip transit time taken for any given point on the second heating member in rotation to pass through a heating nip region where the second heating member contacts the external heating member is determined based on a material and thermal capacity of the external heating member, a power consumption in the heater while the heated material is passing through the press region, and a surface temperature of the external heating member while the heated material is passing through the press region.

2. The heater as set forth in claim 1, wherein:

the external heating member is made of aluminum; and the heating nip transit time t (ms) satisfies $0.0005V^2-0.283V+43.9 \leqq t \leqq 9.15$ where V (mm/sec.) is a transit speed at which the heated material passes through the press region.

3. The heater as set forth in claim 1, wherein:

the external heating member is made of aluminum; and when the heated material is a A4 sheet and passes through the press region so that a 210-mm long side of the heated material is parallel to a transit direction, the heating nip transit time t (ms) satisfies $0.0128P^2-1.36P+35.2 \leqq t \leqq 9.15$ where P (copies per minute) is a transit speed at which the heated material passes through the press region.

4. The heater as set forth in claim 1, wherein:

the external heating member is made of steel; and the heating nip transit time t (ms) satisfies $0.0005V^2-0.351V+56.2 \leqq t \leqq 13.10$ where V (mm/sec.) is a transit speed at which the heated material passes through the press region.

5. The heater as set forth in claim 1, wherein:

the external heating member is made of steel; and when the heated material is a A4 sheet and passes through the press region so that a 210-mm long side of the heated material is parallel to a transit direction, the heating nip transit time t (ms) satisfies $0.0175P^2-1.96P+54.8 \leqq t \leqq 13.10$ where P (copies per minute) is a transit speed at which the heated material passes through the press region.

6. An image forming apparatus, comprising:

an image transfer device forming an image of an unfixed toner on the heated material; and the heater as set forth in claim 1 fixing the unfixed toner on the heated material.

* * * * *